US009441629B2

(12) United States Patent
Kemp

(10) Patent No.: US 9,441,629 B2
(45) **Date of Patent: *Sep. 13, 2016**

(54) ROTARY COMPRESSOR HAVING GATE AXIALLY MOVABLE WITH RESPECT TO ROTOR

(71) Applicant: TORAD ENGINEERING, LLC, Cumming, GA (US)

(72) Inventor: Gregory T. Kemp, Alpharetta, GA (US)

(73) Assignee: Torad Engineering, LLC, Cumming, GA (US)

( * ) Notice: Subject to any disclaimer, the term of this patent is extended or adjusted under 35 U.S.C. 154(b) by 168 days.

This patent is subject to a terminal disclaimer.

(21) Appl. No.: 14/329,402

(22) Filed: Jul. 11, 2014

(65) Prior Publication Data

US 2015/0017046 A1 Jan. 15, 2015

Related U.S. Application Data

(63) Continuation of application No. 13/440,612, filed on Apr. 5, 2012, now Pat. No. 8,807,975, which is a continuation of application No. 12/218,151, filed on Jul. 11, 2008, now Pat. No. 8,177,536.

(60) Provisional application No. 60/995,319, filed on Sep. 26, 2007.

(51) Int. Cl.
*F03C 2/00* (2006.01)
*F03C 4/00* (2006.01)
(Continued)

(52) U.S. Cl.
CPC ..... *F04C 15/0007* (2013.01); *F01C 21/0836* (2013.01); *F01C 21/0845* (2013.01);
(Continued)

(58) Field of Classification Search
CPC ..... F04C 2/24; F04C 2/3442; F04C 2/3443; F04C 18/3442; F04C 15/0007; F04C 15/0026; F01C 1/44; F01C 19/005; F01C 21/0836; F01C 21/0845; F01C 21/0809
USPC ..... 418/260–261, 255, 257, 145–147
See application file for complete search history.

(56) References Cited

U.S. PATENT DOCUMENTS 3,134,600 A 5/1964 Fisch
3,357,412 A 12/1967 Sabet
(Continued)

OTHER PUBLICATIONS

Extended European Search Report issued on Oct. 19, 2015 for application EP 13755651.0, filed on Mar. 1, 2013 and published as EP 2820304 on Jan. 7, 2015 (Applicant—Torad Engineering, LLC // Inventor—Kemp, et al.) (7 pages).
(Continued)

*Primary Examiner* — Theresa Trieu
(74) *Attorney, Agent, or Firm* — Ballard Spahr LLP

(57) ABSTRACT

A rotary compressor having a housing and a rotor positioned within an internal cavity of the housing. The rotor being configured to rotate about a rotor axis of rotation eccentric to a housing longitudinal axis. A gate is also provided that is slidably mounted therewith the rotor and movable axially about and between a first position, in which a distal end of the gate is positioned at a first distance from the peripheral surface of the rotor, and a second position, in which the distal end of the gate is positioned at a second distance from the peripheral surface of the rotor. The distal end of the gate being constrained to be spaced proximate from the inner wall surface of the housing as the rotor rotates about the rotor axis of rotation.

51 Claims, 45 Drawing Sheets

(51) Int. Cl.

| | |
|---|---|
| ***F04C 2/00*** | (2006.01) |
| ***F04C 15/00*** | (2006.01) |
| ***F01C 21/08*** | (2006.01) |
| ***F04C 2/344*** | (2006.01) |
| ***F04C 2/24*** | (2006.01) |
| *F01C 19/00* | (2006.01) |

(52) U.S. Cl.
CPC ..... *F04C 2/24* (2013.01); *F04C 2/3442* (2013.01); *F04C 2/3443* (2013.01); *F01C 19/005* (2013.01); *F01C 21/0809* (2013.01); *F04C 15/0026* (2013.01)

(56) References Cited

U.S. PATENT DOCUMENTS

| | | | |
|---|---|---|---|
| 5,597,168 | A | 1/1997 | Antonini |
| 2009/0081063 | A1 | 3/2009 | Kemp |

OTHER PUBLICATIONS

First Office Action issued on Oct. 22, 2015 by the State Intellectual Property Office of the People's Republic of China for application CN 201380017773.4, filed on Jun. 1, 2014 and published as CN 104204527A on Dec. 10, 2014 (Applicant—Torad Engineering, LLC // Inventor—Kemp, et al.) (10 pages—original // 11 pages—translation).

ROTARY COMPRESSOR HAVING GATE AXIALLY MOVABLE WITH RESPECT TO ROTOR

CROSS-REFERENCE TO RELATED APPLICATIONS

This application is a continuation of U.S. application Ser. No. 13/440,612, filed Apr. 5, 2012, which is a continuation of U.S. application Ser. No. 12/218,151, filed on Jul. 11, 2008, which is now U.S. Pat. No. 8,177,536, issued May 15, 2012, which claims priority to and the benefit of U.S. Provisional Application No. 60/995,319, filed on Sep. 26, 2007. The disclosure of each of the above-referenced applications is hereby incorporated herein by reference in their entirety.

FIELD OF USE

According to various aspects, a rotary compressor is provided; more particularly a rotary compressor is provided having a gate that is configured to mount therein a housing and move in relation to an eccentric cam such that the gate's distal end is maintained at a substantially constant distance from an inner wall surface of the housing.

BACKGROUND

Various vane-type fluid displacement apparatuses have been proposed for use in certain limited applications. These proposed devices have primarily consisted of pumps, compressors, fluid driven motors, and fluid flow meters. The vane-type apparatuses heretofore proposed have generally performed satisfactorily and have gained acceptance for specific liquid applications. Common difficulties encountered with prior art vane-type apparatuses have included: an unsuitability for use with friction-reducing devices, which has traditionally limited their use to moderate power levels; a large fixed-surface to moving-surface contact area, resulting in high friction; an inability to withstand bending forces applied to the crankshaft; a reliance on discrete check valves or the like; and an inability to accommodate simultaneous reciprocating flow from each individual chamber.

Conventionally, a vane or gate compressor typically includes a cam ring, a rotor rotatably received within the cam ring, a drive shaft on which is secured the rotor, a front side block fixed to a front-side end face of the cam ring, a rear side block fixed to a rear-side end face of the same, a front head secured to a front-side end face of the front side block, a rear head secured to a rear-side end face of the rear side block, a plurality of axial vane slits formed in an outer peripheral surface of the rotor at circumferentially equal intervals, and a plurality of vanes radially slidably fitted in the axial vane slits, respectively. The drive shaft for rotating the rotor has opposite ends thereof rotatably supported by radial bearings arranged in the front and rear side blocks, respectively. Typically, a discharge chamber is defined by an inner wall surface of the front head, the front-side end face of the front side block, and the front-side end face of the cam ring, into which flows a liquid or gas delivered from compression chambers.

In another example of a prior art rotary compressor, the compressor mechanism can comprise a shaft adapted to be driven by a drive motor and having its upper and lower ends rotatably received by main and auxiliary bearings, respectively. An intermediate portion of the shaft extends through a cylinder that is fixed in position inside the sealed vessel.

An eccentric portion is mounted on a portion of the shaft positioned within the cylinder for rotation together therewith. Further, a ring-shaped roller is operatively positioned between an inner wall surface of the cylinder and an outer peripheral surface of the crank and will, while the shaft is rotatably driven, undergo a planetary motion.

In one example, the cylinder will have a radial groove defined therein so as to extend in a direction radially thereof, and a slidable radial vane is accommodated within the radial groove for movement within the radial groove in a direction towards and away from the ring shaped roller. This slidable radial vane is normally biased by a biasing spring in one direction with a radially inward end thereof held in sliding contact with an outer peripheral surface of the ring-shaped roller such that, by dividing the volume of the cylinder into volumetrically variable, suction and compression chambers are defined on leading and trailing sides of the slidable radial vane, with respect to the direction of rotation of the shaft.

In this example, a liquid or gas is sucked into the suction chamber through the intake port and then compressed before it is discharged through a discharge port during the planetary motion of the ring-shaped roller as a result of the eccentric rotation of the crank. In order to facilitate a sliding motion of the ring-shaped roller relative to the inner wall surface of the cylinder and the radial inner end of the slidable radial vane and also a sliding motion of the radial vane within the radial groove, a quantity of lubricating oil is accommodated within the sealed vessel at a bottom portion thereof. In one example, the lubricating oil is sucked up by an oil pump mounted on the lower end of the shaft to oil various sliding elements within the compressor mechanism.

Of the various sliding elements used in such a conventional compressor mechanism, the slidable radial vane creates a detrimental problem when it becomes worn. As is well known to those skilled in the art, the slidable radial vane is frictionally engaged not only with the ring-shaped roller, but also with side surfaces defining the radial groove in the cylinder. Specifically, by the biasing force of the biasing spring and a back pressure acting on the trailing surface of the slidable radial vane, the radial inner end of the slidable radial vane is constantly held in frictional engagement with the ring-shaped roller and, also, opposite side surfaces of the slidable radial vane are alternately held in frictional engagement with the corresponding side surfaces defining the radial groove by the effect of a pressure difference between the suction and compression chambers. Unlike other sliding elements such as, for example, the shaft and its bearing mechanism, the slidable radial vane is not lubricated by the lubricating oil supplied directly by the oil pump, but is typically lubricated by an oil component, contained in the liquid or gas being compressed, and/or an oil leaking from roller ends. The quantity of the oil available from the fluid being compressed and leaking from the roller ends is normally insufficient for lubricating the slidable radial vane and its surrounding parts satisfactorily. In addition, considering that the fluid reaches an elevated temperature when compressed, the slidable radial vane in contact with the fluid being compressed becomes heated and is therefore susceptible to an accelerated frictional wear.

In such conventional vane pumps, as speed of the pump is increased, the centripetal force acting on the vane(s) presses them aggressively against the inner surface of the constraining housing, which beneficially provides a solid sealing force but also detrimentally creates high frictional forces between the vane's distal end and the inner surface of the housing. As one skilled in the art will appreciate, this increases frictional wear as well as reduces the compressor's operating efficiency.

U.S. Pat. No. 3,821,899 teaches a vane-type meter for use with petroleum or other fluid products. Its structure comprises: a housing having an inlet port and an outlet port; a rotating interior disc; an interior shaft held with respect to the rotating disk in a fixed, eccentric position with respect to the rotating disc; four radially extending, articulated vanes which rotate within the housing about the interior shaft; and four valving structures extending perpendicularly from the outer periphery of one side of the rotating disc. Each of the vanes includes an inner vane element consisting of: a substantially flat body; a single closed ring which extends from one end of the body and is rotatably positioned around the interior shaft; and an elongate, open C-shaped groove extending along the opposite end of the body. Each articulated vane also includes an outer vane element consisting of: a substantially flat body; an elongate pentil structure is formed along one end of the body and pivotally held in the C-shaped groove formed on the inner member; and a second elongate pentil structure formed along the other end of the body. The second pentil structure is pivotally held in one of the valving structures.

Fluid flow through the meter of U.S. Pat. No. 3,821,899 causes the disc, valving ports, and articulated vanes to rotate within the meter housing. As they rotate, the vanes form compartments, which change in volume and through which known amounts of liquid, are transferred from the inlet to the outlet of the device. Thus, the rotational speed of the device provides a direct indication of the fluid flow rate.

U.S. Pat. No. 2,139,856 discloses a pump or fluid-driven engine employing articulated vanes having shaped outer surfaces. The vanes form fluid chambers which continuously change in volume. In one embodiment, the apparatus of U.S. Pat. No. 2,139,856 comprises: a housing; a cylindrical casing held in fixed position within the housing; a crankpin mounted in the casing for eccentric revolving movement; eight articulated, two-part vanes, each having an inner end pivotally connected to the crankpin and an outer end pivotally connected to the casing; eight flow ports provided through a sidewall of the displacement chamber; a flow chamber provided between the casing and the housing; and eight flow ports and associated check valves provided in the casing between the outer ends of the vanes.

In a second embodiment of the device of U.S. Pat. No. 2,139,856, the crankpin is held at a fixed eccentric position within the casing and the casing rotates within the housing. As the casing rotates about the eccentrically positioned crankpin, the compartments formed by the articulated vanes successively draw fluid from inlet ports formed through one of the flat sidewalls of the displacement chamber, and then discharge the fluid through one or more fixed ports in the housing. Each of the articulated vanes has either one or two closed rings formed on the inner end thereof. These inner closed rings are rotatably positioned around the crankpin.

As previously noted, devices such as those proposed by U.S. Pat. No. 2,139,856 and U.S. Pat. No. 3,821,899 have several shortcomings. First, the devices fail to provide any adequate means for reducing frictional forces generated within the moving articulated vane assemblies. Additionally, the cost and complexity of the devices is significantly increased by the required use of completely separate fluid intake and discharge valve systems and/or port structures. Further, the devices provide no means for creating, accessing, and utilizing reciprocating flow regimes between adjacent pairs of articulate vanes. Also, the devices disclose no means for selectively configuring the vanes and displacement chambers in order to obtain specific desired flow patterns. Additionally, these designs have large and significant areas of metal-to-metal sliding contact with no means shown for reducing friction between the parts.

Thus, what is needed is a rotary compressor type device that experiences reduced frictional forces within its articulated rotary assemblies. Additionally, the device should be one that can be assembled, operated, and maintained cost effectively. Further, the device should be one that is more efficient and produces less noise and vibration during operation.

SUMMARY

In various aspects, a rotary compressor is provided that more efficiently compresses a fluid, such as a liquid or gas, for a given energy input and does so with a lighter construction and improved output per cubic inch of overall size. In various aspects, the rotary compressor described with respect to various aspects herein does not rely on fixed cycle phases, eccentric shafts that induce friction, problematic compression chamber shapes, and does not tax the current state of the art in material sciences to accomplish its operational goals. It is contemplated that, in various embodiments, the device described herein can be used as a compressor for gaseous flow under pressure, or as a vacuum pump, or as a portion of a refrigeration assembly, or as a portion of a fluid power assembly, or as an expander for high pressure gases such as steam, or as a flow meter, or as a portion of an engine assembly that is constructed to operate as an internal combustion engine. In the latter example of an internal combustion engine, one skilled in the art will appreciate that how well such an engine brings in air, compresses it, captures the expansive forces, and then exhausts the burned gases, all determine the engine's relative performance and efficiency. In another aspect, the rotary compressor can be used as the compressor stage of a turbine engine as a means to achieve high pressure ratios within a small package. In other aspects, the rotary compressor can be used as the air feed compressor to a fuel cell package to supply high volumes of air at relatively low pressures. In some aspects, the rotary compressor can be configured as a supercharger for an internal combustion engine. In yet another aspect, the rotary compressor can be used as a waste heat recovery device when adapted into a bottoming cycle for known thermodynamic operations.

A rotary compressor described according to various aspects herein provides a purely rotational device that minimizes all of the conventional compressor stresses, and thusly, can be made from lighter materials with fewer structural requirements. In one aspect, the rotary compressor can be configured such that the intake fluid is ingested into an expanding space created by the relative motion between one solid element and another solid element. In this aspect, both elements form the ends of an expanding space as at least one of the elements moves in translation with respect to multiple inner surfaces disposed concentrically to said element's motion, said inner surfaces forming a passageway for the moving element to pass through and being sealed with sealing elements such that a substantial vacuum or substantial pressure can be created within the defined chamber as the moving element translates with respect to the volume-defining inner surfaces and with respect to the other element which can be fixed or moving in a chosen manner, typically also in a concentric nature to the first moving element. By providing ports that are fluidly connected to the working chamber provided during the intake stage of the device's operation, fluid (such as a liquid, gas such as air, or a two or three phase material) can enter into the working chamber as desired.

In another aspect, the intake tract of the rotary compressor can be configured to have low turbulence during intake chamber filling, which reduces turbulence losses and improves volumetric efficiency.

To create a functional rotary compressor, it is contemplated that in some aspects of the assembly, the opposing elements that are placed within the defined volume and are surrounded by the inner surfaces described above can move relative to each other and a port can be opened such that a liquid or gas can be allowed to enter the defined volume and at some point the port can be closed and the opposing elements moved toward each other in such a way as to reduce the volume contained within the defined space. The reduction in volume serves to increase the pressure within the defined space and, at a chosen point, a port (an additional port or the same port) can be allowed to open and the pressurized liquid or gas is allowed to escape the defined volume and put to other chosen uses.

In other aspects, the rotary compressor's rotational elements can be used to pump oil and/or coolant within the device without the need for auxiliary pumps, which simplifies the overall mechanical design. In another aspect, the rotary compressor may not need the use of an eccentric shaft and thusly can have lower frictional losses and provide a more direct conversion of the energy required to rotate the shaft into a compressed gas/liquid.

Additional advantages will be set forth in part in the description which follows, and in part will be obvious from the description, or can be learned by practice of the device described according to various aspects herein. The advantages of the device will be realized and attained by means of the elements and combinations particularly pointed out in the appended claims. It is to be understood that both the foregoing general description and the following detailed description are exemplary and explanatory only and are not restrictive of the device, as claimed.

BRIEF DESCRIPTION OF THE DRAWINGS

The accompanying drawings, which are incorporated in and constitute a part of this specification, illustrate several aspects of the invention and together with the description, serve to explain various principles of the invention.

DETAILED DESCRIPTION

The present invention may be understood more readily by reference to the following detailed description and drawings, and their previous and following description. Before the present devices, systems, and/or methods are disclosed and described, it is to be understood that this invention is not limited to specific devices, systems, and/or methods disclosed unless otherwise specified, as such can, of course, vary. It is also to be understood that the terminology used herein is for the purpose of describing particular aspects only and is not intended to be limiting.

As used herein, the singular forms "a," "an," and "the" include plural referents unless the context clearly dictates otherwise. Thus, for example, reference to a "gate" can include two or more such gates unless the context indicates otherwise.

Ranges may be expressed herein as from "about" one particular value to "about" another particular value. When such range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

Reference will now be made in detail to the present preferred aspects of the invention, examples of which are illustrated in the accompanying drawings.

It is contemplated that the device described according to various aspects herein can function as a compressor, a pump, a flow meter, an expander, and/or an engine. Generally, for clarity, the device is described herein as a rotary compressor, but it is of course contemplated, as one skilled in the art will appreciate, that the device can function in a variety of applications such as described above. The working fluid in any particular application can be a liquid, a gas, or can comprise a two-phase flow regime as desired for the selected application of the device.

Figure 1:
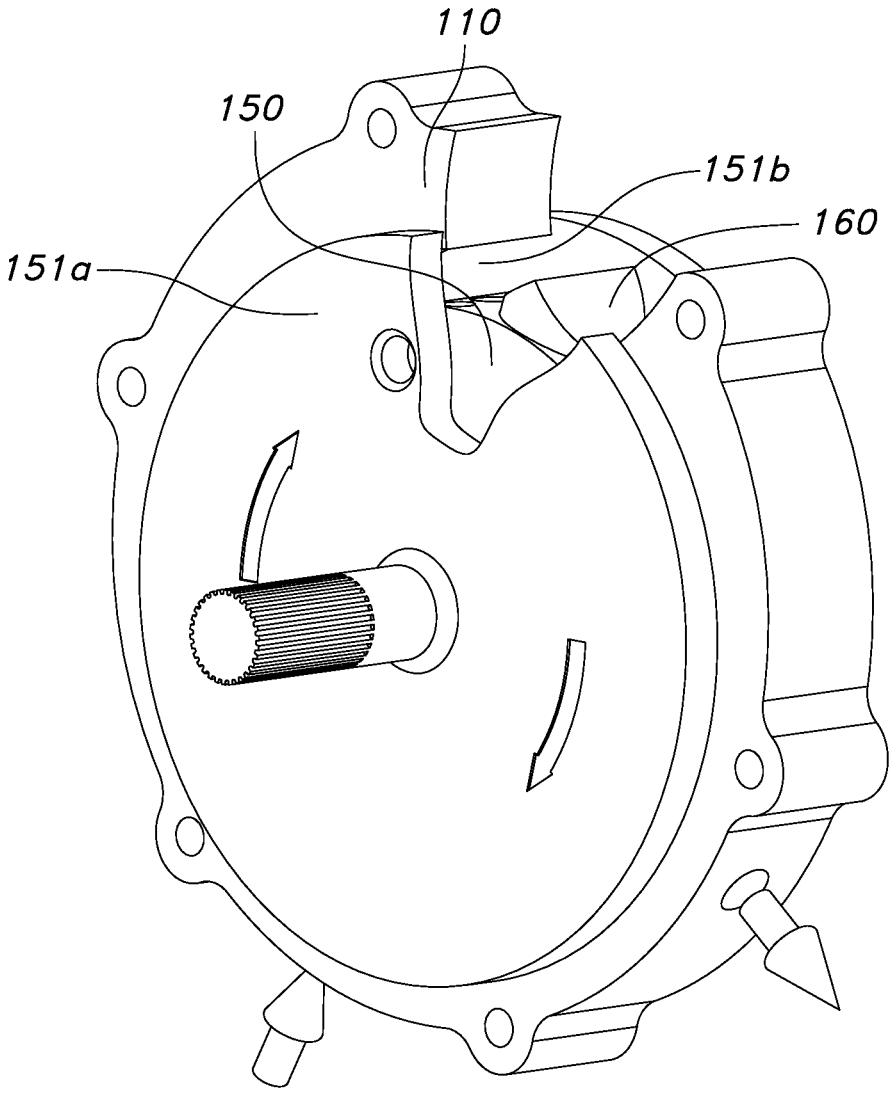
FIG. 1 is an exemplary schematic perspective view of a portion of a rotary compressor, showing a rotor rotating clockwise therein a housing, a first end plate and a second end plate mounted to portions of the rotor, and a distal end portion of a gate that is movable with respect to the rotor.
Figure 3:
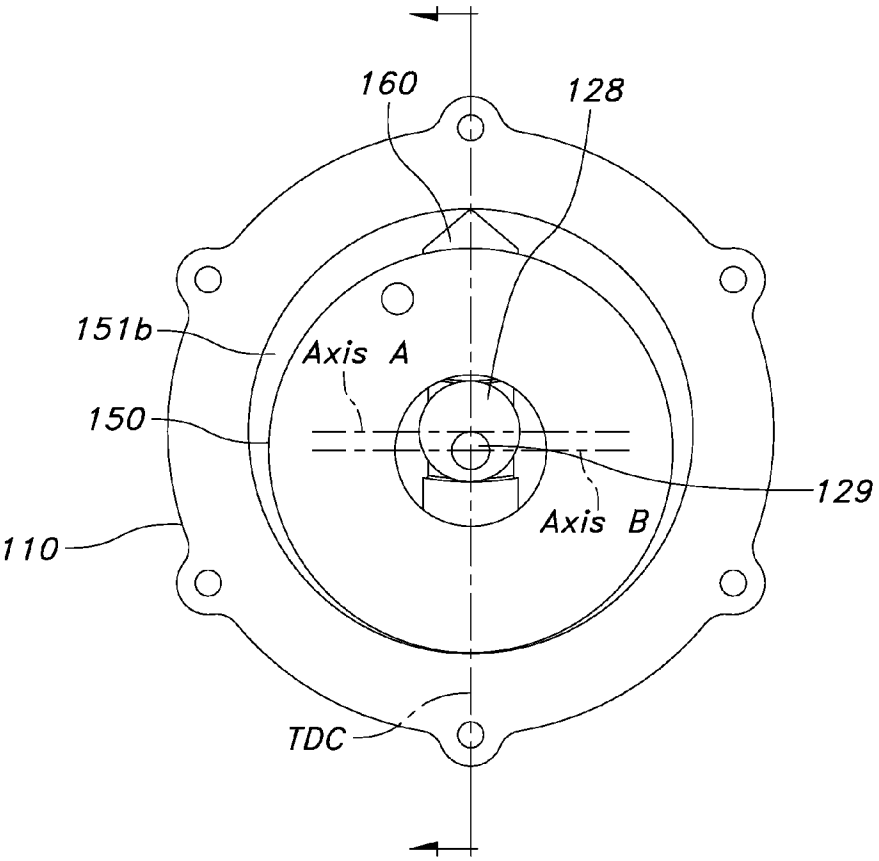
FIG. 3 are an exemplary schematic cross-sectional view and an exemplary partial front elevational view showing the relative positioning of the rotor, gate and eccentric cam therein the housing of the rotary compressor of FIG. 1.
Figure 3:
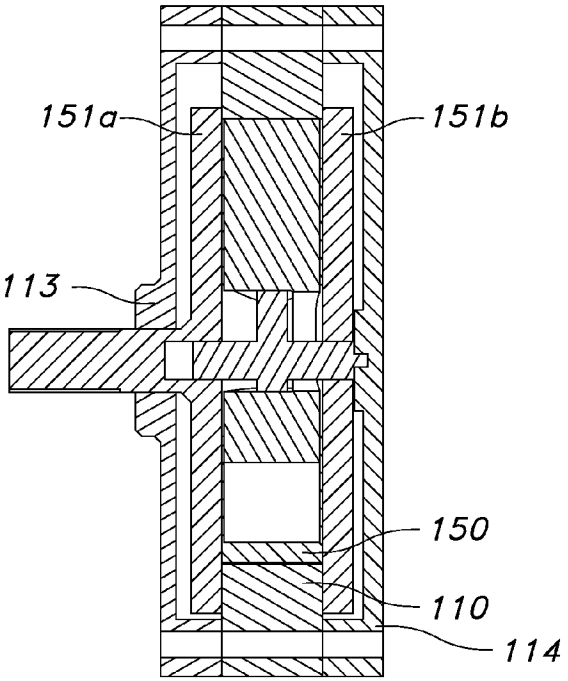

According to one aspect, a rotary compressor is provided that comprises a housing, a rotor, and a gate. An exemplary rotary compressor is illustrated in FIG. 1. The housing 110, in one aspect, defines an internal cavity having an inner wall surface. The housing further has a longitudinal axis that extends transverse to a housing plane that bisects the inner wall surface. The rotor 150, in one aspect, has a peripheral surface and can be positioned within the internal cavity of the housing. The rotor can be configured to rotate about a rotor axis of rotation. According to a particular aspect, the rotor axis of rotation (Axis B of FIG. 3) is eccentric to the housing longitudinal axis (Axis A), such as illustrated in FIG. 3. The gate 160, in one aspect, has a distal end and is configured to slidably mount therewith the rotor. The gate can be movable axially about and between a first position, in which the distal end of the gate is positioned at a first distance from the peripheral surface of the rotor, and a second position, in which the distal end of the gate is positioned at a second distance from the peripheral surface of the rotor. According to a further aspect, the distal end of the gate can be constrained to be spaced proximate from the inner wall surface of the housing as the rotor rotates about the rotor axis of rotation.

Figure 2:
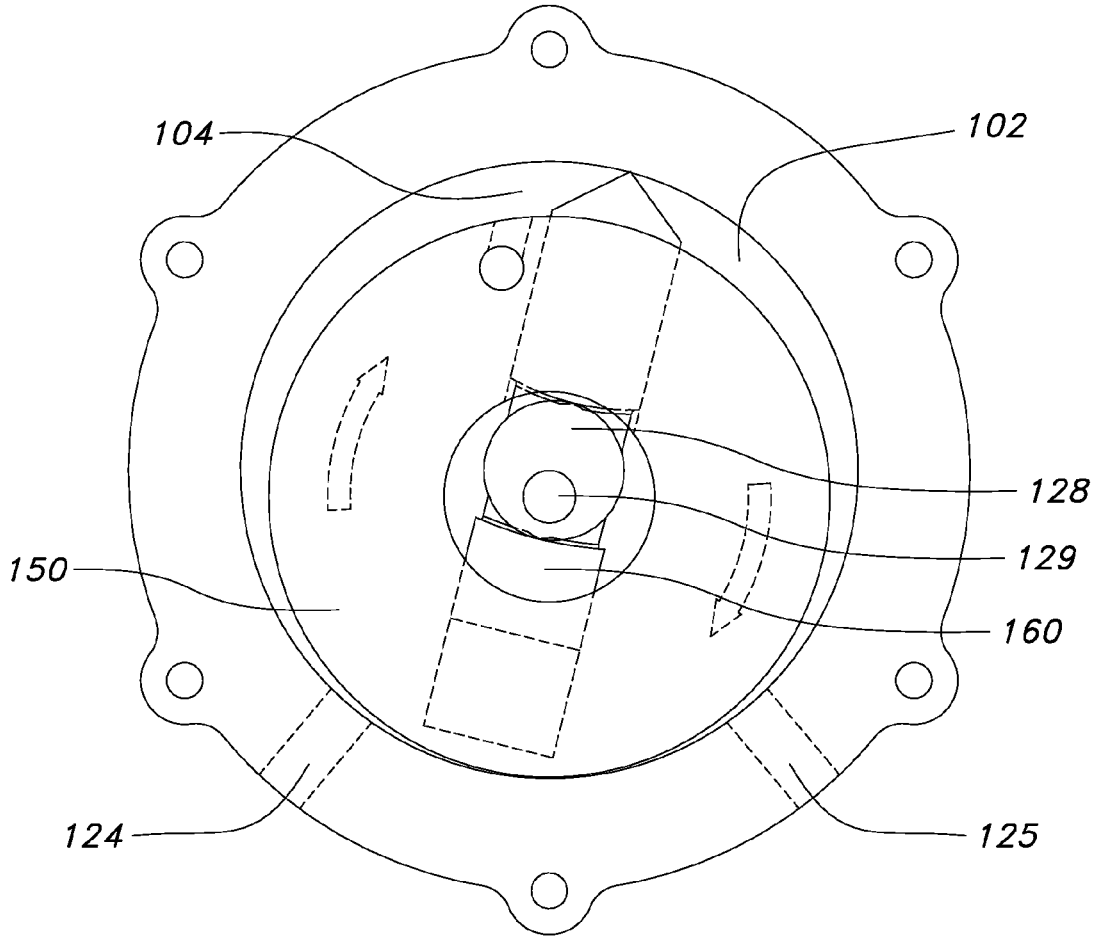
FIG. 2 is an exemplary schematic cross-sectional view of the clockwise rotation of the rotor within the housing, showing respective compression and suction chambers being formed as a result of the rotation, and showing the gate moveable with respect to the rotor and about an eccentric cam.

According to yet another aspect, at least portions of the peripheral surface of the rotor, portions of the inner wall surface of the housing, and varying portions of the gate proximate the distal end of the gate can define a compression chamber 102 of varying volume as the rotor rotates about the rotor axis of rotation. At least portions of the peripheral surface of the rotor, portions of the inner wall surface of the housing, and varying portions of the gate proximate the distal end of the gate can also define a suction chamber 104, such as illustrated in FIG. 2. As shown in FIG. 2, as the rotor is rotated (such as in the direction of the arrows), the suction chamber 104 volume behind the gate increases, while the compression chamber 102 volume decreases.

Figure 4A:
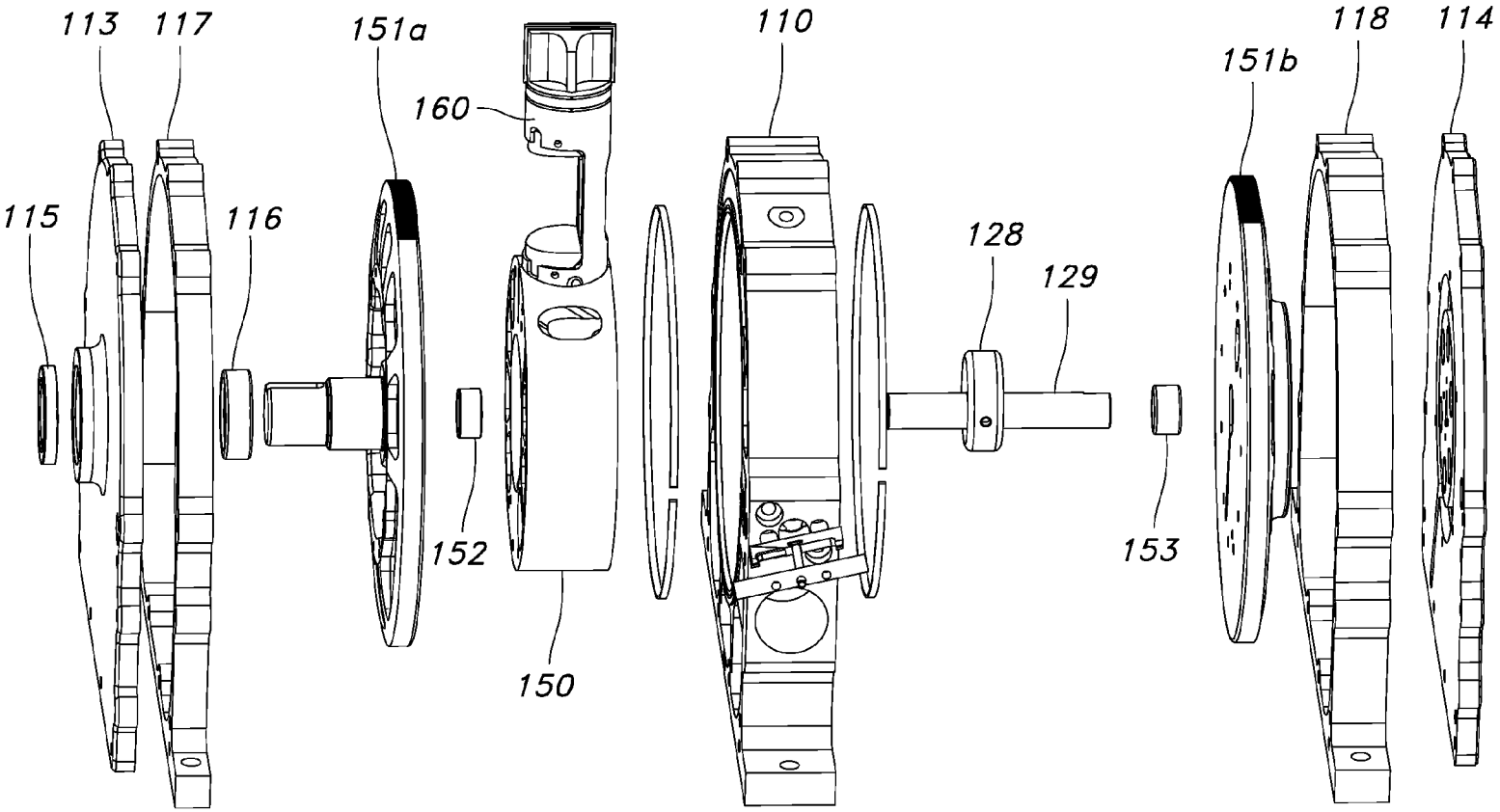
FIG. 4A is an exploded perspective view of one embodiment of a rotary compressor, showing, from left to right, a housing shaft seal, a housing front cover, a housing front spacer, a housing main bearing, a first end plate, a rotor front bearing, a rotor, a gate, a pair of front housing seals, a TDC assembly, a housing, a pair of back housing seals, an eccentric cam, an eccentric shaft, a rotor back bearing, a second end plate, a housing back spacer, and a housing back cover.
Figure 4B:
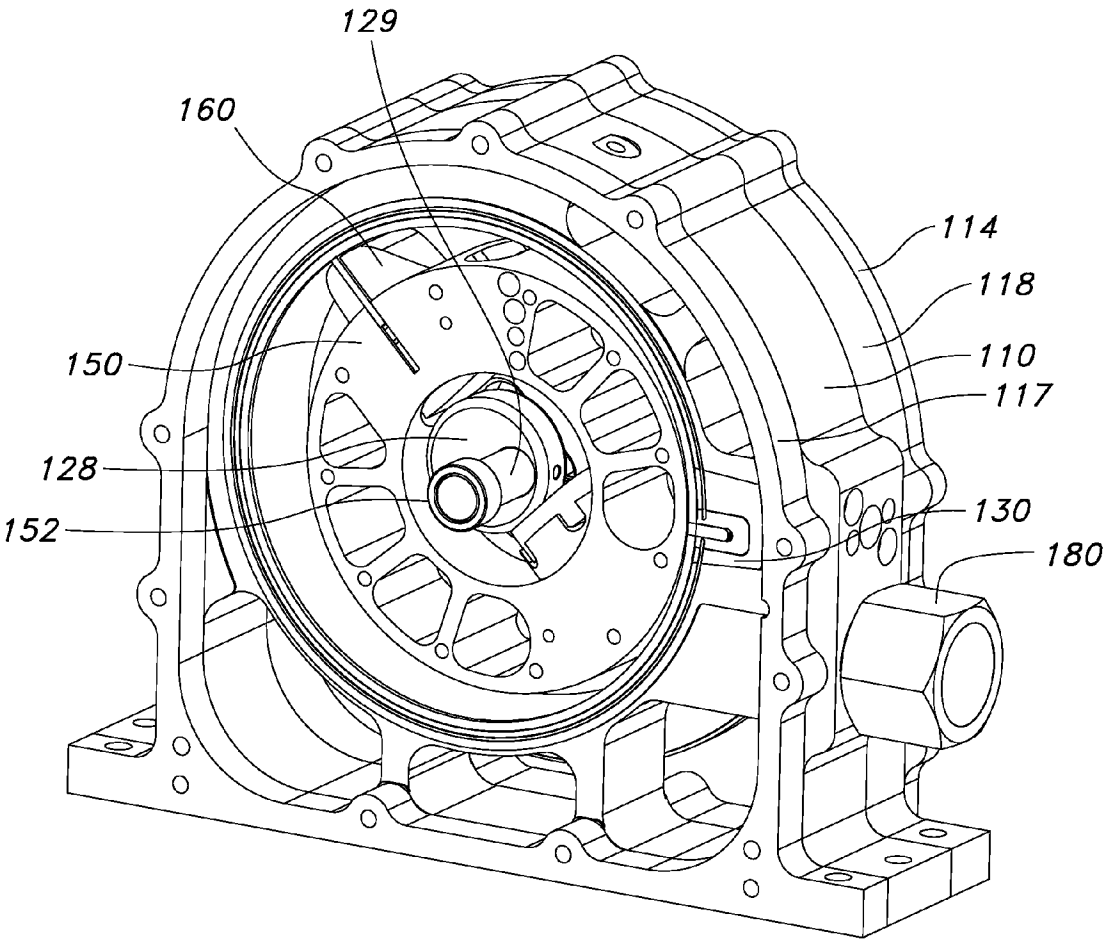
FIG. 4B is a partial assembled perspective view of the rotary compressor of FIG. 4A.
Figure 5:
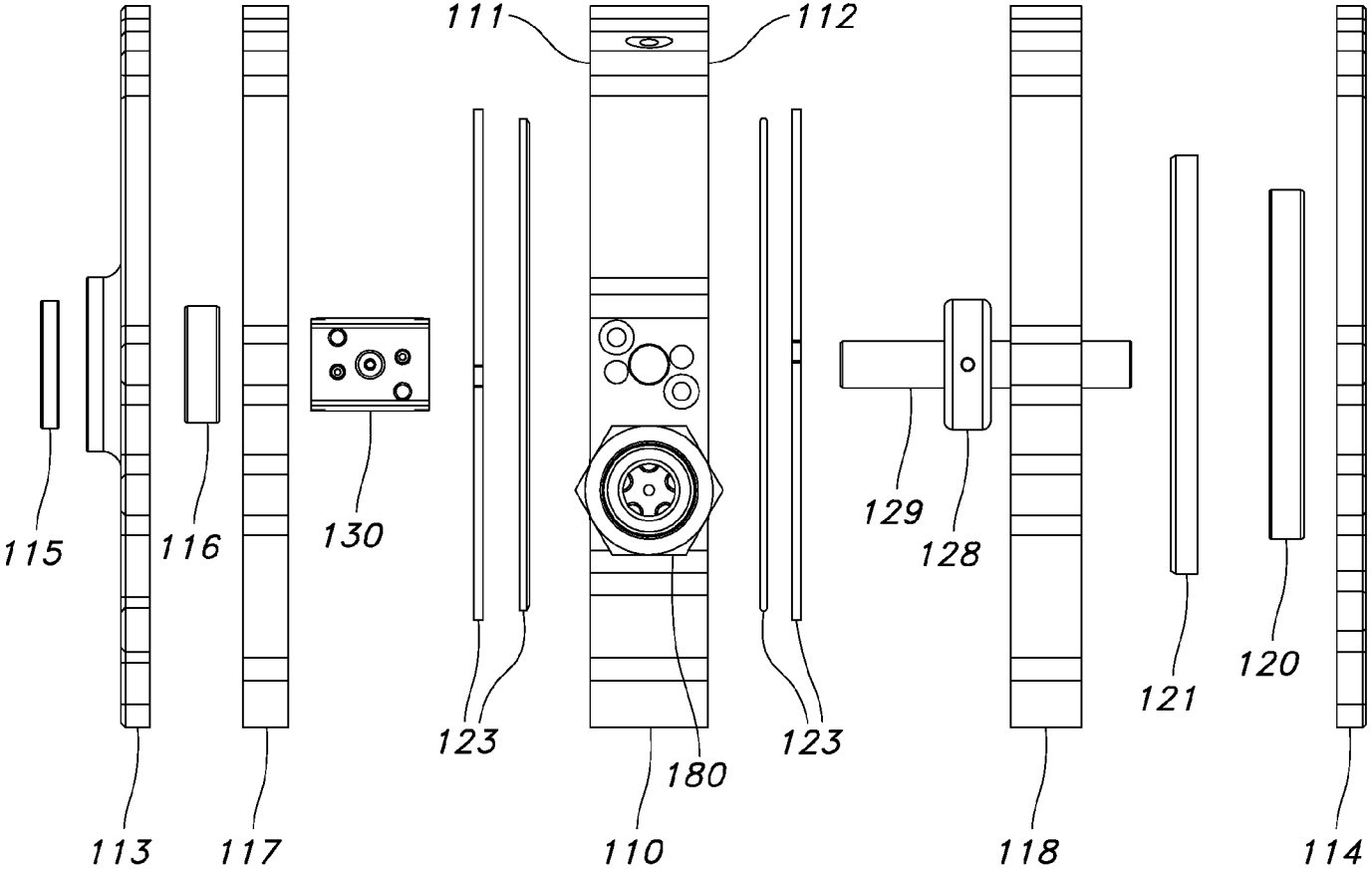
FIG. 5 is a side elevational exploded view of a housing assembly of the rotary compressor of FIG. 4A, showing, from left to right, a housing shaft seal, a housing front cover, a housing main bearing, a housing front spacer, a TDC assembly, a pair of front housing seals, a housing, a plate valve assembly, a pair of back housing seals, an eccentric cam, an eccentric shaft, a housing back spacer, a housing seal retainer, a housing intake seal, and a housing back cover.

An exemplary rotary compressor is illustrated in FIGS. 4A and 4B. In one aspect, the rotary compressor comprises a housing assembly, such as illustrated in FIG. 5. In a particular aspect, such as illustrated in FIG. 5, a housing assembly is provided that comprises the housing 110. The housing assembly, in one aspect, further comprises a housing front cover 113 and a housing back cover 114. The housing assembly can further comprise at least one of a housing shaft seal 115, a housing main bearing 116, a housing front spacer 117, a housing back spacer 118, a housing intake seal retainer 121, and a housing intake seal 120.

Figure 6:
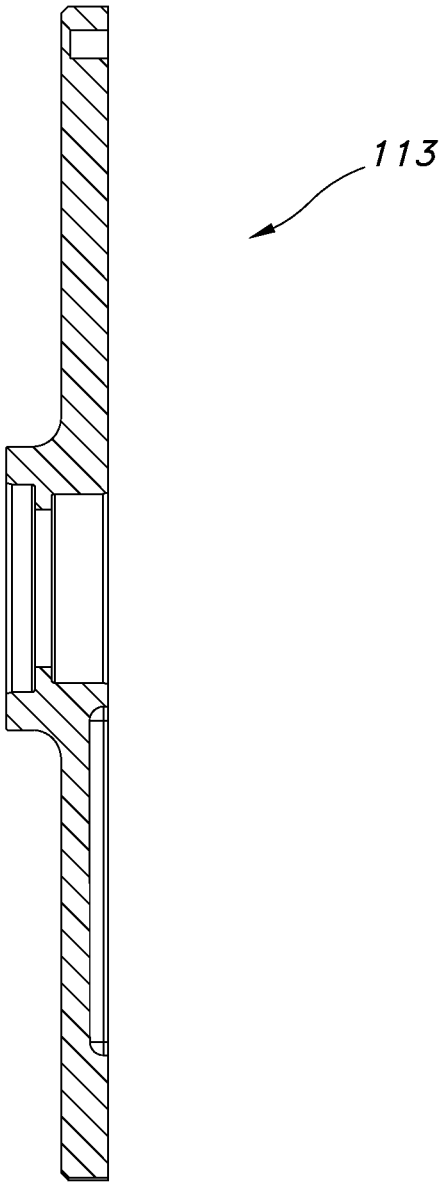
FIG. 6 is a cross-sectional view of a housing front cover of the rotary compressor of FIG. 5.

An exemplary housing front cover 113 is illustrated in FIG. 6. In one aspect, the housing front cover can be substantially plate-like and can have a front surface and an opposed back surface. The housing front cover can define a bore that extends through the front cover. Optionally, the bore can be formed in three portions, such that each portion has different dimensions, such as shown in FIG. 6. At least a portion of the bore, such as the portion formed adjacent the back surface of the housing front cover, is configured to receive the housing main bearing. As one would appreciate, the housing main bearing can also define a bore that is configured to receive a proximal portion of an eccentric shaft (such as described in further detail below). In a further aspect, at least a portion of the bore of the housing front cover, such as the portion formed adjacent the front surface of the front cover, can be configured to receive the housing shaft seal.

Figure 7:
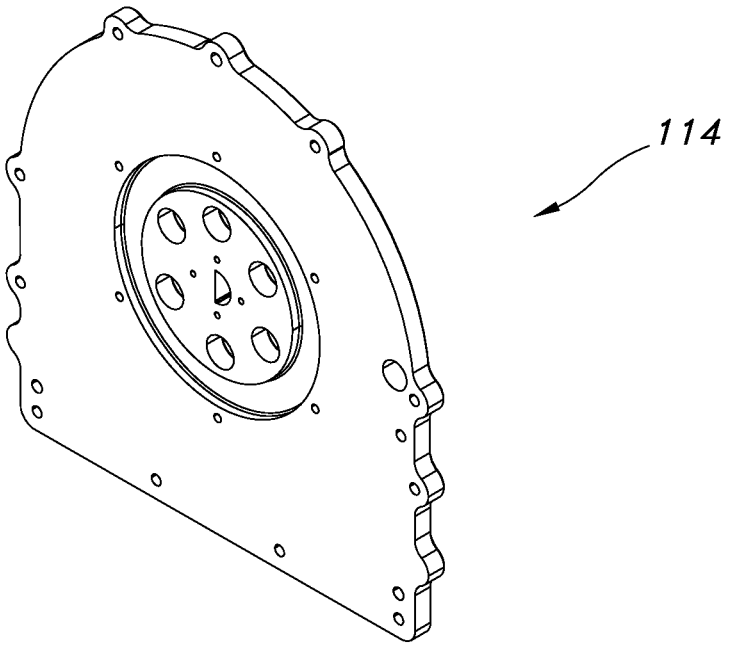
FIG. 7 is a perspective view of a housing back cover of the rotary compressor of FIG. 4A.

An exemplary housing back cover is illustrated in FIG. 7. In one aspect, the housing back cover 114 has at least one bore defined therein that is configured or complementarily shaped to receive a distal end of an eccentric shaft. As described further herein below, the distal end of the eccentric shaft can be configured or cut to have a predetermined cross-sectional shape, such as but not limited to a non-circular cross-sectional shape, for the purpose of locking the eccentric shaft from rotating. In another aspect, at least one hole can be defined in the housing back cover (for example, radially around the aforementioned back cover bore as shown in FIG. 7) that is configured to provide an intake passageway. As will be described in more detail below, the intake passageway can be in fluid communication with an inlet port therein the rotor, the gate, the housing, and/or one or both of the first and second end plates. In a further aspect, a housing intake seal retainer 121 (shown for example in FIG. 5) is provided, along with an intake seal 120, to seal the intake passageway. Optionally, the intake passageway can be formed therein the housing at a predetermined position to allow for sufficient fluid passage into the suction chamber of the rotary compressor.

Figure 8:
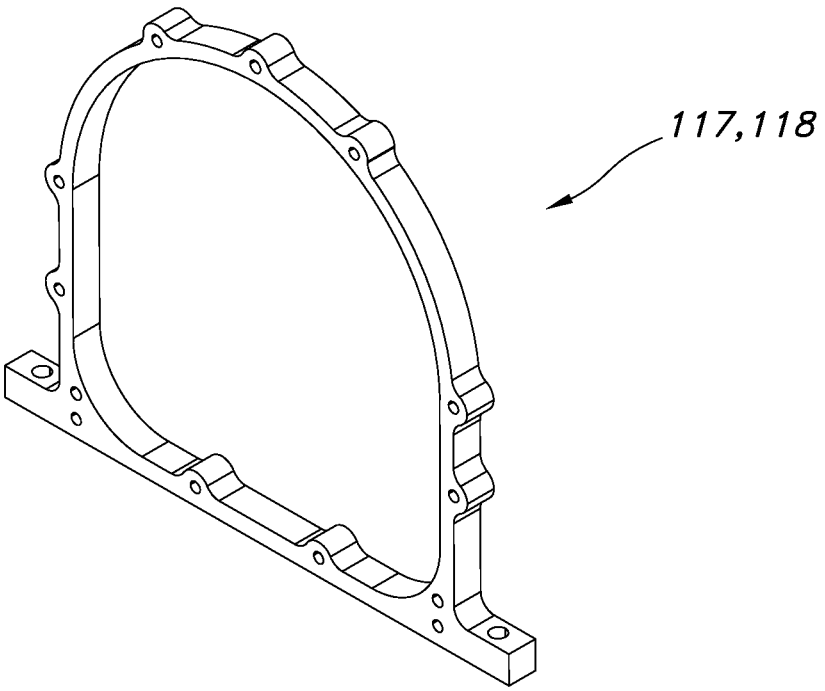
FIG. 8 is a perspective view of an exemplary housing front or back spacer of the rotary compressor of FIG. 4A.

FIG. 8 illustrates an exemplary housing spacer, such as a housing front spacer 117 or a housing back spacer 118. As can be seen in FIG. 5, the housing front spacer is configured to be positioned between the housing front cover 113 and the front surface of the housing 111. Likewise, the housing back spacer is configured to be positioned between the housing back cover 114 and the back surface of the housing 112. It is contemplated that, in various embodiments, either or both of the housing front and back covers, and/or the housing, can be constructed such that the spacing provided by the front and back spacers is integrated into the front and back covers and/or the housing.

Figure 9:
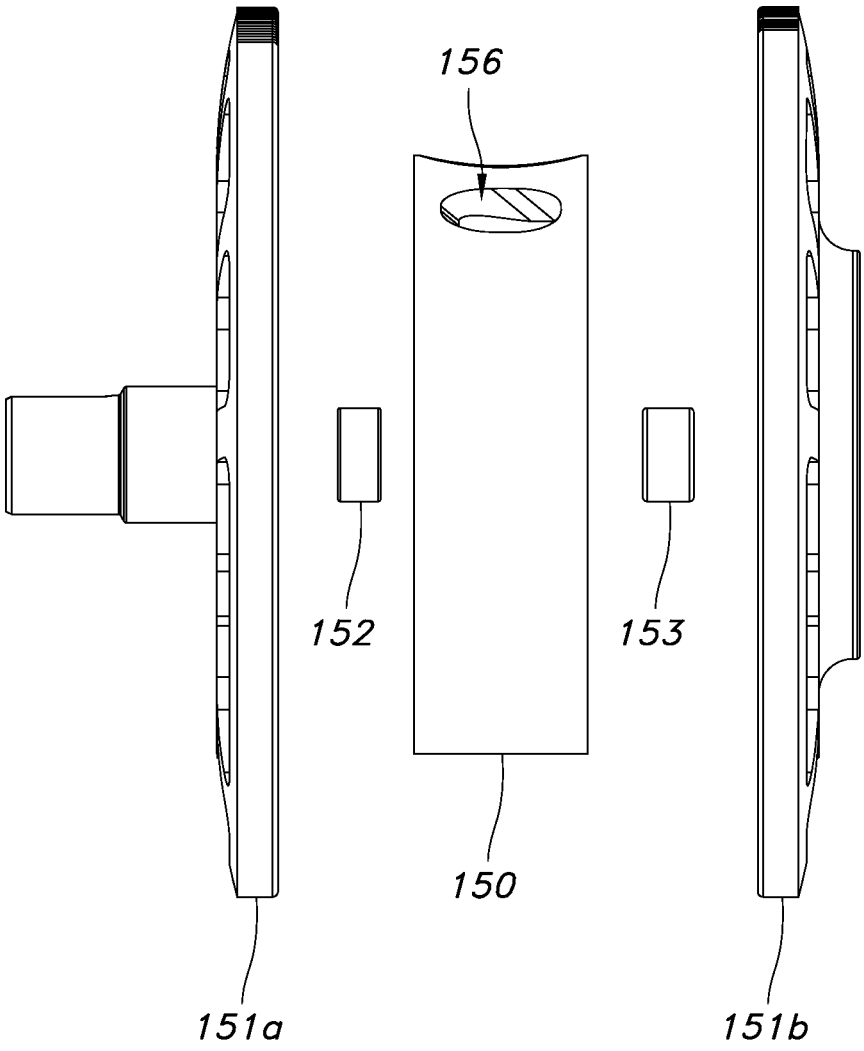
FIG. 9 is a side elevational exploded view of one embodiment of the rotor assembly of the rotary compressor of FIG. 4A, showing, from left to right, a first end plate, a rotor front bearing, a rotor, a rotor back bearing, and a second end plate.
Figure 11:
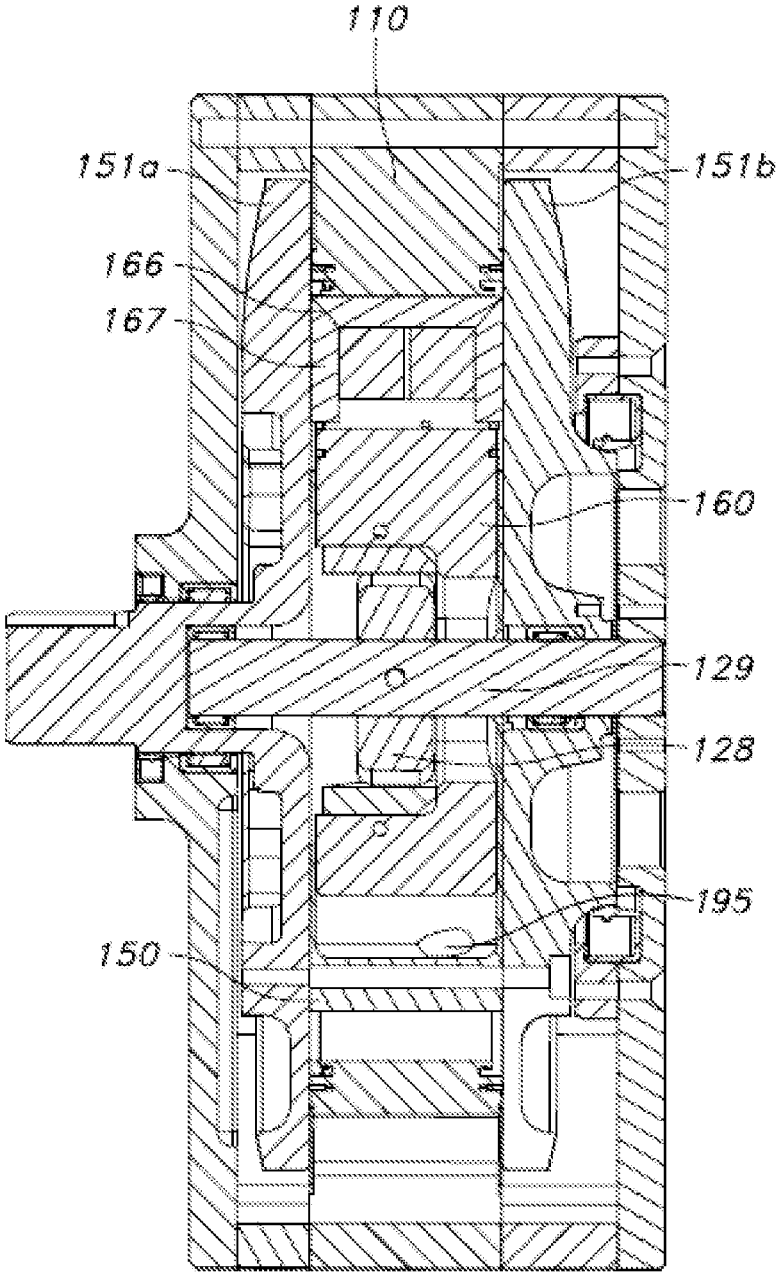
FIG. 11 is a schematic cross-sectional view of one embodiment of a rotor operatively mounted therein the housing assembly of the rotary compressor, showing the gate movable about the eccentric cam and movable relative to the outer surface of the rotor.

An exemplary rotor 150 is illustrated in FIG. 9. In one aspect, the rotor has a first side surface and an opposed second side surface. The rotor, in one aspect, can be generally cylindrical in shape; however, other geometries are contemplated, such as can be chosen to alter the volumetric flow of fluid within the rotary compressor. The rotary compressor can comprise a pair of end plates 151*a*, 151*b* that are mounted to and rotate therewith the respective first and second side surfaces of the rotor. The housing 110, in one aspect, has a front surface and an opposed back surface. In one aspect, portions of a first end plate 151*a* f the pair of end plates sealingly and slidably contact portions of the front surface of the housing, such as illustrated in FIG. 11. Similarly, portions of a second end plate 151*b* of the pair of end plates sealingly and slidably contact portions of the back surface of the housing.

According to one aspect, the rotary compressor further comprises means for providing a substantially fluid-impervious seal between the first end plate 151*a* and the front surface of the housing 111, and between the second end plate 151*b* and the back surface of the housing 112. In one exemplary aspect, at least one slot can be defined in peripheral portions of each of the first and second end plates. A plurality of seals can be provided, each seal being configured for complementary mounting therein one slot of the first and second end plates.

Figure 10:
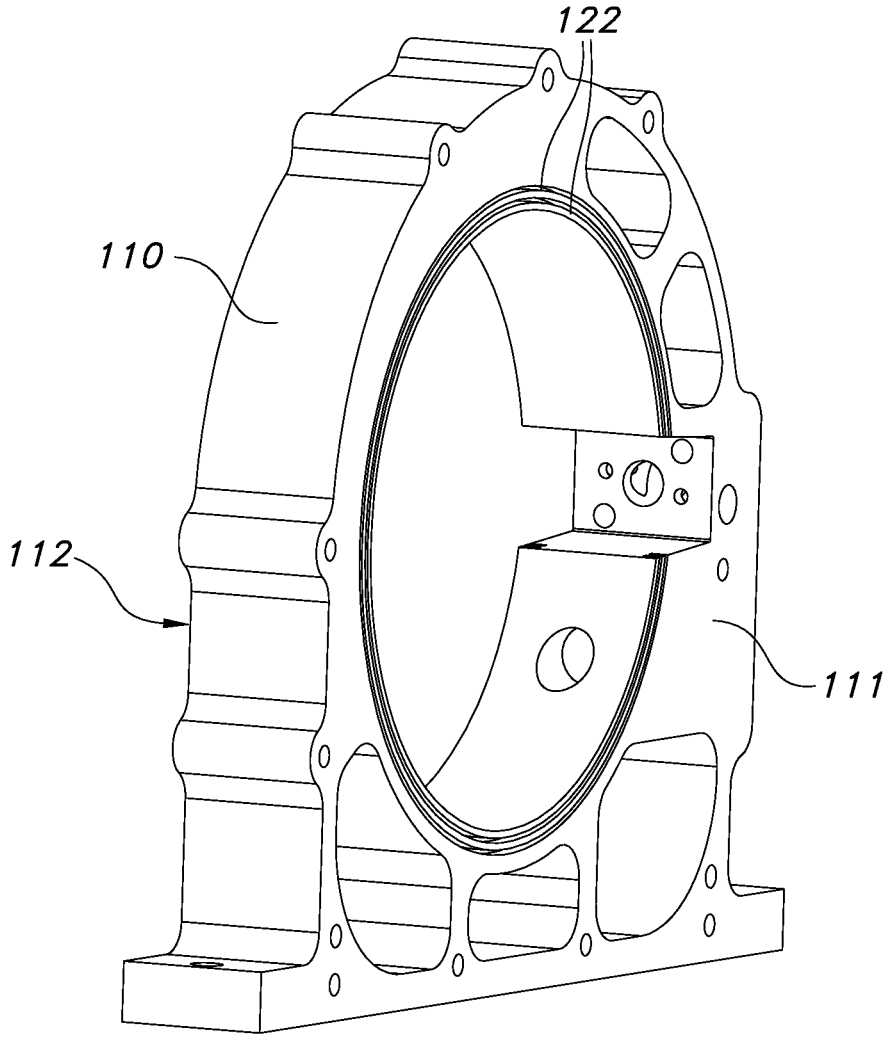
FIG. 10 is a perspective view of one embodiment of a housing of the rotary compressor of FIG. 4A, showing slots formed therein a portion of the housing front surface, which are configured for operative receipt of seals.

Optionally, at least one slot 122 can be defined in each of the front surface 111 and back surface 112 of the housing, the at least one slot substantially surrounding the interior cavity of the housing. At least one seal can be provided, each seal being configured for complementary mounting therein one slot of the housing. For example, as shown in FIG. 10, one or more slots 122 (such as, but not limited to, two slots as shown in FIG. 10) can be formed in each of the front and back surfaces of the housing and can be substantially concentric with the internal cavity of the housing. One or more seals 123 can be provided and configured for complementary mounting therein one slot of the housing, such as shown in FIG. 5. Thus, for example, if two slots are formed on each of the front and back surfaces of the housing, four seals can be provided, each configured for complementary mounting therein a respective slot of the housing.

In yet another aspect, a first end plate of the pair of end plates can be mounted to the front surface of the housing, and a second end plate of the plurality of end plates can be mounted to the back surface of the housing. The rotary compressor can further comprise means for providing a substantially fluid-impervious seal between the first end plate and a first side surface of the rotor, and between the second end plate and a second side surface of the rotor. In one aspect, at least one slot is defined in peripheral portions of each of the respective first and second side surfaces of the rotor. At least one seal can be provided, each seal being configured for complementary mounting therein one slot of the rotor.

Figure 12:
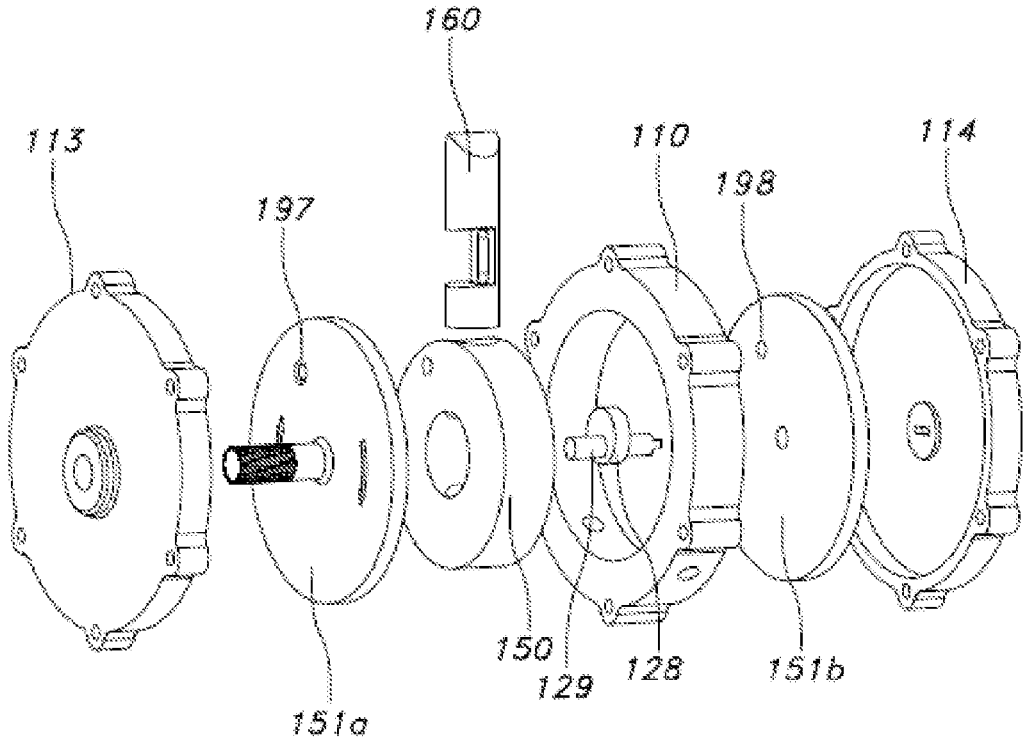
FIG. 12 is a schematic exploded perspective view of one embodiment of the rotary compressor, showing, from left to right, a housing front cover, a first end plate, a rotor, a gate, a housing, an eccentric cam mounted thereto an eccentric shaft, a second end plate and a housing back cover.

The rotary compressor, in one aspect, comprises a cam 128, such as shown in FIGS. 5 and 12. The cam can be positioned therein the internal cavity of the housing about a cam axis, and can be configured to selectively engage select portions of the gate to effect the axial movement of the gate about and between the first position, in which the distal end of the gate is positioned at a first distance from the peripheral surface of the rotor, and the second position, in which the distal end of the gate is positioned at a second distance from the peripheral surface of the rotor. The rotor can also be configured to act on the select portions of the gate to effect the constrained axial movement of the gate relative to the peripheral surface of the rotor. The cam 128, in one aspect, can be positioned along a shaft. For example, the cam can be positioned at a position between a proximal end and a distal end of the eccentric shaft 129, such as shown in FIGS. 5 and 12.

Figure 13:
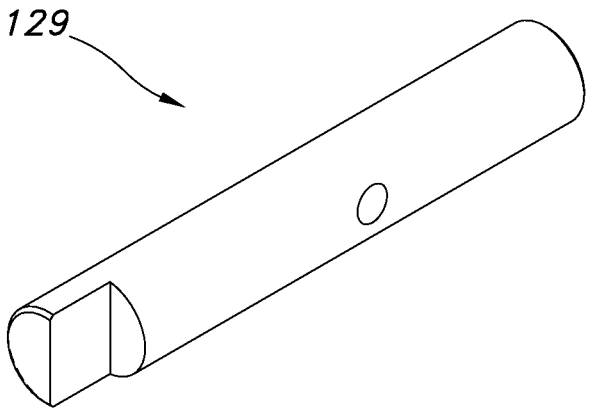
FIG. 13 is a perspective view of one embodiment of an eccentric shaft.

An exemplary eccentric shaft 129 is illustrated in FIG. 13. The eccentric shaft, in one aspect, can be substantially cylindrical and has a proximal end and an opposed distal end. In one aspect, a portion of the eccentric shaft proximate the distal end can be removed such that the cross section of the distal end is non-circular. For example, and without limitation, the cross-sectional shape of the distal end can be semi-circular, partially circular (i.e., a portion can be removed along a chord of the circle other than the diameter), or other geometric shape. Optionally, the eccentric shaft can have a non-circular cross section along a portion or substantially all of its length. According to various aspects, the eccentric shaft can be fixed with respect to the housing front and back covers 113, 114, such as described above, or using alternative attachment or integration (i.e. made as a part of the housing end plate, etc.) methods such as are known to those skilled in the art.

Figure 14:
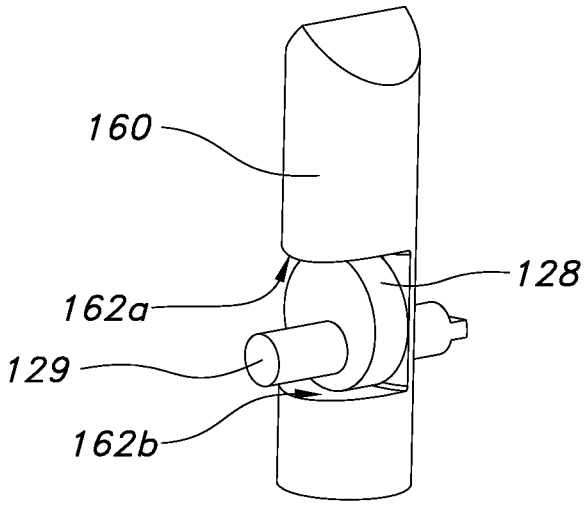
FIG. 14 is a schematic perspective view of a portion of a gate mounted for rotation relative to an eccentric cam that is mounted thereto an eccentric shaft, showing portion(s) of the eccentric cam in selective contact with portions of respective upper and lower eccentric plates of the gate.

An exemplary cam 128, such as shown in FIG. 14 can be substantially cylindrical and can have a predetermined width. In one aspect, the cam can have a bore defined therein that is sized and shaped to receive the eccentric shaft. According to various aspects, the center of the bore can be offset from the center of the cam (i.e., such that the bore is not concentric with the cam). In a further aspect, the cam can be positioned at a position between the proximal and distal ends of the eccentric shaft (such as shown in FIGS. 5 and 14). According to one aspect, it is contemplated that the cam can be fixed from rotation with respect to the housing 110 through a chosen attachment method without the use of an eccentric shaft. In yet another embodiment, the cam can comprise a bearing such that the frictional forces between the cam and the gate can be reduced, such as through the use of a bushing, roller bearing, needle bearing, or similar low-friction device known to those skilled in the art. In further aspects, it is contemplated that the cam can be rotated at a constant or varying speed relative to the rotor's movement to affect the desired positioning of the gate as it rotates about the rotor axis of rotation. The cam rotation can be effected through means known to those skilled in the art, such as belts, gears, chain drives, linkages, and other similar means.

Figure 15A:
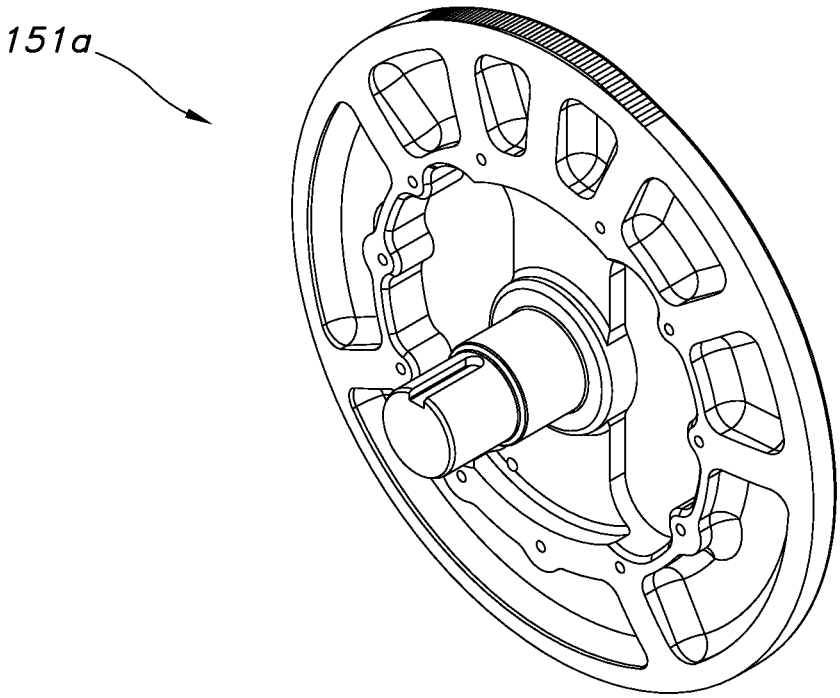
FIG. 15A is a perspective view of a first end plate.

As described above, the rotary compressor in various aspects comprises a pair of end plates 151*a*, 151*b* that can be mounted to and rotate therewith the respective first and second side surfaces of the rotor. As shown in FIGS. 15A and 15C, a first end plate 151*a* can comprise a substantially circular plate-like structure with a shaft-like or male protrusion extending outwardly therefrom. In one exemplary aspect, the protrusion can be substantially cylindrical and can extend outwardly therefrom the first end plate substantially normal or perpendicular with respect to a plane of the first end plate. In a further aspect, the protrusion and the first end plate can be substantially concentric (i.e., a longitudinal axis of the protrusion passes substantially through the geometric center of the first end plate). According to another aspect, the protrusion can be fixedly attached to the first end plate. In a further aspect, the protrusion can have a conventional keyed portion for non-slip transmission of torque. In various exemplary aspects, and not meant to be limiting, the keyed portion can be a splined shaft, a pinned shaft, or the like.

In a further aspect, the protrusion of the first end plate can have a blind bore that extends a predetermined depth from an inner surface of the first end plate into the protrusion, such as shown in the cross-sectional view of FIG. 15C. In this aspect, the bore can be configured to receive the proximal end of the eccentric shaft. The proximal end of the eccentric shaft can be inserted through a rotor front bearing 152 and inserted into the bore defined in the protrusion of the first end plate to allow the rotor to rotate about the eccentric shaft while the eccentric shaft remains fixed or stationary.

In one aspect, the eccentric shaft can be supported by a nested anti-friction bearing positioned therein the bore of the protrusion; the bearing can be constructed of known bearing elements, such as but not limited to, bushings, roller bearings, journal bearing, taper roller bearings, or the like. In some aspects, the nested bearing can be a taper roller bearing, and adjustment means can be provided within the distal end portion of the eccentric shaft to allow for some axial movement of the eccentric shaft and rotor to accommodate for wear or assembly tolerances, such that the rotor can be aligned properly with respect to the housing. In other aspects, thrust bearings can be provided to achieve the desired alignment for the rotational elements.

Similarly, it is contemplated that the second end plate 151*b* can define a bore that extends therethrough the second end plate, which can be configured for receiving a distal end of the eccentric shaft. As described with respect to the rotor front bearing, the distal portion of the eccentric shaft can be inserted therethrough a rotor back bearing 153 and then inserted through the bore in the second end plate to allow the rotor to rotate relative to and about the eccentric shaft.

Figure 15B:
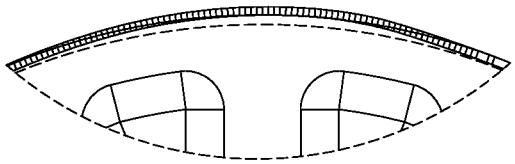
FIG. 15B is a partial elevational view of a portion of the edge of the first end plate of FIG. 15A, showing a raised portion of the edge or profile of the first end plate, which is configured to operatively engage a portion of the TDC assembly.
Figure 15C:
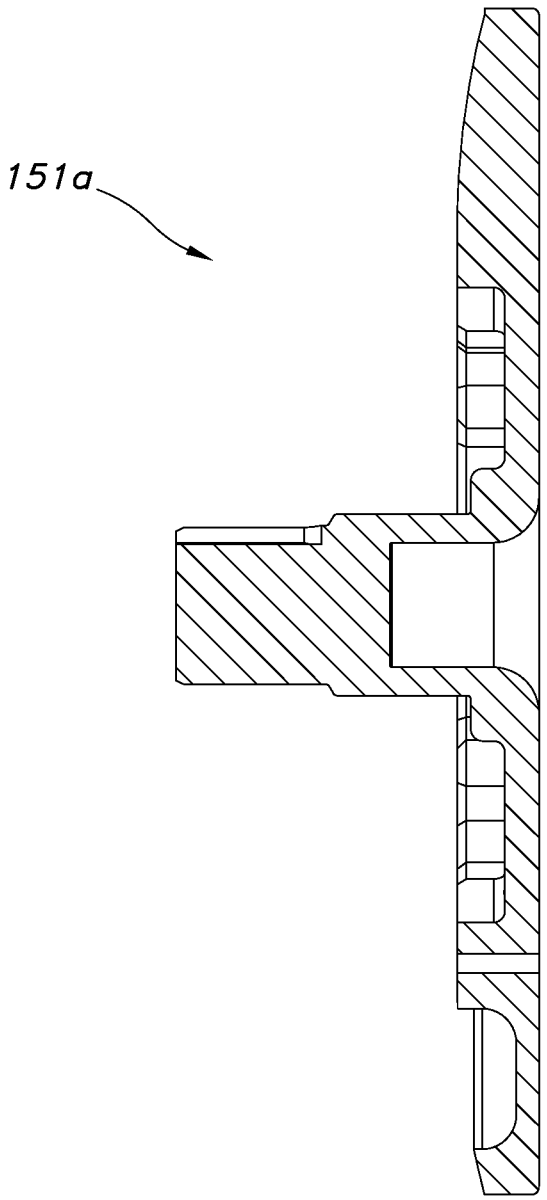
FIG. 15C is a cross-sectional view of the first end plate of FIG. 15A.

In one aspect, the first end plate, second end plate, or both the first and second end plates can have a slight protrusion along a portion of its circumference that provides a cam-like profile (shown, for example, in FIG. 15B). As will be described further below, the cam-like profile of the first and/or second end plate can interact with a cross bar of a TDC assembly to articulate a seal element of the TDC assembly.

Figure 16A:
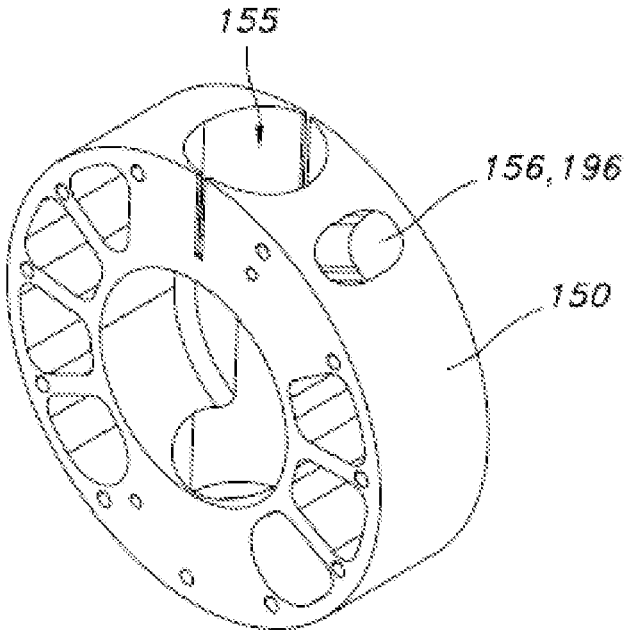
FIG. 16A is a perspective view of one embodiment of a rotor, showing a bore that is configured for operative receipt of at least a portion of a gate.

According to various aspects, the rotor 150 defines a bore 155 configured for slidable receipt of the gate, such as shown in FIG. 16A. The rotor, in one aspect, defines a centrally positioned chamber configured for rotative receipt of the cam, such as shown in FIG. 16A. The bore 155, in one aspect, has a bore axis that bisects a center of the chamber. The bore can be a blind bore (i.e., it does not extend fully through the rotor), as shown in the cross-sectional view of FIG. 16B.

In a further aspect, the gate can be generally cylindrical and the bore of the rotor can be complementarily cylindrical in shape to receive the gate. Optionally, the gate can have a non-cylindrical shape and the bore of the rotor can be complementarily shaped to receive the gate. A gate 160, such as exemplarily shown in FIGS. 17-19, can define a hollow 161 having at least one bearing surface that is configured for selective contact with portions of the cam 128. The at least one bearing surface, in one aspect, comprises a pair of opposed bearing surfaces 162*a*, 162*b*. According to a particular aspect, as describe above, the bore axis can bisect a center of the chamber of the rotor. In this aspect, the pair of opposed bearing surfaces of the gate can be positioned substantially transverse to the bore axis when the gate is slidably received by the bore. In a further aspect, the pair of opposed bearing surfaces are spaced from each other along a longitudinal axis of the gate and are positioned opposite each other about the cam axis. At least a portion of at least one of the bearing surfaces can be curved.

Figure 17:
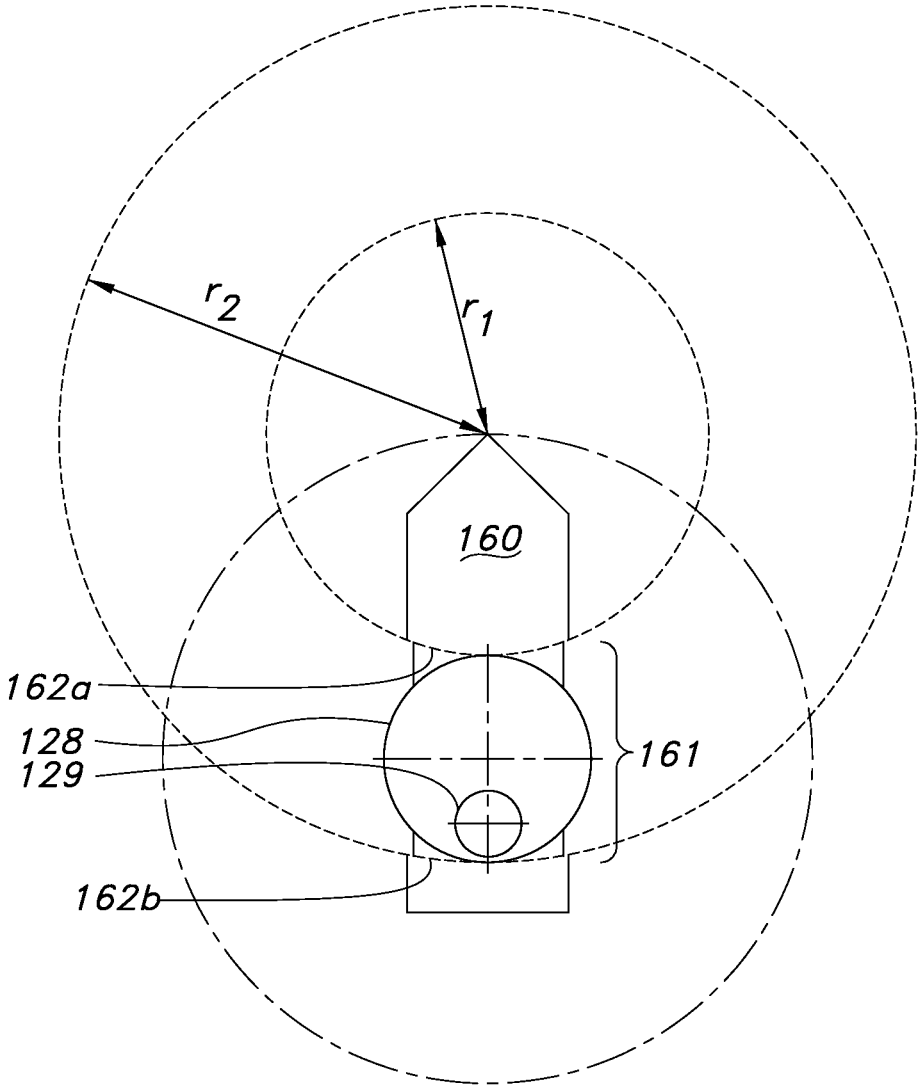
FIG. 17 is a schematic illustration of one embodiment of the respective geometries of a gate upper eccentric plate and gate lower eccentric plate of a gate of a rotary compressor.
Figure 18A:
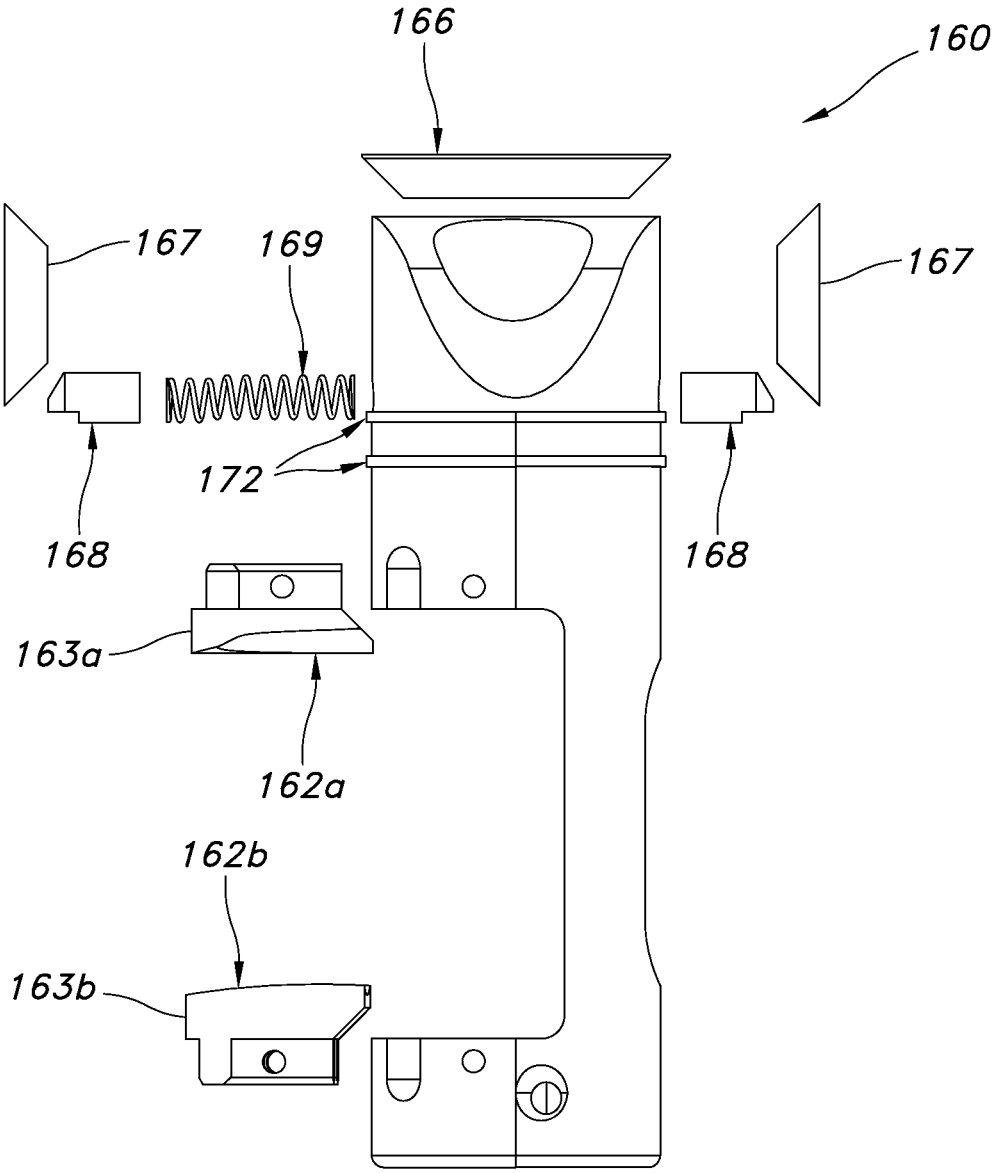
FIG. 18A is a side elevational exploded view of one embodiment of the gate assembly of the rotary compressor, showing, a gate, a gate upper eccentric plate, a gate lower eccentric plate, at least one gate compression or piston seal, a pair of gate side seals, a gate apex seal, a pair of gate seal actuators, and a gate actuator spring.

In one aspect, the gate can comprise an upper eccentric plate 163*a* and a lower eccentric plate 163*b*, such as shown in FIG. 18A. In one aspect, the upper and lower eccentric plates 163*a*, 163*b* can define the pair of opposed bearing surfaces 162*a*, 162*b*, respectively. Optionally, the gate can be machined such that the pair of opposed bearing surfaces are integrally formed with the gate. In either aspect, each bearing surface of the pair of bearing surfaces can be at least partially curved. The upper bearing surface 162*a* can have a first radius of curvature (r1) (shown in FIG. 17, for example). The lower bearing surface 162*b* can have a second radius of curvature (r2). In one aspect, the first radius of curvature (r1) and second radius of curvature (r2) can be selected such that the circles scribed by the first and second radii of curvature are substantially concentric, such as shown in FIG. 17. In a further aspect, the center of these scribed circles can be defined by an apex of the gate. In other aspects, the lower and upper eccentric plates (or the machined portions of the gates that are in contact with the cam) can have flat profiles rather than curved or partially curved surfaces. As can be appreciated, the gate (and/or the upper and lower eccentric plates) can be surface treated or plated in areas that are in mechanical contact with the cam or the bore of the rotor to provide sufficient longevity of the components during operation of the rotary compressor.

In one aspect, the rotary compressor comprises means for minimizing distortion and deflection of the gate at high fluid pressures. In one aspect, at least a portion of the bore of the rotor can have a cylindrical cross-sectional shape and at least portions of the gate can have a cylindrical cross-sectional shape that is complementary to the bore of the rotor. In this aspect, the cylindrical shape of portions of the gate can provide improved resistance to gate distortion and deflection at high fluid pressures and high rotational speeds due to a superior moment of inertia.

In a further aspect, the gate can have additional support for proper alignment during its axial movement via an internal guide pin affixed to the rotor and extending along the axis of the gate bore provided within the rotor. In this aspect, the guide pin can be received within a bore provided within the gate itself running along its longitudinal axis. In this way, the side forces pressing upon the gate can be carried by both the gate bore within the rotor and by the guide pin residing within the bore. Optionally, there can be bearing elements provided within the gate's internal bore upon which the guide pin can ride to reduce frictional loads.

Figure 19:
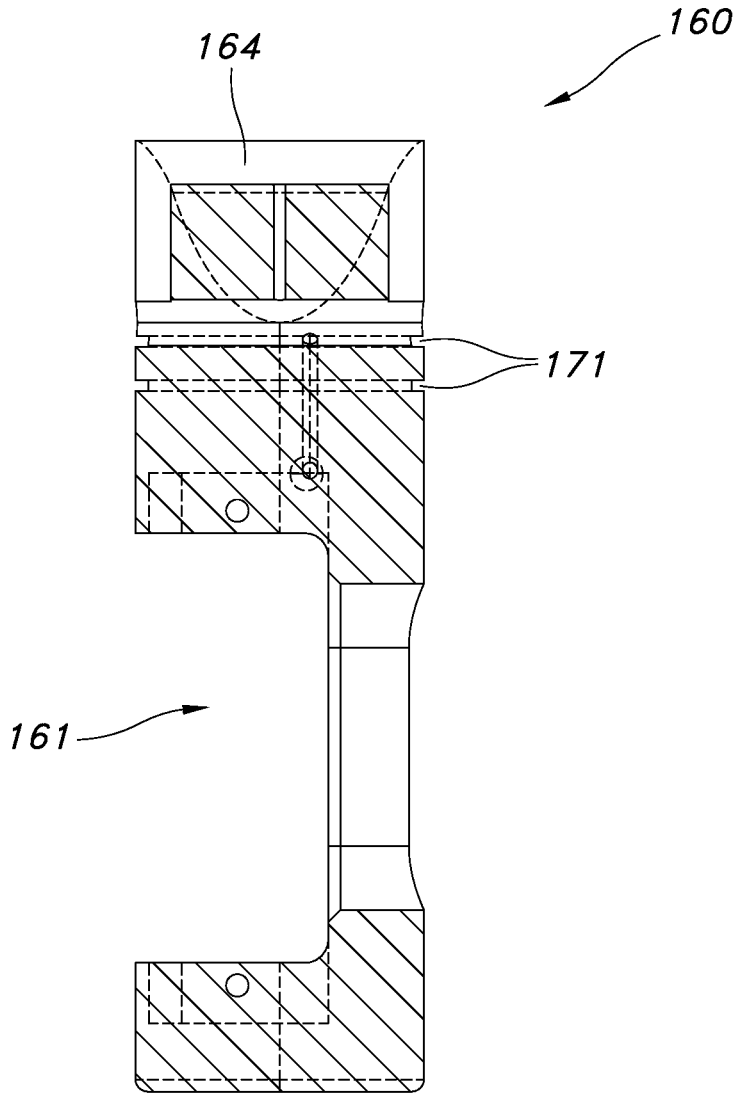
FIG. 19 is a cross-sectional view of the gate of FIG. 18A.

In yet another aspect, the rotary compressor comprises at least one sealing element mounted thereon exterior portions of the portions of the gate having the cylindrical cross-sectional shape. For example, as illustrated in FIG. 19, one or more grooves 171 can be formed proximate the distal end of the gate. Optionally, the one or more grooves can be formed proximate the proximal end of the gate, or both proximate the distal and proximal ends of the gate. One or more gate sealing elements 172 can be provided, each configured to be received by a respective groove, such as shown in FIG. 18A. The gate sealing element(s) can provide a seal between the gate and the bore of the rotor, as is generally known in conventional piston and cylinder sealing technology. Thus, the gate sealing elements can act to seal the gate against the bore as the gate is axially moved between the first and second positions. It is also contemplated that, in various aspects in which at least portions of the gate have a non-cylindrical cross sectional shape, appropriate gate sealing elements can be provided at chosen locations along the gate's perimeter to achieve the desired level of sealing.

As described above, in one aspect, the gate is slidably mounted therewith the rotor and is movable axially about and between the first position, in which the distal end of the gate is positioned at a first distance from the peripheral surface of the rotor, and the second position, in which the distal end of the gate is positioned at a second distance from the peripheral surface of the rotor. In one aspect, the first distance is greater than the second distance. The second distance can be proximal to the peripheral surface of the rotor, in one aspect. In yet another aspect, in the second position, the distal end of the gate can be at or below the peripheral surface of the rotor.

The distal end of the gate can be constrained to be spaced proximate from the inner wall surface of the housing as the rotor rotates about the rotor axis of rotation. In one aspect, the distal end of the gate can be constrained to be proximate from the inner wall surface of the housing in a constrained range of between about 0.0001 inches to about 0.2000 inches. Optionally, the distal end of the gate can be constrained to be spaced proximate from the inner wall surface of the housing in a constrained range of between about 0.0003 inches to about 0.1500 inches. In yet another aspect, the distal end of the gate can be constrained to be spaced proximate from the inner wall surface of the housing in a constrained range of between about 0.0005 inches to about 0.1000 inches.

According to various aspects, the distal end of the gate defines a slot. The rotary compressor can further comprise a seal assembly comprising at least one planar member movable therein the slot of the gate, and a bias element configured to selectively act on the at least one planar member to maintain the outer edge of the at least one planar member in sliding contact with the inner wall surface of the housing as the rotor rotates. In one aspect, the mass of the at least one planar member is less than about 50 percent of the mass of the gate. In another aspect, the mass of the at least one planar member is less than about 10 percent of the mass of the gate. Optionally, the mass of the at least one planar member can be less than about 2 percent of the mass of the gate. According to yet another aspect, the mass of the at least one planar member can be between about 1 to about 60 percent of the mass of the gate. It is also contemplated that, optionally, the biasing force for the at least one planar member can be provided at least in part by the pressurized gases of the compression chamber through the provision of passageways fluidically connecting the compression chamber to the underside of the sealing element.

In one aspect, the distal end of the gate can be generally tapered, such as shown in FIG. 17. The tapered end portion can be shaped such that two opposing sides of the distal end are tapered inwardly and come together substantially at an apex. In a further aspect, the two sides connecting the opposing tapered sides of the distal end are substantially parallel to and continuous with the cylindrical portions of the gate. In one aspect, the tapered end portion is configured to help create a larger area onto which the expanding pressure is acting as the gate retracts thereinto the rotor. In conventional hydraulic vane motors, for example, as the vane retracts the exposed area is reduced, which reduces the effectiveness of the expander.

The noted configuration of the tapered end portion of the gate reduces the gradient for total volume reduction as the rotor spins, that is, as the gate retracts downwardly into the bore of the rotor, it is adding a small amount of incremental volume for each degree of rotor rotation, which reduces the rate at which the total volume decreases. Thus, the exemplified configuration moves some of the volume down into the bore as the crescent shape closes up. Because the "bore volume" increases slower than the reduction in the crescent volume, the result is a net compression event.

It is contemplated that alternative shapes for the distal end portion of the gate can be used. In various aspects, different geometric shapes can be used on one or both sides of the tapered end portion of the gate to optimize either a compression or an expansion operation. For example, in one aspect, if the end portion of the gate does not have a taper on the compression side, an increase in the compression ratio would result. Alternatively, by providing a steep taper (i.e., a larger height to width ratio of the tapered portion of the distal end portion of the gate) on the suction side, the volume ingested for each "stroke" is increased. If the present device is used as an expander, it is contemplated that the tapered end portion of the gate can be configured to create the highest resultant moment reaction for a given portion of the rotation, such as, for example and not meant to be limiting, creating a substantially "constant volume expansion" stroke by varying the geometry of the gate's profile on its distal end.

The exemplary tapered end portion of the gate, as described above, can provide a retracting 'pocket' in the gate on which the pressure can act or through which the suction volume can be increased. The tapered configuration allows some volume to grow in the compression chamber as the rotary compressor moves toward the final clearance volume. The particular shape of the tapered end portion provides a means for tuning the compression dynamics rather than just rely on the gate/housing geometry alone.

According to various aspects, at least one slot is defined by the distal end of the gate. In one aspect, the slot 164 defined by the distal end of the gate is a three-sided slot, such as shown in FIG. 19. A first, or apex-side, of the slot is formed along the apex of the tapered end portion. The latter two opposing side edges of the three-sided slot extend downwardly away from the apex along the sides of the gate that are substantially parallel to and continuous with the cylindrical portions of the gate (such as shown in FIG. 19). In one aspect, the three-sided slot is positioned in a common plane in the tapered end portion of the gate. In a further aspect, the distal end portion of the gate can further comprise a bore that is defined in and extends through the tapered end portion substantially parallel to the apex slot. In this aspect, the defined bore can be formed at the distal (non-apex) ends of the latter two side edges of the slot.

The slot 164, in one aspect, can be configured to complementarily and operatively receive an apex seal 166 and a pair of side seals 167, such as shown in FIG. 18A. It is contemplated that, according to various aspects, the apex seal and side seals can be formed as a unitary seal for the distal end portion of the gate. For example, a unitary seal can comprise an elastic, biasable, or other material positioned therein the slot 164 and configured to seal the apex and sides of the distal end portion of the gate against the inner wall surface of the housing and the first and second end plates, respectively.

Figure 18B:
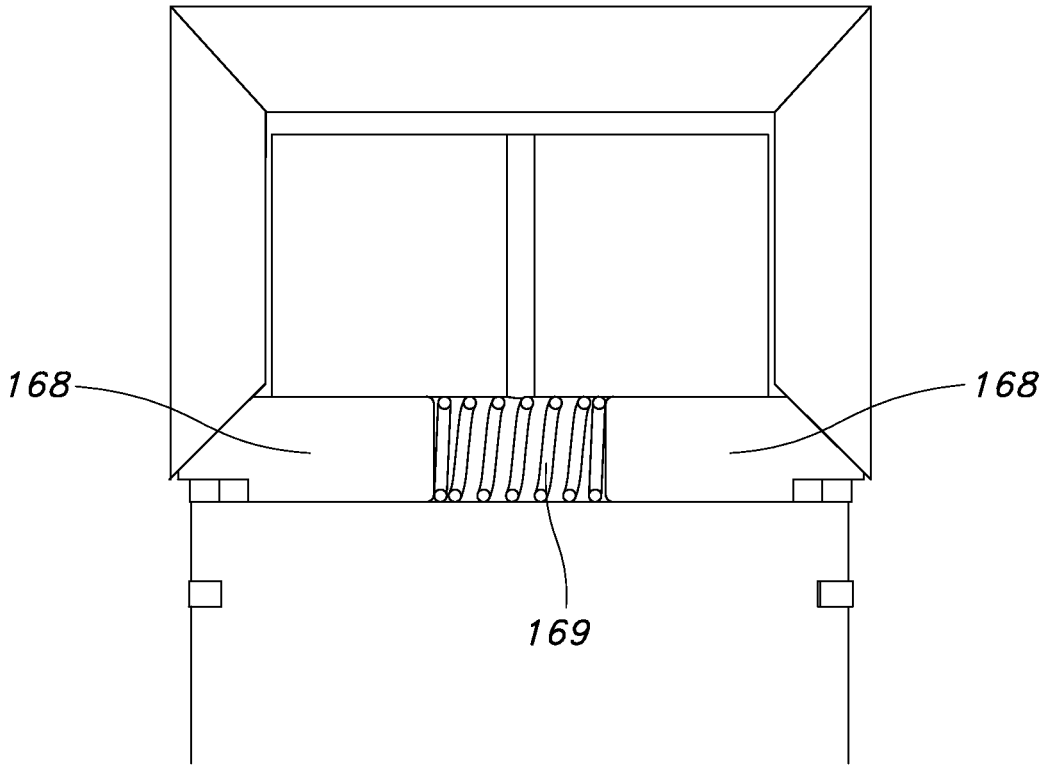
FIG. 18B is a schematic cross-sectional view of a distal portion of the gate, showing the gate actuator spring mounted therebetween the pair of gate seal actuators.
Figure 20:
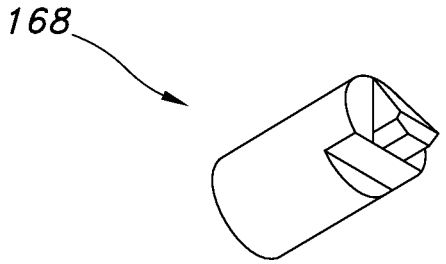
FIG. 20 is a perspective view of a gate seal actuator.

A pair of gate seal actuators 168 (illustrated in FIGS. 18A and 20) and a gate actuator spring 169 can be provided and operatively positioned therein the bore of the distal end portion of the gate, such as shown in FIG. 18B. As shown in FIGS. 18A and 18B, the gate actuator spring 169 can be placed into the bore and a respective one of the gate seal actuators 168 can be placed in the bore on either side of the gate actuator spring. The side seals 167 can be placed in the two side edges of the slot, and the apex seal 166 can be placed in the apex-side of the slot.

In one exemplary aspect, each of the side and apex seals is generally trapezoidal in shape. Due to the general geometry of the gate seal actuators, the side seals, and the apex seal, sealing of the gate against portions of the housing and/or the rotor can be effectuated. The gate actuator spring acts on the gate seal actuators, which can slide longitudinally within the bore in directional parallel to the longitudinal axis of the gate actuator spring. The gate seal actuators, in turn, act against the side seals 167, which in turn act against the apex seal 166. The angled-end geometries of the seals allow for applied forces from the spring to press the side seals outward against their respective mating surfaces (in one aspect, against the inner surfaces of the pair of end plates) while also translating this force up to the apex seal, thereby forcing it against the inner wall surface of the housing. Thus, the lateral force of the spring is transferred to the side seals, creating a seal between the gate and the first and second end plates. Due to the angled interface between the side seals and the apex seal, the lateral force of the spring is translated through the side seal as a lateral and upward force, pressing the apex seal against the inner wall surface of the housing. Optionally, the compression fluid within the compression chamber can be directed through passageways provided in the seals themselves or within the gate such that the pressurized fluid acts upon the underside of chosen seals to provide all or part of the biasing force necessary for fluidic sealing of given chambers.

According to yet another aspect, the rotary compressor further comprises a seal element extending outwardly from the inner wall surface of the housing proximate the location of minimal running clearance between the inner wall surface of the housing and the peripheral surface of the rotor. An edge of the seal element can be configured for selective slidable contact with the peripheral surface of the rotor. In a further aspect, the rotary compressor can comprise means for withdrawing the seal element within the housing such that the edge of the seal element is at or below the inner wall surface of the housing when the distal end of the gate passes over the seal element as the rotor rotates.

Figure 21A:
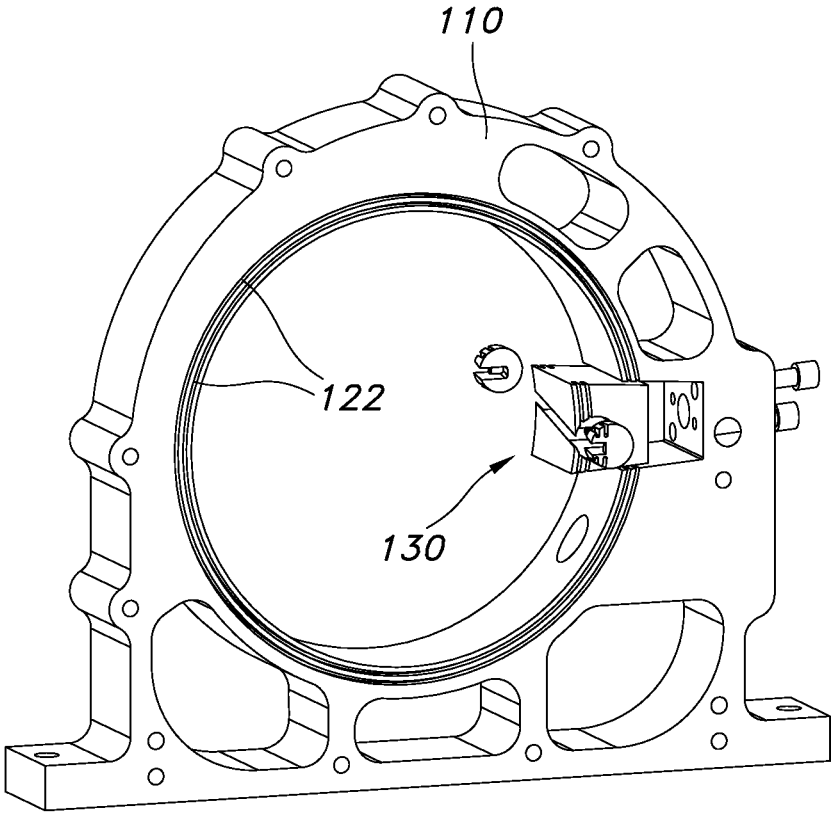
FIG. 21A is a perspective view of a housing of the rotary compressor, showing a TDC assembly partially mounted therein the housing.
Figure 22A:
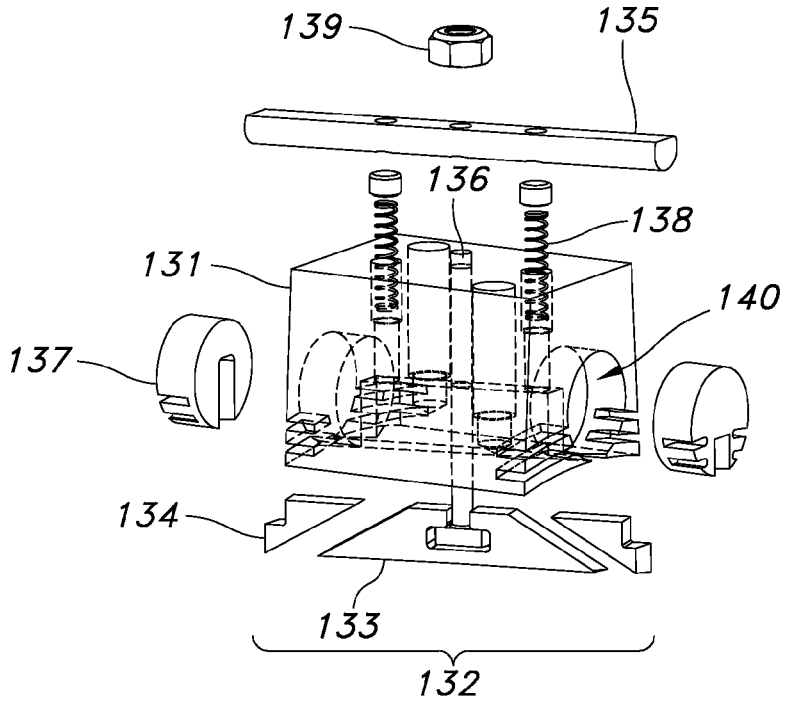
FIG. 22A is a perspective, partially transparent exploded view of one embodiment of a TDC assembly.
Figure 22B:
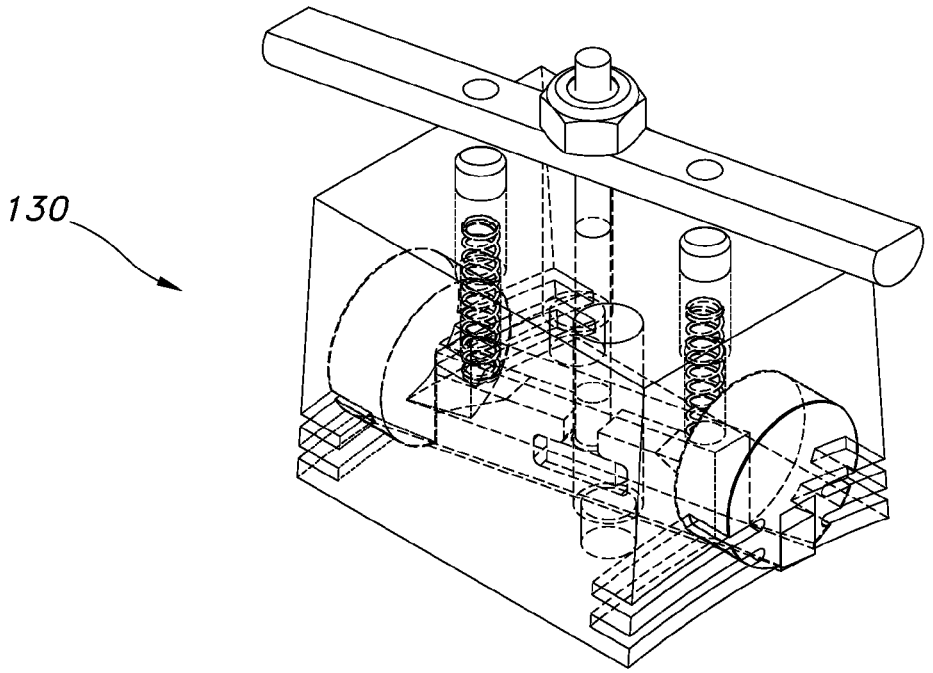
FIG. 22B is a perspective, partially transparent view of the TDC assembly of FIG. 22A.

In one aspect, at least one top dead center (TDC) assembly is provided and comprises the seal element. The TDC assembly 130 can be inserted therein and forms a portion of the housing 110, such as shown in FIG. 21A. Optionally, the components of the TDC assembly as described below can be formed integrally with the housing. Therefore, although described below with respect to a separate TDC assembly, it is contemplated that one or more of the TDC assembly components can be integrally formed with the housing and operate in a similar manner as described below. An exemplary TDC assembly 130, as illustrated in FIGS. 22A and 22B, can comprise a TDC insert 131, a seal element 132 (which, in one aspect, comprises a TDC surface seal 133 and a pair of opposed TDC side seals 134), a TDC cross bar 135, a TDC pull rod 136, TDC button seals 137, and seated spring members 138.

The TDC insert 131 comprises the main body portion of the TDC assembly and has an inner surface that is substantially continuous with the inner wall surface of the housing when the TDC assembly is inserted therein a cut-out of the housing. The inner surface thus has a radius of curvature substantially equal to the radius of curvature of the inner wall surface of the housing. A groove or TDC seal land is defined in a portion of the inner surface and is configured to complementarily receive the seal element, such as the TDC surface seal and the TDC side seals. When the TDC assembly is positioned therein the housing, the groove extends substantially from the front surface of the housing to the back surface of the housing. In a particular aspect, the groove is positioned at an acute angle relative to the front surface of the housing. In a preferred aspect, the groove is positioned at an angle that is not perpendicular to the front surface of the housing, such as illustrated in FIG. 21A. In this aspect, as the gate passes across the TDC seal element, the apex seal of the gate will not be parallel to the TDC seal element, thereby minimizing or preventing snagging of the apex seal and the seal element during operation of the rotary compressor.

In yet another aspect, at least one cavity 140 is defined in the respective front and back surface of the TDC insert 131. In this aspect, each cavity extends partially inwardly into the TDC insert (i.e., blind bores). Each cavity is configured for operative receipt of a TDC button seal 137. Optionally, additional cavities can be defined in the TDC insert, which extend into the TDC insert from the outer surface of the TDC insert. In an exemplary aspect, the cavities can extend from the outer surface of the TDC insert to the TDC seal land. In another aspect, two of the cavities can be configured to operatively receive the seated spring members 138, such as shown in FIGS. 22A and 22B.

Figure 23:
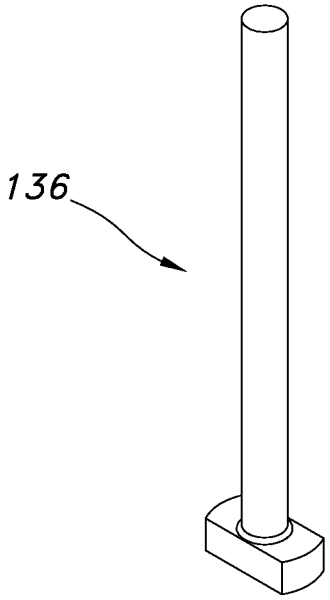
FIG. 23 is a perspective view of a TDC pull rod of the TDC assembly of FIG. 22A.
Figure 24:
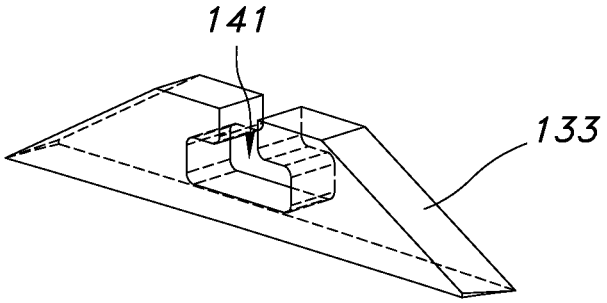
FIG. 24 is a perspective view of a TDC surface seal of the TDC assembly of FIG. 22A.
Figure 25A:
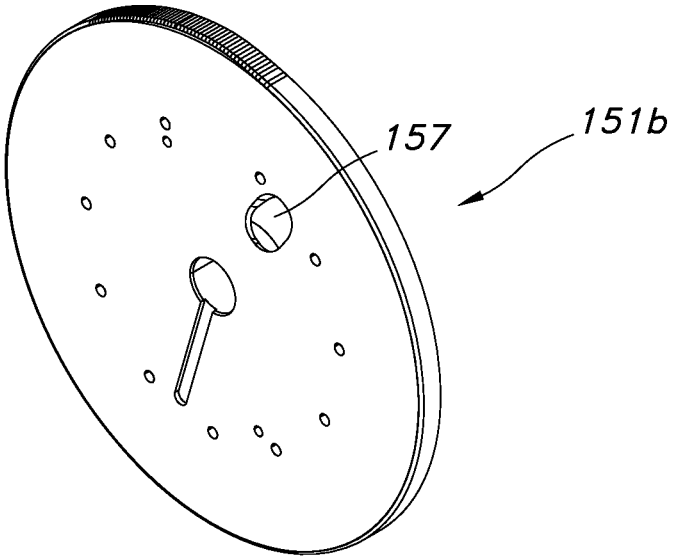
FIG. 25A is a perspective view of the second end plate of the rotary compressor.
Figure 25B:
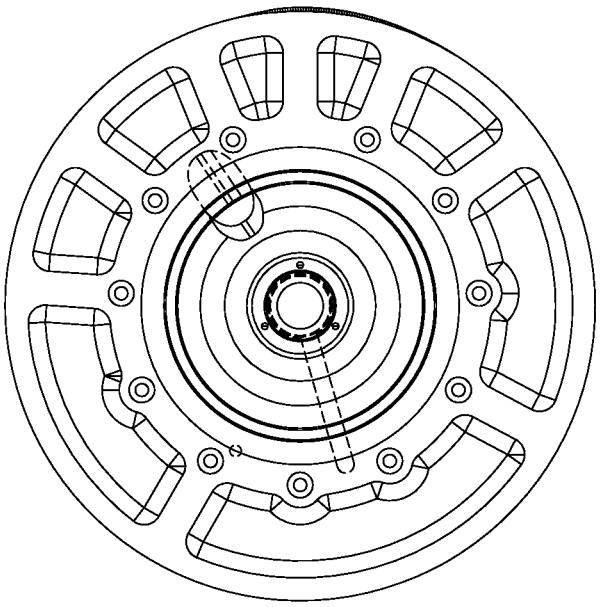
FIG. 25B is a side elevational view of the second end plate of FIG. 25A.

A bore can be defined therein the TDC insert and can be configured to operatively receive the pull rod 136. Optionally, a plurality of bores can be defined therein the TDC insert, each bore configured for receiving a respective pull rod. In one aspect, a distal end of the pull rod, shown for example in FIG. 23, can be inserted into and retained by a notch 141 defined in a portion of the TDC surface seal 133 (such as shown in FIG. 24). The shaft of the pull rod extends through the bore to beyond the outer surface of the TDC insert. The opposing proximal end of the pull rod is configured to pass through a bore defined in a portion of the cross bar 135 (which is positioned substantially perpendicular to the pull rod) and can, for example and without limitation, be held in place with a nut 139. As shown in FIGS. 22A and 22B, the cross bar, in one aspect, has a predetermined length that is greater than the width of the TDC insert (i.e., the distance between the front and back surfaces of the TDC insert, or substantially the distance between the front and back surfaces of the housing).

The cross bar can be operatively engaged by the first and second end plates 151*a*, 151*b* in one aspect, to position the seal element of the TDC assembly such that it is at or below the inner wall surface of the housing when the distal end of the gate passes over the seal element as the rotor rotates. For example, as described above, one or more of the first and second end plates can have a protrusion along their periphery, resulting in a cam-like profile. As the protrusion passes over and contacts one or both ends of the cross bar that extend beyond the front and back surfaces of the housing, the cross bar is moved and thereby draws the seal element to a position at or below the inner wall surface of the housing. It can be appreciated that alternative actuation means can be used to articulate the TDC seal element without departing from the scope of the present disclosure and all such articulating means are contemplated by the present disclosure. It is contemplated that such actuation means can include, but are not limited to, pneumatic, hydraulic (such as using an external fluid, control fluid, and/or the working fluid of the rotary compressor, etc.), electronic, electro-mechanical, or other known means of providing mechanical movement.

Figure 16B:
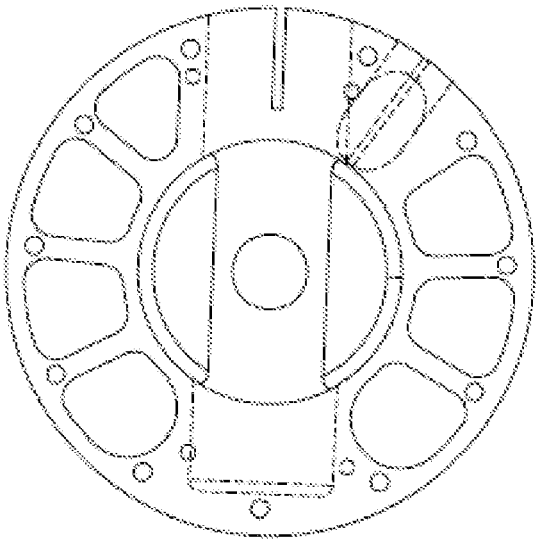
FIG. 16B is a side elevational view of the rotor of FIG. 16A.
Figure 30A:
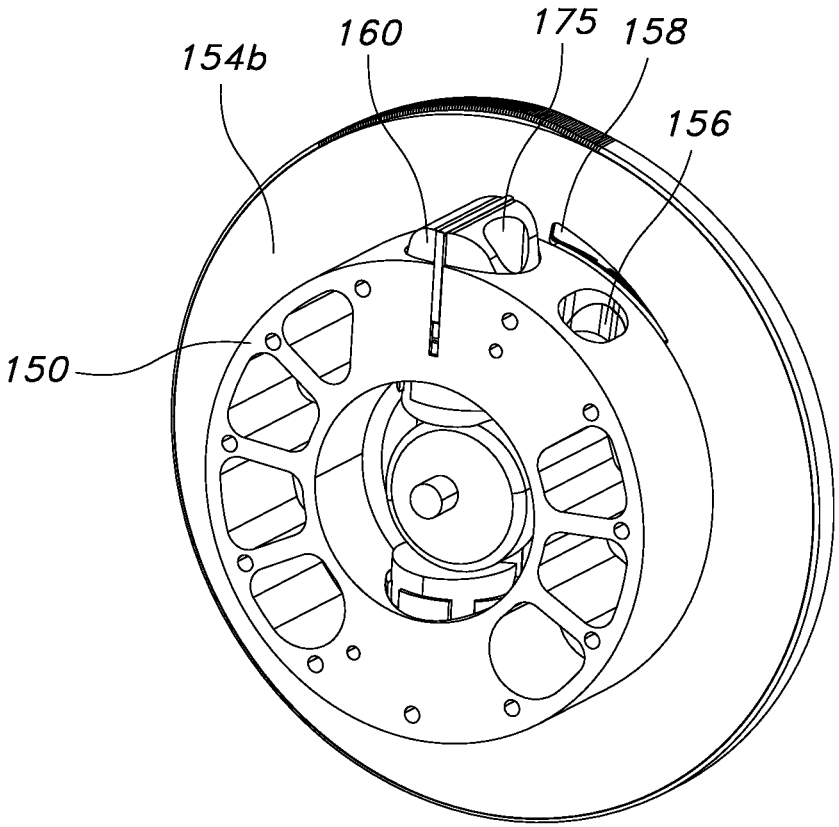
FIG. 30A is a schematic perspective view of one embodiment of a rotor mounted to a second end plate, and showing multiple exemplary inlet ports in respective portions of the rotor, gate and second end plate.
Figure 30B:
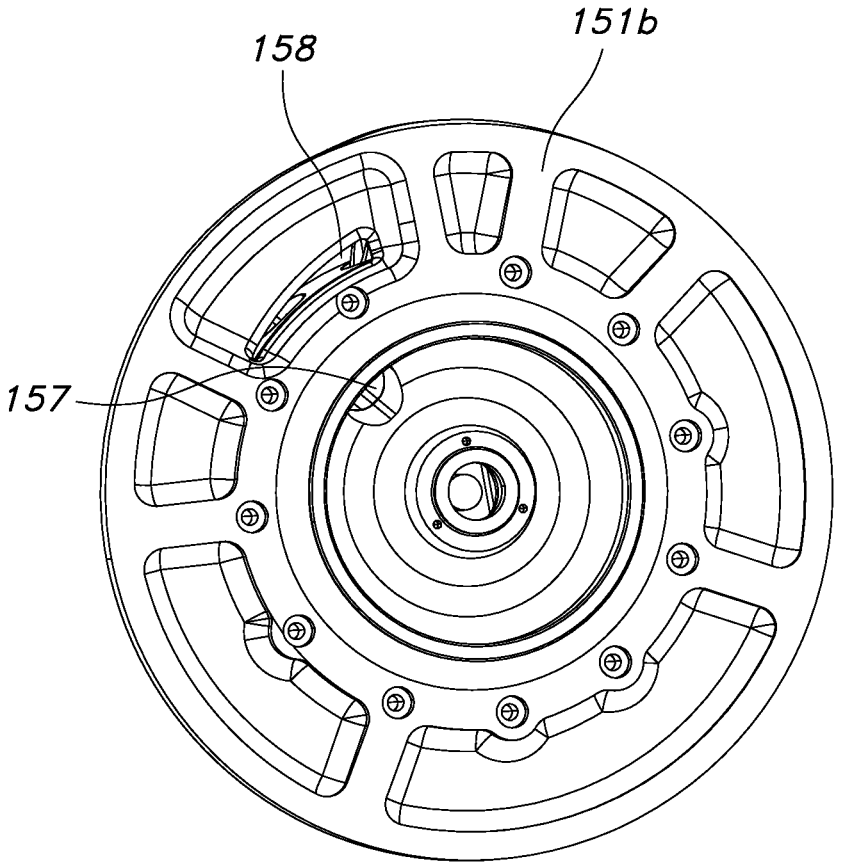
FIG. 30B is a rear elevational view of FIG. 30A.

Referring to FIG. 2, for example, and as described above, in one aspect portions of the peripheral surface of the rotor, portions of the inner wall surface of the housing, and varying portions of the gate proximate the distal end of the gate define a suction chamber 104 and a compression chamber 102, each of varying volume as the rotor rotates about the rotor axis of rotation. According to various aspects, one or more inlet ports in fluid communication with the suction and/or compression chamber can be provided in one or more of the rotor 150, gate 160, housing 110, first end plate 151*a* and/or second end plate 151*b*, or other component(s) of the rotary compressor. Similarly, one or more outlet ports can be provided in one or more of the rotor, gate, housing, first and/or second end plates, or other component(s) of the rotary compressor. For example, in one aspect, such as illustrated in FIGS. 16A, 16B and 30A, the rotor can comprise at least one rotor inlet port 156 in fluid communication with the suction chamber and/or compression chamber. In this aspect, the inlet port can extend from the peripheral surface of the rotor to a side surface of the rotor, such as the second side surface, to form a fluid passageway. According to another aspect, the second end plate 151*b* can comprise at least one inlet port. For example, as shown in FIGS. 25A-25B and 30A-30B, the second end plate can comprise a first inlet port 157 and a second inlet port 158. The first inlet port 157, in one aspect, is in fluid communication with the rotor inlet port 156 to thereby provide a substantially continuous fluid passageway. At least one of the inlet ports formed therein the second end plate can be configured to cooperate with the one or more holes formed therein the housing back cover to provide a substantially continuous fluid intake passageway.

Figure 29:
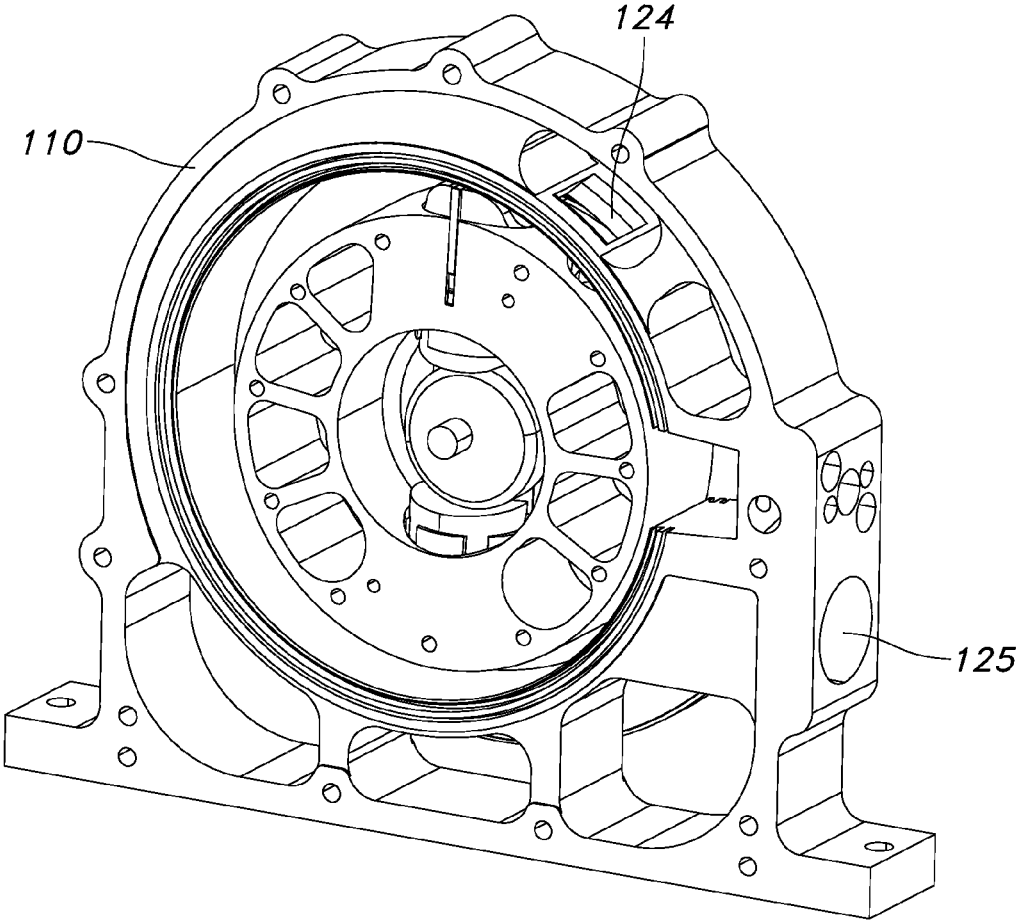
FIG. 29 is a partial schematic perspective view of one embodiment of a rotary compressor.

According to one aspect, the housing can have at least one housing inlet port 124 that is in fluid communication with the suction and/or compression chamber, such as illustrated in FIG. 29. In another aspect, the gate 160 can have at least one gate inlet port 175 in fluid communication with the suction and/or compression chamber. In this aspect, the rotary compressor can comprise means for selectively opening and closing the at least one inlet port therein the gate. It is contemplated that, in one aspect, the rotor of the rotary compressor illustrated in FIG. 29 can be configured to rotate in a counter-clockwise direction as viewed in the figure. In this aspect, and not meant to be limiting. it is contemplated that the one or more inlet ports formed therein the rotor, second end plate, and/or gate can be positioned such that when the rotor begins a rotation (i.e., when the gate apex seal passes the TDC position), the inlet ports are positioned proximate the TDC position and can draw fluid into the suction chamber as the rotor continues its rotation. Similarly, the inlet formed therein the housing can be positioned proximate the TDC position. However, it is contemplated that the positions of the inlet ports can be selected as desired.

Similarly, in one aspect, the rotor, gate, first and/or second end plates, housing, and/or other component(s) of the rotary compressor can have at least one outlet port in fluid communication with the compression chamber. For example, in a particular aspect, the gate can have at least one outlet port 195 in fluid communication with the compression chamber, such as shown in FIG. 11. Exemplary outlet ports 197, 198 in the first and second end plates, respectively, are shown in FIG. 12. An exemplary rotor outlet port 196 is shown in FIG. 16A. The rotary compressor can further comprise means for selectively opening and closing the at least one outlet port therein the gate. In yet another aspect, such as illustrated in FIG. 29, a housing outlet port 125 can be formed therein the housing. The housing outlet port 125, in one aspect, can be positioned proximate the TDC position, such that as the rotor completes a rotation, substantially all of the fluid in the compression chamber exits the compression chamber via the housing outlet port. As described further below, in one aspect, a valve can be mounted therein the housing outlet port to act as a discharge valve for the rotary compressor.

In a further aspect, the axial movement of the gate within the rotor can be used to open ports provided in the gate as they become aligned with ports provided in the rotor. In this aspect, during select periods of rotor movement the outlet port is placed in fluid communication with one or more volumetric chambers to allow fluid flow therebetween. In yet other aspects, outlet ports can be provided in the rotor endplates, which are allowed to be placed in fluid communication with selected volumetric chambers as the rotor endplates moves eccentrically with respect to the housing. In this exemplified aspect, during select periods of rotor movement, the ports allow fluid communication to be established, which allows for the ingestion or discharge of fluid from one or more of the volumetric chambers. Alternatively, it is contemplated that ports can be provided in at least a portion of the housing that are configured to provide the primary inlet or outlet passageways for the working fluid, or the formed housing ports can serve as additional ports to main ports provided in other components as described above.

The rotary compressor can further comprise a discharge valve mounted thereto the housing that serves to prevent back flow of the compressed fluid in the compression chamber. In other aspects, the rotary compressor can comprise an intake valve positioned therein the intake passageway (such as, but not limited to, positioned therein an inlet port of the housing) to reduce or eliminate reversion flow of the intake fluid. According to various aspects, for example and not meant to be limiting, the discharge valve and/or intake valve can comprise a reed valve, a plate valve, a flapper valve, and the like.

Figure 26:
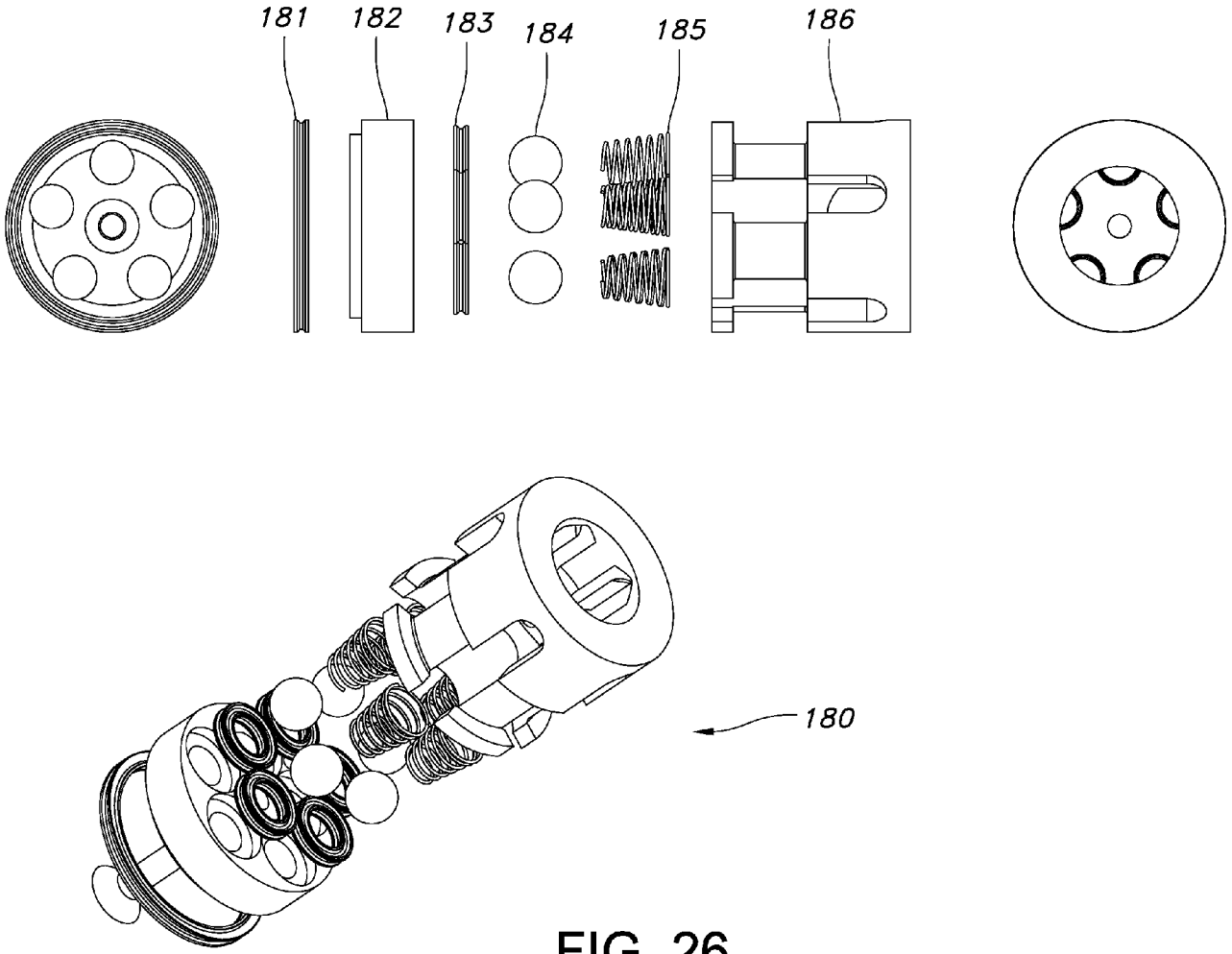
FIG. 26 are a plurality of views of one embodiment of a plate valve assembly, including an exploded perspective view of the plate valve assembly.
Figure 27:
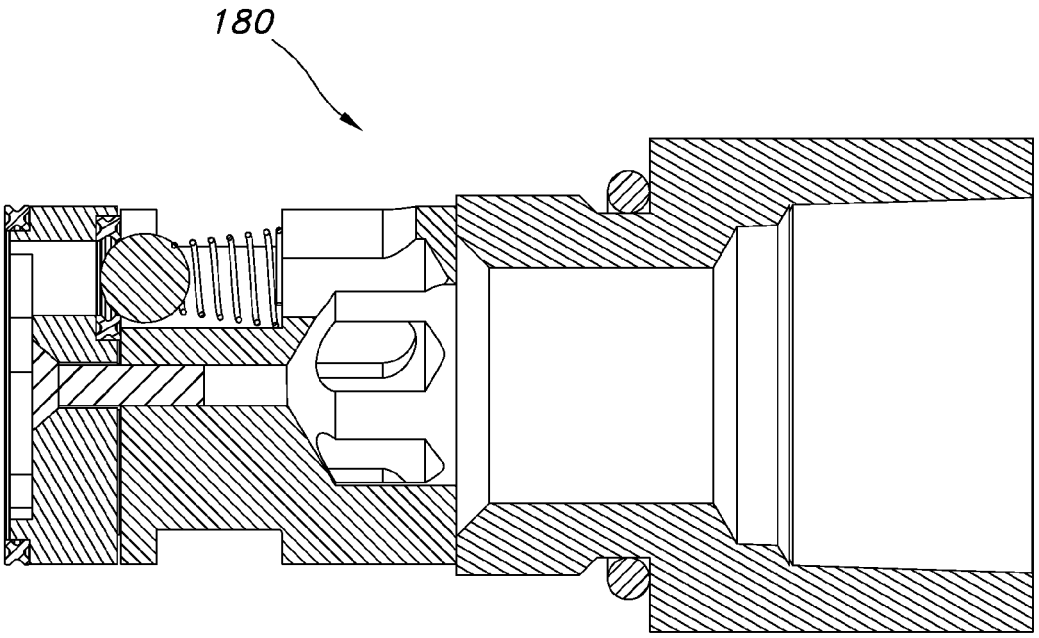
FIG. 27 is a cross-sectional view of the plate valve assembly of FIG. 26.

Referring now to FIGS. 26-27, an exemplary plate valve assembly 180 is illustrated, which can be positioned therein an outlet port of the housing to act as a discharge valve, for example. According to various aspects, a plate valve assembly can comprise a chamber seal 181, a valve plate 182, valve seats 183, sealing elements 184, seal springs 185, and a valve body 186. It is contemplated that, when assembled, the valve plate, valve seats, and valve body define a plurality of channels radially displaced around a common axis. In one aspect, a sealing element 184 and respective seal spring 185 is placed within each of the plurality of channels. In one example, the sealing elements can be substantially spherical. According to one aspect, and not meant to be limiting, five channels are formed in the valve body; thus, five sealing elements are mounted therein the respective formed channels. In one aspect, the valve body is shaped such that the seal springs and sealing elements are retained within the channels when the plate valve assembly is assembled, such as shown in FIG. 27. Optionally, the seal springs can be omitted and the movement and sealing function of the sealing elements can be controlled by fluid flow therethrough the plate valve assembly. In other aspects, the sealing elements can be fitted within their respective channels with close tolerances such that the movement of the sealing elements is substantially restricted, thereby providing a damping mechanism to prevent the sealing elements from unconstrained movement. As can be appreciated, a plate valve assembly, or other like valve, can be provided and can be configured to act as a discharge valve for the rotary compressor.

According to various aspects, the rotary compressor can comprise a rotor having a peripheral surface and a rotor axis, and a housing defining an internal cavity having an inner wall surface, and the housing can be configured to rotate about a housing longitudinal axis eccentric to the rotor axis. The rotor can be positioned within the internal cavity of the housing. A gate, such as described herein, can be slidably mounted therewith the rotor and movable axially about and between a first position, in which the distal end of the gate is positioned at a first distance from the peripheral surface of the rotor, and a second position, in which the distal end of the gate is positioned at a second distance from the peripheral surface of the rotor. In this aspect, first and second end plates can be provided and can be fixedly attached or mounted thereto the rotor. Thus, the rotor and the end plates can be held or maintained in a stationary position as the housing rotates about the housing longitudinally axis. Such a rotary compressor can be used for example, as a compressor, pump, expander, or any combination thereof.

It is contemplated that compound devices can be assembled using two or more rotary compressors as described herein to create high pressure ratios as can be desired. In an exemplary aspect, the first stage rotary compressor can have its outlet port or ports positioned selectively in fluid connection with the inlet of a secondary stage rotary compressor. In various aspects, the secondary stage can be, without limitation, any one of a number of known compressor devices such as a centrifugal compressor, a scroll compressor, a reciprocating compressor, an axial turbine compressor, or the like. Alternatively, it is contemplated that the first stage can be comprised of a known compressor or pump, as exemplarily described above, and subsequent stages can be assembled using a rotary compressor as described according to various aspects herein, or combinations thereof. Such a multi-stage compressor can be used, for example and without limitation, as a compressor, pump, expander, engine, or any combination thereof.

With reference to FIGS. 4A, 4B and 11, a rotary compressor can be assembled to comprise any or all of the components as described above. In one aspect, the gate can be assembled by inserting the seal actuator into the bore of the tapered end portion of the gate. The apex seal and side seals can be inserted into the respective portions of the three-sided slot at the apex of the gate. The one or more gate sealing elements can be positioned within the grooves formed in the portions of the gate having the cylindrical cross-sectional shape. In one aspect, gate lower and upper eccentric plates are provided, which define a pair of opposed bearing surfaces when positioned therein the gate. Thus, in one aspect, the upper eccentric plate and lower eccentric plate can be positioned within the body of the gate. The gate can then be inserted into the bore of the rotor.

According to various aspects, it is contemplated that the seal actuator presses against the gate side seals, pressing the gate side seals against the inner surfaces of the first and second end plates. As described above, due to the construction and geometrical shape of the gate side seals and gate apex seal, the lateral force experienced by the gate side seals is translated to the gate apex seal in a transverse direction, thereby pressing the gate apex seal against the inner wall surface of the housing. These pressing forces can serve to ensure proper sealing during operation of the rotary compressor. In one aspect, the gate side seals experience pressing forces in the range of between about 0.01 pounds and about 15.0 pounds. In a further aspect, the gate side seals experience preferably about 4.0 pounds of force. According to another aspect, the gate apex seal experiences a pressing force in the range of between about 2.0 to about 40.0 pounds. In yet another aspect, the gate apex seal and gate side seals can be constructed with alternative spring elements to cause the forces described herein above.

Figure 21B:
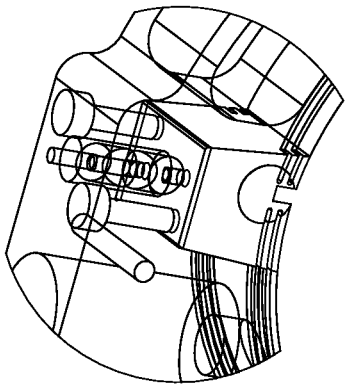
FIG. 21B is partial perspective and partially transparent view of the TDC assembly mounted therein and forming a portion of the housing.

In one aspect, a TDC assembly is provided and can be mounted therein the housing. The TDC insert can be positioned within the housing and the distal end of the TDC pull rod can be inserted into the notch of the TDC surface seal, which can in turn be inserted into the groove or TDC seal land in the TDC insert. The TDC side seals can likewise be inserted into the groove, and the button seals can be inserted into respective bores on the front and back surfaces of the TDC insert. The TDC cross bar can be inserted into a bore (as shown, for example, in FIG. 21, TDC cross-bar relief) that extends from the housing front surface to the housing back surface. The seated spring elements and nut can be inserted from the outer surface of the housing and the nut can be fastened to the distal end of the TDC pull rod. The one or more seals can be positioned within respective slots defined in the front and/or back surfaces of the housing. As can be appreciated, in one aspect, the TDC assembly can be at least partially integral with the housing; thus, in this aspect, the various TDC assembly components can be assembled directly therein the housing.

The rotor (with gate positioned therein) can then be positioned within the internal cavity of the housing. In one aspect, the general rotor position within the housing (i.e., the position of the rotor defined by the position of the rotor axis of rotation relative to the housing longitudinal axis), and relative to the housing, is constant, despite the rotational movement of the rotor within the housing. Thus, there is a point or location at which the peripheral surface of the rotor and the inner wall surface of the housing are closest, such as illustrated in FIG. 3. In a particular aspect, this point can be substantially equal to the top dead center (TDC) position of the rotary compressor. It is contemplated that the TDC seal element, or more specifically the TDC surface seal, acts to maintain a seal between the inner wall surface of the housing and the peripheral surface of the rotor.

The eccentric shaft and cam can be inserted therein the centrally positioned chamber of the rotor and the defined hollow portion of the gate. The cam can be positioned along the eccentric shaft such that it is positioned therein the hollow of the gate, proximate the at least one bearing surface defined by the hollow. In one aspect, the cam can be positioned therebetween the upper and lower eccentric plates of the gate. It is contemplated, according to various aspects, that the shape of the cam can be chosen such that the gate, which is constrained within the rotor by the rotor bore, has its radial position defined by the contact points between the cam and the mating contact points on the at least one bearing surface of the gate hollow, such as the upper and lower eccentric plates. As the rotor rotates about the rotor axis of rotation, the circumferential path of the gate is defined by the center of rotation of the rotor, and the gate's radial distension is fixed by the geometry of the cam. In this way, the distal end of the gate is constrained to be spaced proximate from the inner wall surface of the housing, and is constrained from pressing with excessive or erratic force against the inner wall surface of the housing.

In one aspect, the cam is designed such that the distal end of the gate can be maintained at a spaced distance proximate from the inner wall surface of the housing. In one aspect, the distal end of the gate is constrained to be spaced proximate from the inner wall surface of the housing in a constrained range of between about 0.0001 inches to about 0.2000 inches, in a constrained range of between about 0.0003 inches to about 0.1500 inches, or in a constrained range of between about 0.0005 inches to about 0.1000 inches. In another aspect, the distal end of the gate is constrained to be spaced proximate from the inner wall surface of the housing in a constrained range of between 0.01% and 15.0% of the diameter of the housing inner surface.

In this manner, wear and contact friction between the gate and the inner wall surface of the housing can be minimized or eliminated. As described herein, sealing between the distal end of the gate and the inner wall surface of the housing (and/or the inner surfaces of the first and second end plates) can be accomplished by the spring force of the gate seal actuator acting on the gate side seals and the gate apex seal. In other aspects, sealing between the distal end of the gate and the inner wall surface of the housing (and/or the inner surfaces of the first and second end plates) can be accomplished by close running clearances achieved through exact machining and assembly tolerances, thereby creating a non-contact sealing function and thus reducing friction and wear.

A proximal portion of the eccentric shaft can be inserted through the rotor front bearing into the bore formed in the shaft of the first end plate. Similarly, a distal portion of the eccentric shaft can be inserted through the rotor back bearing, through the second end plate, and inserted into the mating bore in the housing back cover. In one aspect, the housing front spacer is positioned between the housing front cover and the front surface of the housing. As shown in FIG. 8, the housing front spacer can define a void in which the first end plate can rotate freely. Similarly, the housing back spacer can be positioned between the housing back cover and the back surface of the housing, and can define a void in which the second end plate can rotate freely. Optionally, as described above, the housing front and back spacers can be eliminated and the housing front and back covers and/or the housing can be constructed to provide the respective voids when the rotary compressor is assembled.

It is contemplated that the rotary compressor can be joined together or assembled with conventional means, such as, for example and without limitation, mechanical fasteners such as, without limitation, screws, bolts, rivets, clamps, pressed studs with nuts, and the like, or any combination thereof. Complementary fastener holes can be defined, such as illustrated for example in FIGS. 6-8 and 10, with respect to the housing front cover, housing front spacer, housing, housing back spacer, and housing back cover. However, it is also contemplated that any number of the elements of the housing assembly can be formed integrally together into a single machine part or casting.

According to various aspects, the first and second end plates can be fixedly attached to the first and second side surfaces of the rotor, respectively, such that they rotate simultaneously with the rotor. In one aspect, the first and second end plates can be substantially sealed against the front and back surfaces of the housing by at least one seal positioned therein a respective slot defined in the front and/or back surface of the housing. In this aspect, the gate side seals translate axially up and down relative to the inner surfaces of the first and second end plates, rather than sweeping against them if they were fixed relative to the rotation of the rotor. In this manner, sealing performance can be improved and friction can be reduced. As can be appreciated, any number of seals can be used to provide sealing of the gate within the rotor and of the gate against the inner wall surface of the housing, and it is contemplated that various aspects can include more or fewer seals than described herein. It is contemplated that, in some aspects, one or more of the seals can be urged against their mating surfaces through, for example and not meant to be limiting, the use of fluid pressure routed from the compression chamber or elsewhere, or through the use of bias elements, or a combination thereof.

According to other aspects, the first and second end plates can be fixedly attached to the housing. For example, the first end plate can be mounted to the front surface of the housing and the second end plate can be mounted to the back surface of the housing. Means can be provided for providing a substantially fluid-impervious seal between the first end plate and the first side surface of the rotor and between the second end plate and the second side surface of the rotor. In this aspect, it is contemplated that the gate side seals will 'sweep' against the inner surfaces of the first and second end plates, rather than moving axially or laterally against them as described herein in accordance with various other aspects. According to various aspects, it is contemplated that fewer seals (e.g., gate seals, TDC seals, etc.) can be provided and sealing can be effectively achieved through close assembly tolerances at selected interfaces between components of the rotary compressor. Optionally, an oil-less compressor or vacuum pump can be constructed through the elimination of chosen sealing elements such that the desired performance can be achieved through the exact positioning of the gate relative to the housing, i.e., by positioning the gate such that the distal end of the gate remains at a close select tolerance from the housing. This aspect can achieve long service life through the reduction of friction and wear at the typical seal contact points.

In operation, as the rotor rotates within the housing, the gate assembly is axially moved about and between the first and second position, as described above. When the distal end of the gate approaches the point at which the rotor and housing are closest (i.e., at substantially the TDC position), the cam-like profile of the first and second end plates cause the TDC cross bar to move outwardly, away from the inner wall surface of the housing, which causes the pull rod to exert a pulling force on the TDC surface seal. The TDC surface seal is thereby retracted to a position at or below the inner wall surface of the housing.

According to a further aspect, the retraction of the TDC surface seal described above can substantially coincide with the movement of the gate past the TDC position, and allows the gate to pass the TDC position while minimizing or eliminating any contact between the gate apex seal and the TDC surface seal. Thus, the cam-like protrusions in each of the first and second end plates can be located and profiled to provide a predetermined amount of lift to the TDC surface seal to prevent it from being struck or contacted by any portion of the gate as the gate passes the TDC position.

According to various aspects, additional means can be provided to prevent the TDC surface seal from adversely contacting the gate apex seal. For example, the TDC surface seal can be positioned at an angle (described above) with respect to the front and back surfaces of the housing, such that the gate apex seal and the TDC surface seal are not parallel as the gate passes the TDC position (thereby preventing full contact between the two seals). The angled positioning of the TDC surface seal can further prevent the gate apex seal from catching or dropping into the groove or seal land formed in the TDC insert configured for receiving the TDC surface seal. In another aspect, the TDC surface seal retraction can be caused by the gate apex seal through a pushing force provided by the gate apex seal as it travels past and contacts the TDC surface seal, forcing the TDC surface seal to retract into the groove of the TDC insert.

According to yet another aspect, it is contemplated that the TDC surface seal can be a fixed seal (i.e., it would remain stationary and not be retracted into the groove or seal land of the TDC insert). In this aspect, the gate apex seal can be configured with means for translating the gate apex seal inwardly toward the housing longitudinal axis as the gate apex seal passes the "fixed" TDC surface seal. The means for translating can comprise a cam surface on the eccentric cam that is configured to control the position of the gate apex seal relative to the distal end of the gate as the rotor rotates within the housing.

Due to the geometries and relative positioning of the TDC surface seal, side seals, and TDC button seals (such as shown in FIGS. 22A-22B), the retracting movement of the TDC surface seal can cause movement in the other components of the TDC assembly. In one aspect, as the TDC surface seal is retracted by the pulling force of the pull rod, the TDC side seals are pushed outwardly, which in turn causes the TDC button seals to be pushed outwardly.

In operation, in one aspect, the TDC side seals can engage the respective first and second end plates along a small contact area, causing wear at that interface. In one aspect, as the TDC side seals wear, they engage the TDC button seals, which seal the compression chamber above the TDC surface seal. Further, in operation, the TDC side seals exert pressure onto respective TDC button seals against the inner surfaces of the respective first and second end plates, which restricts the TDC side seals' contact and pressure against the first and second end plates. In this aspect, the large combined surface area of the TDC button and side seal interface against the respective end plates reduces the applied pressure, which can effectively reduce wear to a minimal amount. In another aspect, this exemplified embodiment of the TDC button and side seals ensures that the side seals will substantially always be pressing against the internal surface of the button seal for maximizing the desired sealing.

In operation, fluid intake (such as air or other gas intake, liquid intake, etc.) is achieved via the various inlet ports described above. For example, inlet port(s) can be formed in the housing back cover that are in sealed fluid communication with an inlet port formed on the second end plate. The inlet port of the second end plate can be in fluid communication with an inlet port of the rotor. Thus, fluid, such as air, can be brought into the suction chamber of the rotary compressor. As can be appreciated, in an initial rotation of the rotor, fluid will be drawn into the suction chamber of the rotary compressor, defined behind the gate. At the end of the initial rotation, when the gate passes the TDC position, the fluid that was drawn into the suction chamber of the initial rotation becomes fluid in the compression chamber of the subsequent rotation.

Through this air (or other fluid) passageway, for example, air can be naturally pumped or drawn into the suction chamber by the rotation of the rotor and the low pressure (e.g., vacuum) force created by the movement of the rotor assembly (i.e., as the suction chamber volume behind the gate expands). Additionally, by having the air enter into the suction chamber through a side surface of the rotor, less flow inertia is necessary to fill the working chamber than in known compressors. Rather, air is "laid out" into the suction chamber by the inlet port in the rotor's side surface as the rotor rotates about the rotor axis of rotation. Each discrete element of the air enters into the suction chamber without having to push additional air out of its way, as is the case with known poppet and flapper valves. Instead, each discrete element of air is "pulled" into the suction chamber by the pressure gradient created by the rotor's movement.

In an expansion mode of operation, fluid flow can be sent through the rotor and out its periphery into the expansion chamber through a port provided proximate to and behind the gate. In this aspect, the fluid that is pressing against the gate does not have to transfer its pressure force through all the previously injected fluid, but rather the fresh charge of fluid pressure is always fed proximate to and behind the gate's distal end.

In another aspect, the air (or other fluid) intake allows the rotor to be cooled by the incoming air charge, which can aid in the longevity and efficiency of a rotary compressor assembled according to various aspects described herein.

In one aspect, the compression ratio of the rotary compressor can be determined by the selective positioning of the inlet and outlet ports described herein. The full rotation of the rotor within the rotary compressor can provide nearly a full 360 degree intake and compression "stroke." This can be altered in a fixed manner through the selective location of the inlet and/or outlet ports. Optionally, the stroke of the rotary compressor can also be made changeable, or variable in real time by using a moving port location. In this aspect, conventional shutters, sliding ports, sleeves, or similar means to change the location of the ports (inlet ports, outlet ports, or both) with respect to the rotor's position in its rotation can be used to vary the stroke of the rotary compressor. Likewise, it is contemplated that the amount of fluid ingested into the suction chamber can be variable using similar means.

According to yet another aspect, the bottom portion of the gate (i.e., the proximal portion opposite the distal end of the gate) can be used as a control valve, pump, etc. as can be envisioned from observing that the proximal portion of the gate is moved axially within the rotor bore. In this aspect, the rotor bore can be a blind bore. Thus, in the closed bottom portion of the bore, a closed working volume can be created wherein the up and down axial motion of the gate will expand and contract the volume of this closed working volume. This expansion and contraction can be used, through the incorporation of chosen valves, ports, and similar components of pumps or compressors, to effect a pump or compressor function in the bottom portion of the bore. Likewise, the proximal portion of the gate can be used as a sliding valve or sleeve valve through the use of ports formed therein the rotor bore at selected locations.

According to various aspects, the bottom or proximal portion of the gate can be configured to act as an additional gate, and can comprise a gate seal assembly (i.e., a gate apex seal and gate side seals positioned therein a respective slot at the proximal end of the gate) configured to contact the inner wall surface of the housing. As can be appreciated, by doubling the number of gates, the number of chambers therein the rotary compressor can be doubled. It is contemplated that additional inlet and outlet ports can be provided within the rotor and/or housing to effect the fluid flow into and out of the rotary compressor to maximize pumping efficiency. According to yet another aspect, a plurality of gates can be provided to increase the suction, compression, and/or pumping functions of the rotary compressor.

Figure 28:
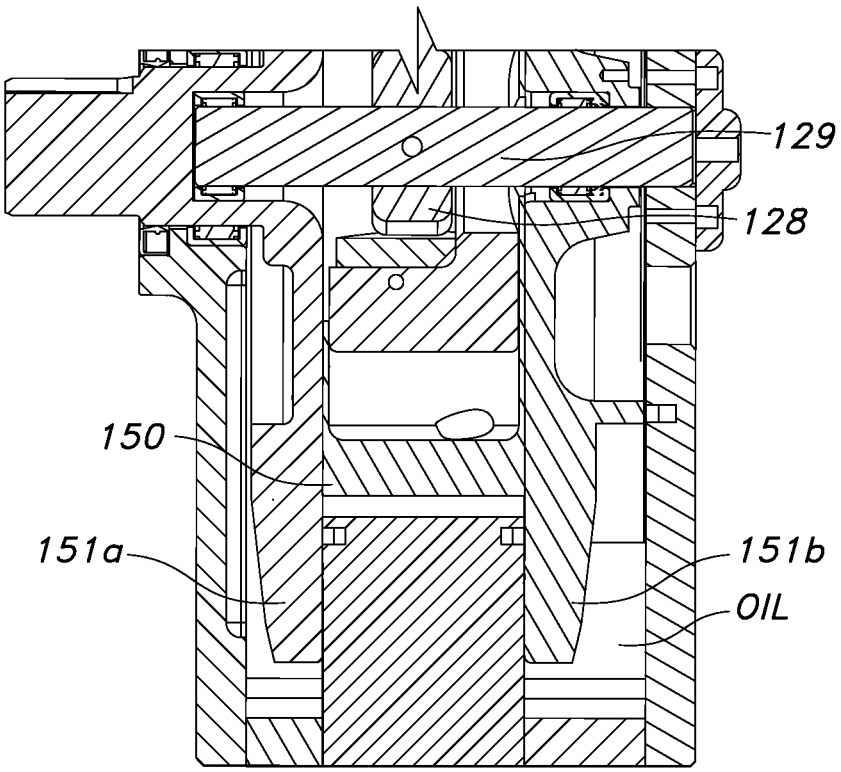
FIG. 28 is a partial cross-sectional view of one embodiment of a rotary compressor showing an exemplary lubrication means for lubricating desired portions of the rotary compressor.

Referring now to FIG. 28, an exemplary lubrication system of a rotary compressor is illustrated. In one aspect, the radial edges of the respective first and second end plates are configured to pass through an oil bath that is positioned therein the lower portions of the assembled rotary compressor as the rotor rotates. Oil that adheres to the portions of the first and second end plates is brought into the upper portions of the assembled rotary compressor. As the oil is brought into the upper portions, the housing seals are wetted and oil is flung off into the substantially open void between the first and second end plates and the respective housing front and back covers. Such an exemplary lubrication system can be used, for example, with an internally lubricated compressor or pump. It is of course contemplated that an oil bath can be omitted and the working fluid being compressed or pumped by the rotary compressor can act as a lubricant. In other aspects, a lubricant can be mixed with the working fluid to provide the necessary lubrication for the rotary compressor, including the various seals and contact surfaces.

According to various aspects, means for cooling the rotary compressor can be provided, such as but not limited to cooling fins placed in selected locations on the exterior of the housing, first and second end plates, and/or other locations, such that ambient air can access the cooling fins and promote heat transfer away from the apparatus into the ambient air. In other aspects, specific cooling circuits can be provided that incorporate air-to-air, liquid-to-air, air-to-liquid, or liquid-to-liquid cooling processes to achieve the desired cooling.

According to yet another aspect, the intake air can be routed through passages provided in the high temperature components of the rotary compressor to augment heat flux out of these areas and into the intake air stream. In some aspects, an external fan can be provided to facilitate air flow over the rotary compressor. Optionally, an oil cooling circuit can be utilized to provide the desired level of cooling. In some aspects, an oil separator device can be incorporated into the oil cooling circuit in which the outlet air is conditioned such that any airborne oil within the discharge stream is removed, cooled, and recirculated into the device.

As described above, in one aspect, the opposed bearing surfaces of the gate can interact with an eccentric cam to effect the axial movement of the gate within the rotor.

Figure 31:
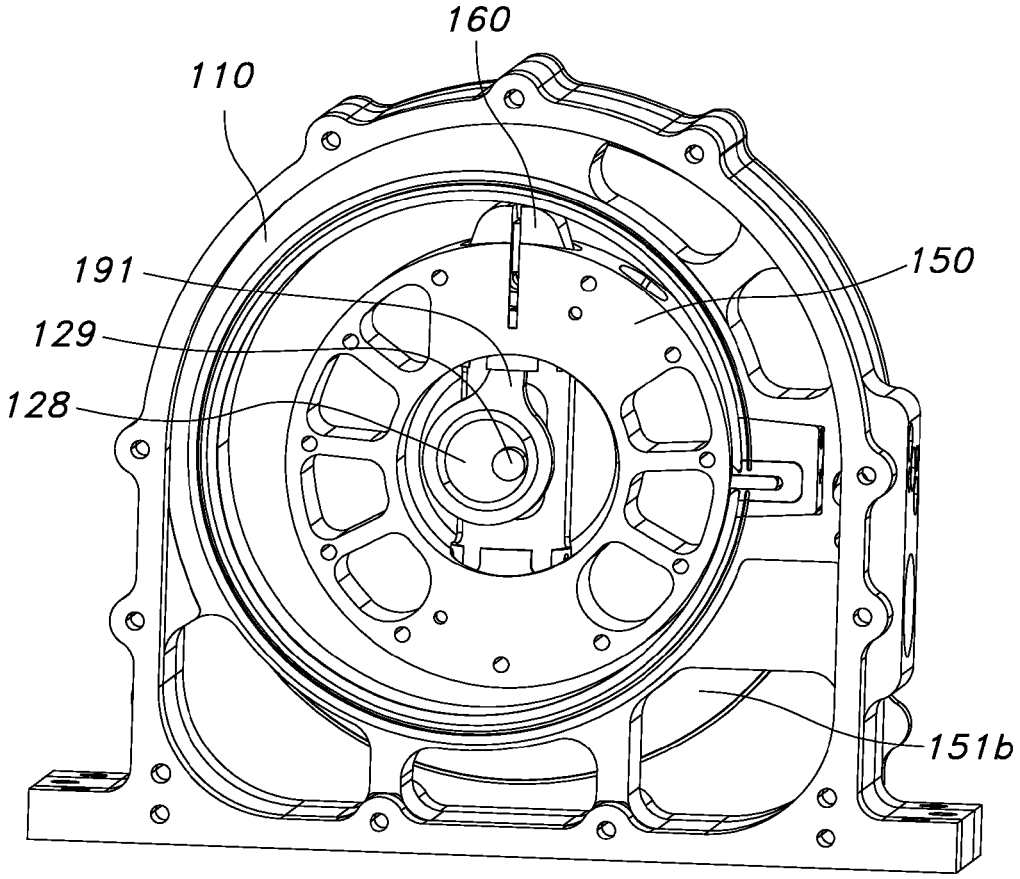
FIG. 31 is a partial schematic perspective view of one embodiment of a rotary compressor, showing a connecting rod assembly operatively coupled to the eccentric cam to effect the axial movement of the gate relative to the rotor.
Figure 32A:
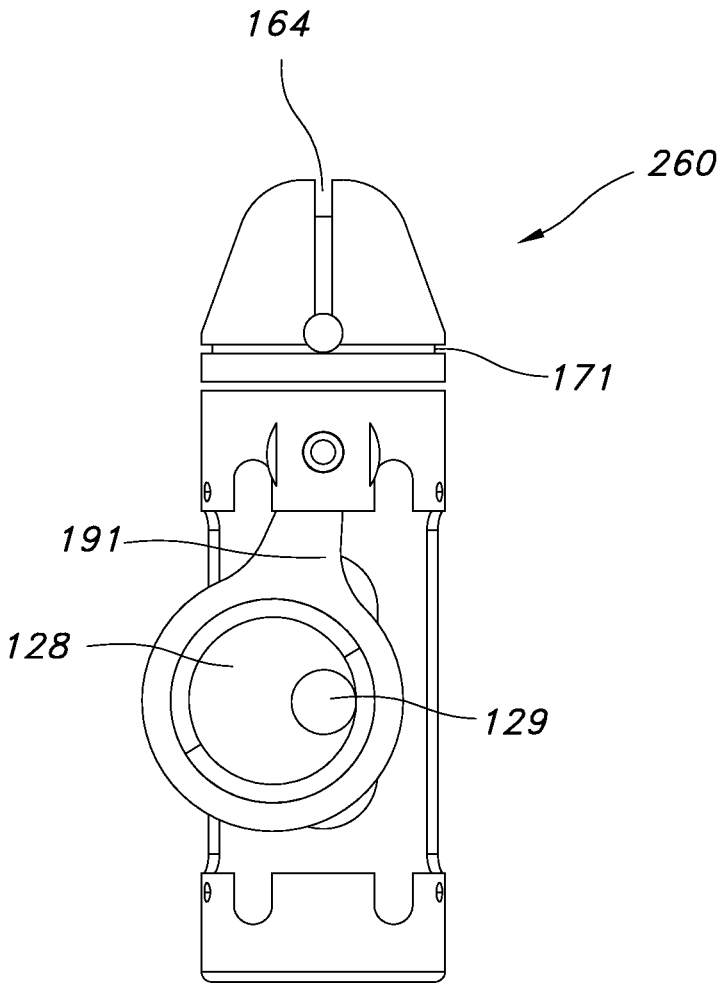
FIG. 32A is a schematic side elevational view of the gate and connecting rod assembly of FIG. 31.
Figure 32B:
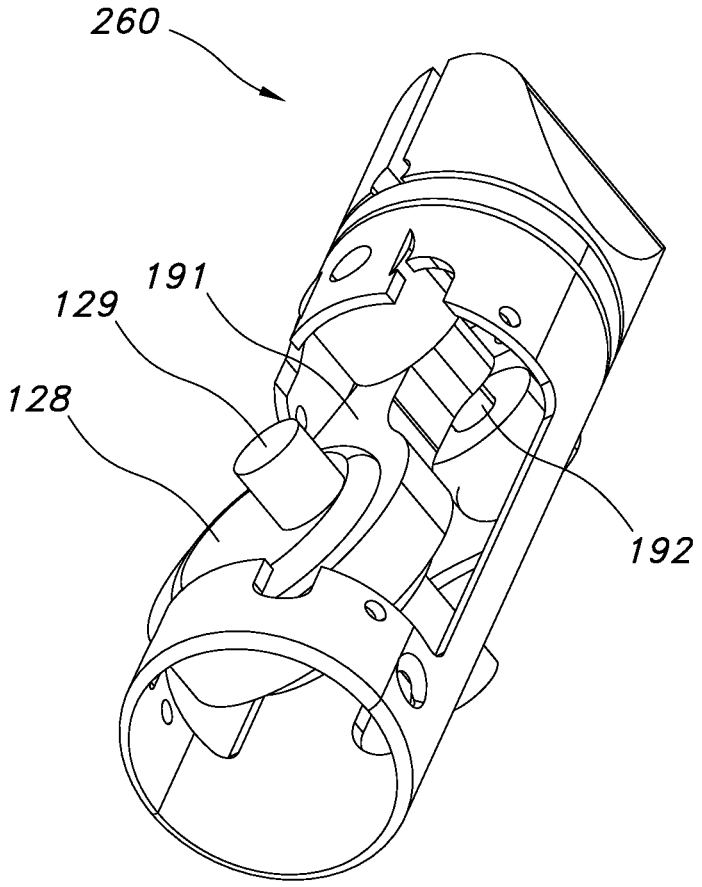
FIG. 32B is a schematic bottom perspective view of the gate and connecting rod assembly of FIG. 31.

According to another aspect, such as illustrated in FIGS. 31, 32A and 32B, a connecting rod assembly can be provided to interact with the eccentric cam to effect the axial movement of the gate. For example, as shown in FIGS. 32A and 32B, a connecting rod 191 can be attached to the gate 260 (such as, but not limited to, with a pin 192) proximate the distal end of the gate. The connecting rod can extend downwardly into the hollow of the gate. In one aspect, the portion of the connecting rod that extends into the hollow defines a hole sized and shaped to receive the cam. As the rotor rotates about the rotor axis of rotation, the connecting rod will likewise rotate about the cam, thereby causing the axial movement of the gate within the rotor bore.

Figure 33A:
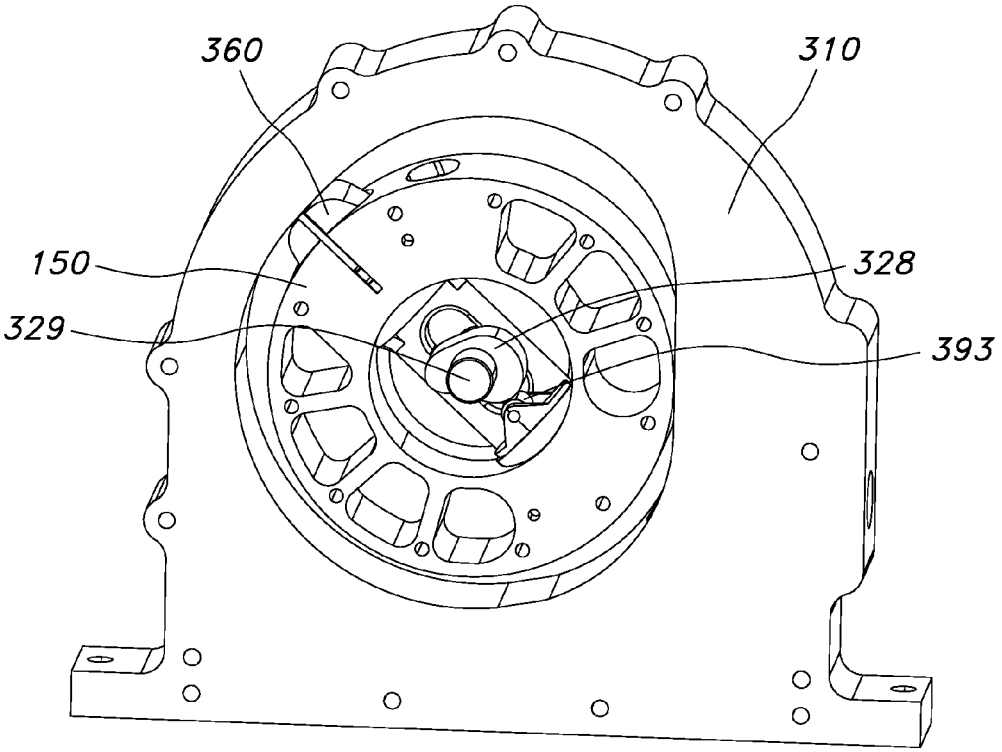
FIG. 33A is a partial schematic perspective view of one embodiment of a rotary compressor, showing a cam follower assembly operatively bearing on a cam to effect the axial movement of the gate relative to the rotor, and showing an exemplary non-circular interior cavity of the housing.
Figure 33B:
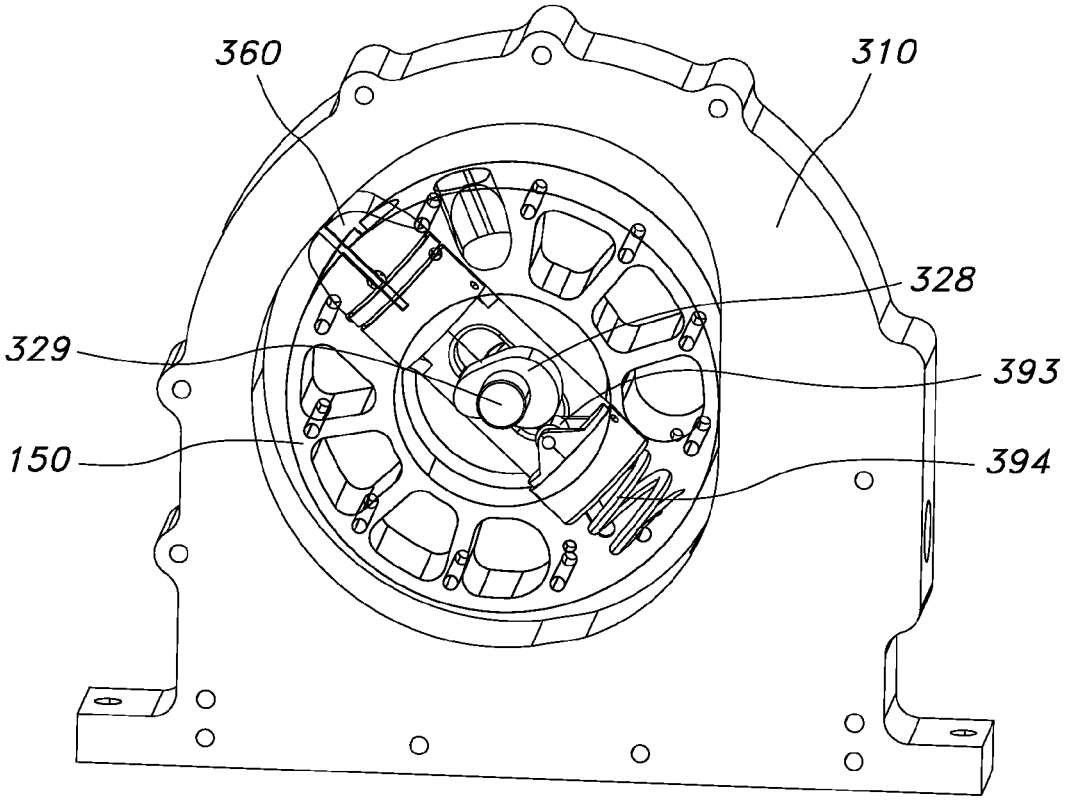
FIG. 33B is a schematic partially transparent view of the rotary compressor of FIG. 33A, showing a spring mounted therein the rotor and configured to urge the gate axially with respect to the rotor.
Figure 34:
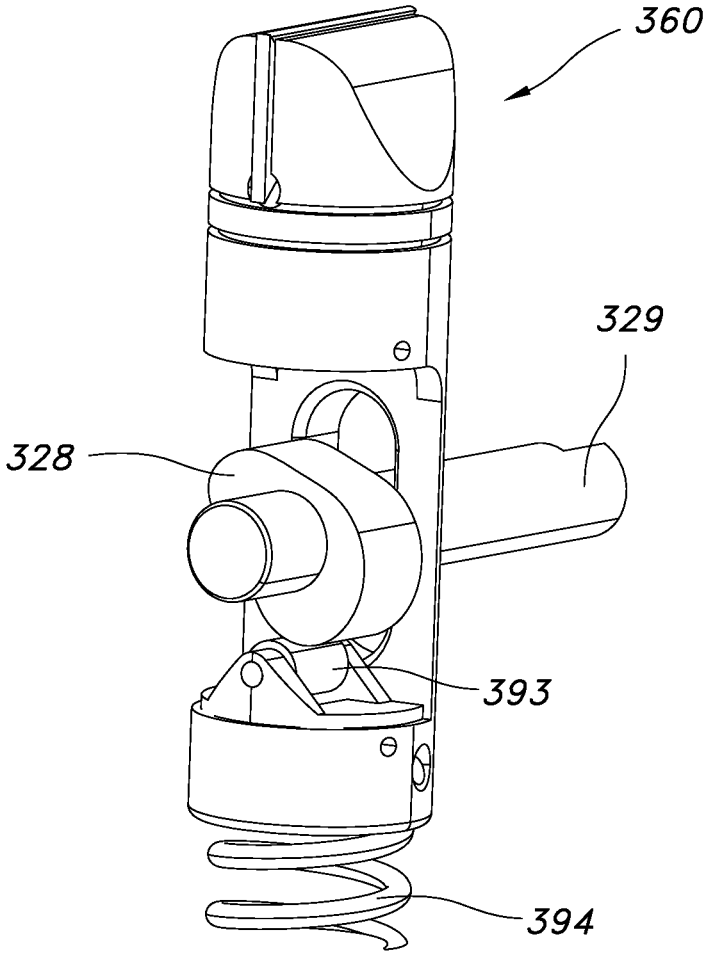
FIG. 34 is a perspective view of the cam follower assembly of the gate shown in FIG. 33A, operatively bearing on the cam, and showing the spring positioned with respect to a proximal end of the gate.

Referring to FIGS. 33A, 33B and 34, according to yet another aspect, the axial movement of the gate can be effected by a cam-follower mechanism in the gate 360. In this aspect, it is contemplated that the cam 328 can have any shape, such as but not limited to the non-circular shape shown in FIG. 33A. A cam-follower mechanism comprising a roller 393 can be provided therein the gate, with the roller extending into the hollow of the gate to interact with the cam. As shown in FIGS. 33B and 34, a spring 394 can be provided to urge the roller against the surface of the cam. As the rotor rotates about the rotor axis of rotation, the roller will follow the cam, thereby causing the axial movement of the gate within the bore of the rotor. As shown in the figures, it is contemplated that in this aspect, the housing 310 can define an internal cavity having any cross-sectional shape, such as but not limited to the non-circular shape shown in FIG. 33A.

As exemplarily illustrated, in the various embodiments described herein, it is contemplated that the shape of the internal cavity of the housing can be selected to complement the shape of the cam, and vice versa, such that the distal end of the gate can be constrained to be spaced proximate from the inner wall surface of the housing as the rotor rotates about the rotor axis of rotation.

Figure 35A:
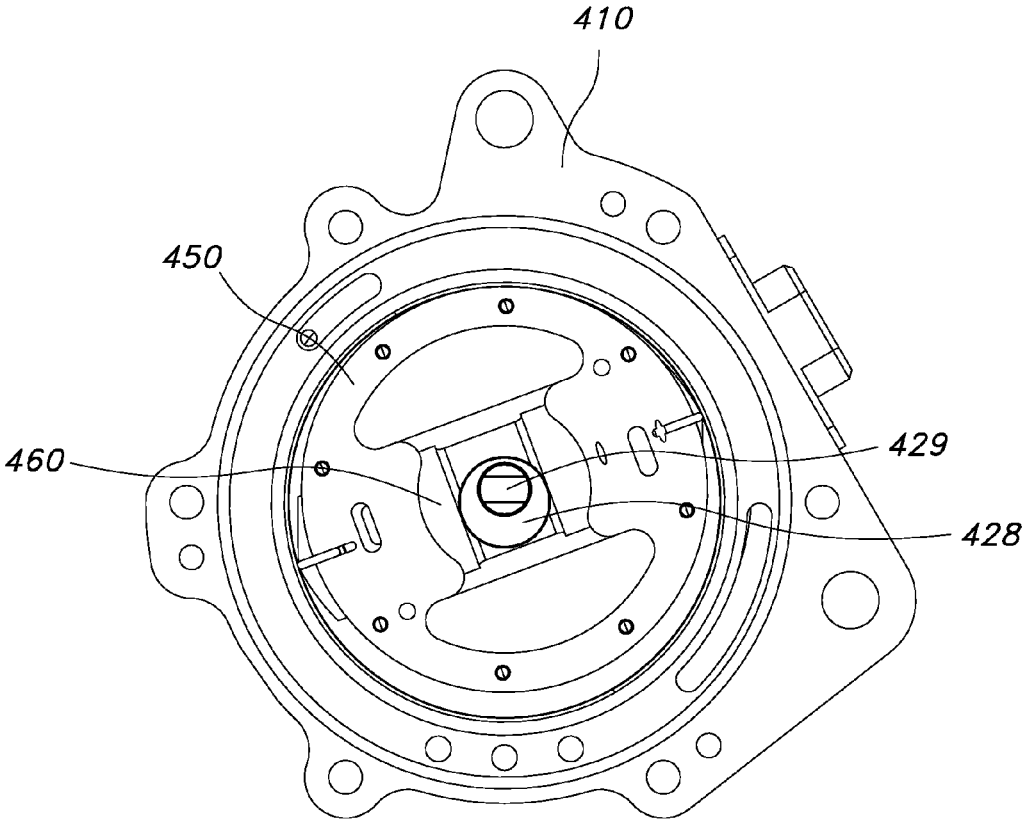
FIG. 35A is a schematic perspective view of an embodiment of a rotary compressor, showing a dual-end gate mounted therein, and movable relative to, a rotor of the rotary compressor.
Figure 35B:
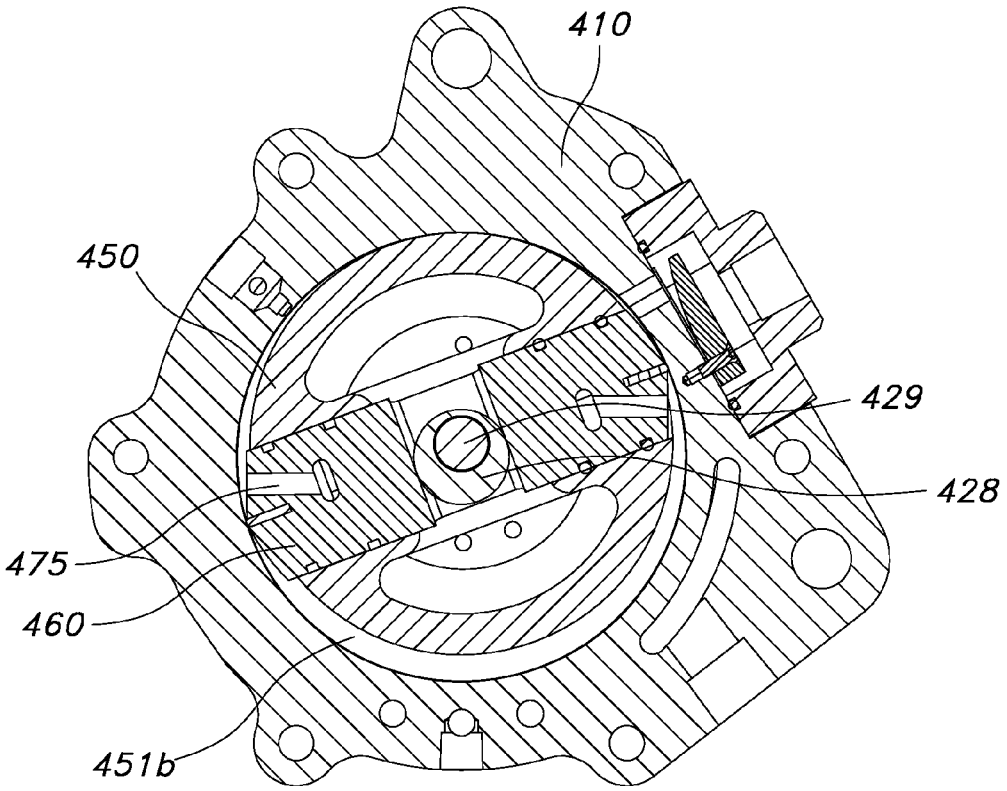
FIG. 35B is a cross-sectional view of the rotary compressor of FIG. 35A, showing inlet ports formed therein the dual-end gate.

According to various other aspects, the rotary compressor can comprise gate assemblies comprising one or more gates and/or comprising one or more end portions configured to be spaced proximate from the inner wall surface of the housing. For example, as illustrated in FIGS. 35A and 35B, the rotary compressor can comprise a dual-end gate 460. In this aspect, the bore of the rotor can be configured to extend fully therethrough the rotor to receive the dual-end gate 460 and the dual-end gate can be slidably mounted therewith the rotor 450 and movable axially therein. The dual-end gate can have a distal end and an opposed proximal end. The dual-end gate can be movable axially therein the rotor bore about and between a first position in which the distal end of the dual-end gate is positioned at a first distance from the peripheral surface of the rotor, and a second position in which the distal end of the dual-end gate is positioned at a second distance from the peripheral surface of the rotor. It is contemplated that, in the first position, the proximal end of the dual-end gate is positioned at substantially the second distance from the peripheral surface of the rotor, and in the second position, the proximal end of the dual-end gate is positioned at substantially the first distance from the peripheral surface of the rotor. Each of the distal end and proximal end of the dual-end gate can be constrained to be spaced proximate from the inner wall surface of the housing as the rotor rotates about the rotor axis of rotation.

In one aspect, at least portions of the peripheral surface of the rotor 450, portions of the inner wall surface of the housing 410, and varying portions of the dual-end gate 460 proximate the distal end of the dual-end gate define a first compression chamber of varying volume as the rotor rotates about the rotor axis of rotation. Similarly, at least portions of the peripheral surface of the rotor, portions of the inner wall surface of the housing, and varying portions of the dual-end gate proximate the proximal end of the dual-end gate define a second compression chamber of varying volume as the rotor rotates about the rotor axis of rotation.

According to yet another aspect, at least one inlet port 475 can be formed therein the dual-end gate assembly. In a particular aspect, an inlet port is formed therein each of the distal and proximal ends of the dual-end gate. In one aspect, the distal end can define at least one inlet port in fluid communication with the first compression chamber. In another aspect, the proximal end can define at least one inlet port in fluid communication with the second compression chamber. According to yet another aspect, each of the distal end and proximal end can define at least one inlet port in fluid communication with the first compression chamber and second compression chamber, respectively.

According to various aspects, the rotary compressor can further comprise means for selectively opening and closing the at least one inlet port therein the respective distal end and proximal ends of the dual-end gate. For example and not meant to be limiting, as illustrated in the cross-sectional view of FIG. 35B, the inlet port(s) 475 of the dual-end gate can be configured to align with a respective inlet port 457 of an end plate, such as but not limited to a second end plate 451*b*, of the rotary compressor at a predetermined position in the dual-end gate's axial movement within the bore of the rotor. At this predetermined position, the gate inlet port(s) 475 can provide an intake passageway between the inlet port of the second end plate and a respective one of the first or second compression chambers. As the rotor rotates about the rotor axis of rotation, thereby effecting the axial movement of the dual-end gate therein the rotor bore, the intake passageway can be selectively opened and closed based on the alignment or non-alignment, respectively, of the gate inlet port(s) 475 and the end plate inlet port(s) 457.

Figure 36:
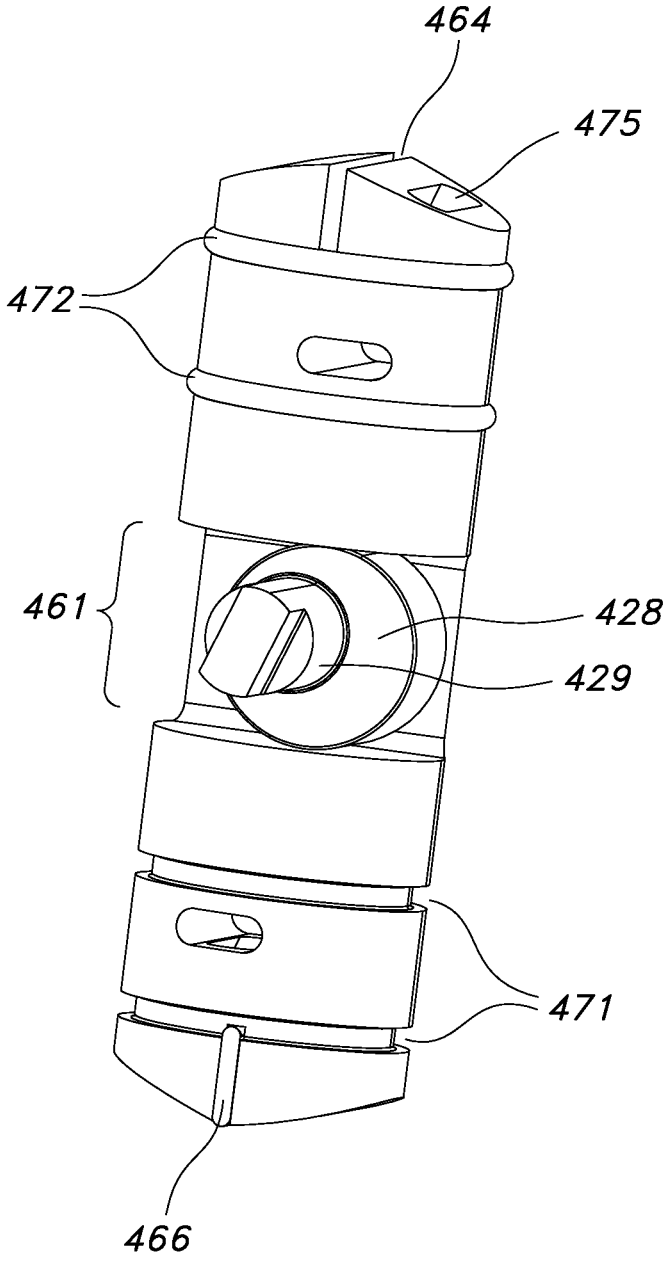
FIG. 36 is a schematic perspective view of the dual-end gate of FIG. 35A in operative cooperation with an eccentric cam.

As shown in FIG. 36, the dual-end gate 460 can define a hollow 461 having at least one bearing surface that is configured for selective contact with portions of the cam 428. The distal end and an opposing proximal end of the dual-end gate can each define a respective slot 464 for receiving a respective gate apex seal 466. In one aspect, the gate apex seal 466 can be a unitary seal configured to provide side and apex sealing of the gate against the first and second end plates and the inner wall surface of the housing, respectively. Optionally, a gate apex seal and side seals, such as discussed with reference to the gate described with respect to FIG. 18A, can be provided. According to another aspect, each end portion of the dual-end gate assembly can define at least one groove 471 for receiving a respective gate sealing element 472.

In one aspect, a TDC assembly can be provided therein the housing, such as described above. Of course, it is contemplated that the housing, such as shown in FIGS. 35A and 35B, can be provided without a TDC assembly. In this aspect, the sealing between the housing and the rotor and/or gates can be provided by close manufacturing tolerances or other means.

Figure 37:
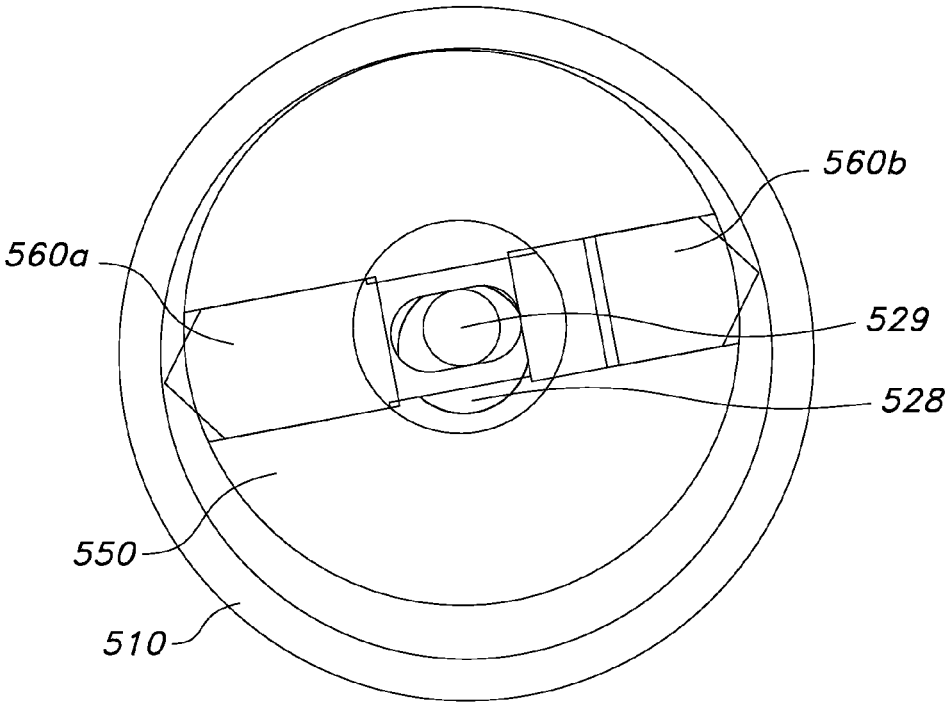
FIG. 37 is a schematic front elevational view of an embodiment of a rotary compressor, showing a double-gate assembly mounted therein, and movable relative to, a rotor of the rotary compressor.
Figure 38:
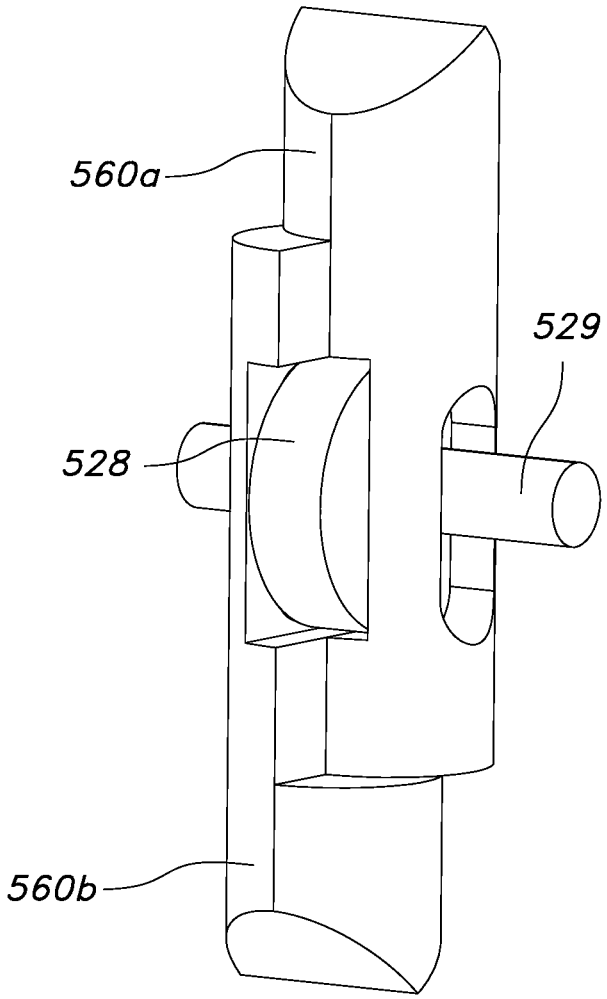
FIG. 38 is a schematic perspective view of the double-gate assembly of FIG. 37.

As described above, a gate having dual end portions can be formed as a unitary dual-end gate assembly. Optionally, and with reference to FIGS. 37 and 38 for example, a double-gate assembly can be provided that comprises a first gate portion 560*a* and a second gate portion 560*b*, each in operative cooperation with the eccentric cam 528. Each of the first and second gate portions can comprise a respective distal end portion that can be constrained to be spaced proximate from the inner wall surface of the housing as the rotor rotates about the rotor axis of rotation. As described above with regard to an exemplary gate assembly 160, each gate portion 560*a*, 560*b* of the double-gate assembly can define a hollow having at least one bearing surface that is configured for selective contact with portions of the cam 528. The at least one bearing surface can comprise a pair of opposed bearing surfaces machined in each of the gate portions, and/or provided by an upper and lower eccentric plate such as described above. In one aspect, each of the first and second gate portions can comprise a pair of opposed bearing surfaces that are at least partially curved such as described with respect to the gate shown in FIG. 17. As the rotor 550 rotates about the rotor axis of rotation, each of the first and second gate portions 560*a*, 560*b* can operatively cooperate with the cam 528 to effect the axial movement of the first and second gate portions therein the rotor bore, thereby effectively controlling the position of the distal end of each of the gate portions with respect to the inner wall surface of the housing 510.

Figure 39:
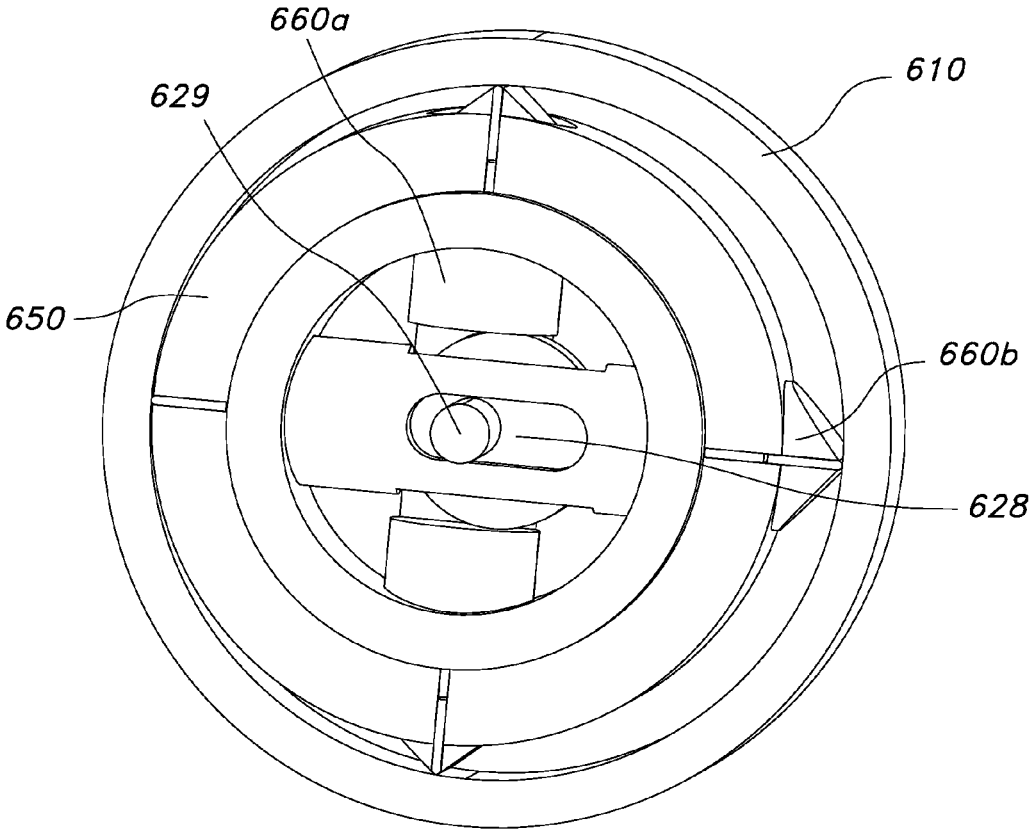
FIG. 39 is a schematic perspective view of an embodiment of the rotary compressor, showing a quad-gate assembly mounted therein, and movable relative to, a rotor of the rotary compressor.
Figure 40:
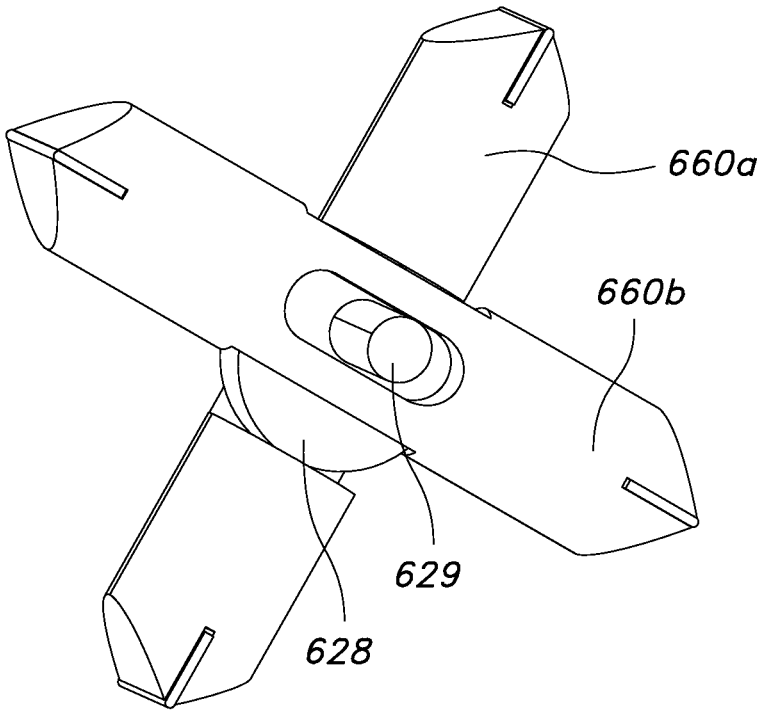
FIG. 40 is a schematic perspective view of the quad-gate assembly of FIG. 39 in operative cooperation with an eccentric cam.

According to yet another aspect, the rotary compressor can comprise a quad-gate assembly 660, such as illustrated in FIGS. 39 and 40. In one aspect, the quad-gate assembly can comprise two dual-sided gate assemblies, each having opposing end portions and defining a substantially central hollow having at least one bearing surface configured for selective contact with portions of the cam 628. The dual-sided gate assemblies can be positioned substantially perpendicularly to each other such that the cam is positioned therein the hollow of each of the dual-sided gate assemblies. According to one aspect, at least portions of the peripheral surface of the rotor 650, portions of the inner wall surface of the housing 610, and varying portions of the quad-gate assembly 660 proximate each end portion of the dual-sided gate assemblies can define a plurality of suction and/or compression chambers.

EXPERIMENTAL

Figure 41:
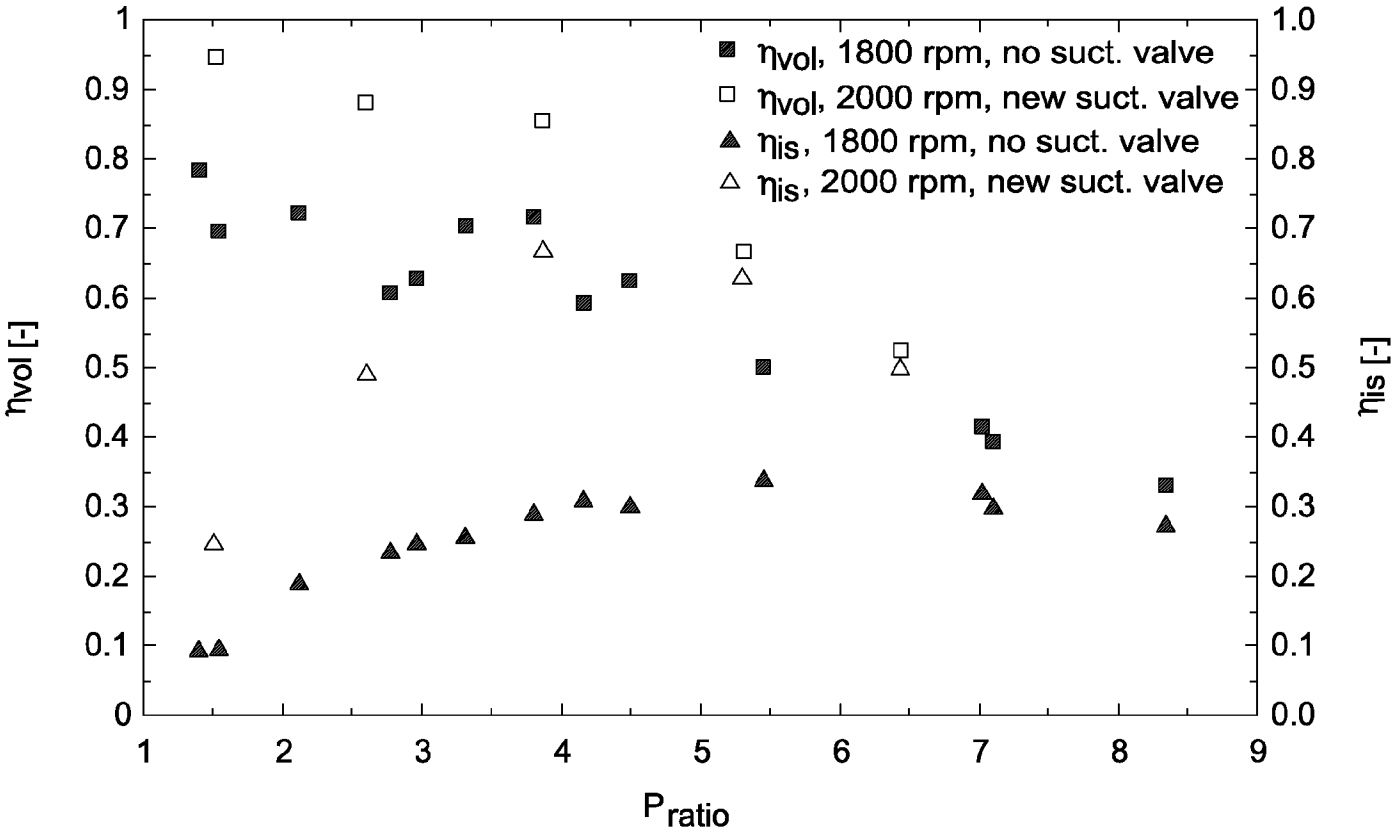
FIG. 41 is a graph illustrating the volumetric efficiency of an exemplary rotary compressor run at various rpm with and without an intake valve.

A prototype rotary compressor was constructed as illustrated in FIGS. 4A and 4B. The internal cavity of the housing had an internal diameter of 129.5 mm. The swept volume of the rotary compressor was 98 $cm^3$ and the clearance volume was 3.8 $cm^3$, yielding a compression ratio of 26:1. Several test runs were performed using the rotary compressor and the data from the test runs are shown in FIG. 41. As can be seen, test runs were performed at 1800 rpm and 2000 rpm with an intake valve; additional test runs were performed at 1800 and 2000 rpm without an intake valve. The volumetric efficiency ($\eta_{vol}$) and isentropic efficiency ($\eta_{is}$) were calculated using the following equations:

$$\eta_{vol} = \frac{\dot{m}_{act} \cdot v_1}{\dot{V}_{th}}$$

$$\eta_{is} = \frac{\dot{m}_{act} \cdot (h_{2s} - h_1)}{\dot{W}_{comp}}$$

where $\dot{m}_{act}$ is the measured mass flow rate (kg/s); $v_1$ is the specific volume at state point 1 ($m^3$/kg); $\dot{V}_{th}$ is the theoretical volume flow rate ($m^3$/s); $h_1$ is the enthalpy at state point 1 (kJ/kg); $h_{2s}$ is the enthalpy at state point 2 for an isentropic compression process (kJ/kg); and $\dot{W}_{comp}$ is the input power to the compressor (W).

Figure 42:
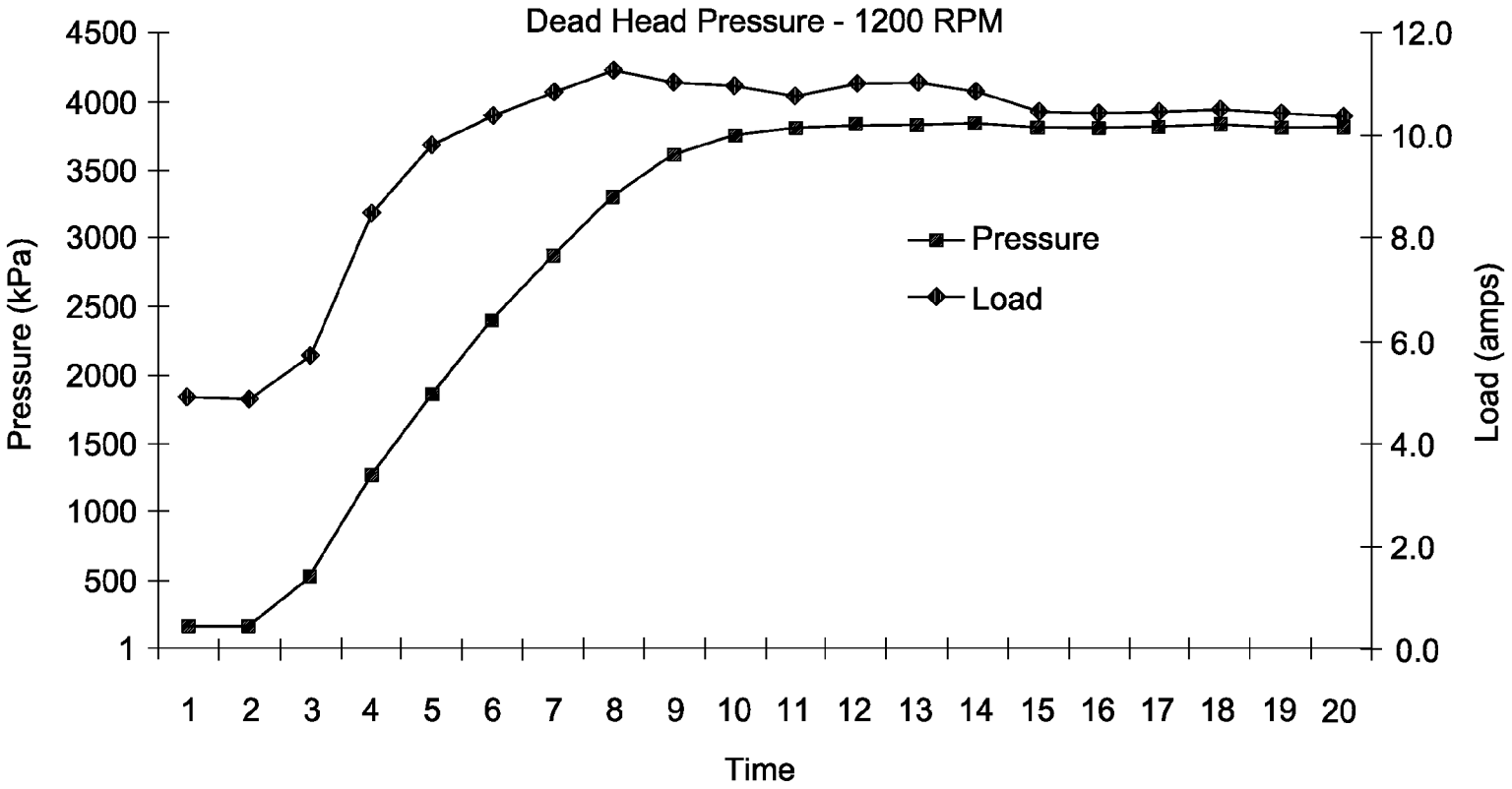
FIG. 42 is a graph illustrating the dead head pressure of an exemplary rotary compressor run at 1200 rpm.

Additional tests were performed to measure the "dead head" pressure capabilities of the prototype. At 1200 rpm, a pressure ratio exceeding 38:1 was recorded. The results of this test can be seen in FIG. 42.

It will be apparent to those skilled in the art that various modifications and variations can be made in the present invention without departing from the scope or spirit of the invention. Other aspects of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A rotary compressor, comprising:

a housing defining an internal cavity having an inner wall surface, wherein the internal cavity of the housing has a housing longitudinal axis extending transverse to a housing plane that bisects the inner wall surface;

a rotor having a peripheral surface and being positioned within the internal cavity of the housing, the rotor configured to rotate about a rotor axis of rotation eccentric to the housing longitudinal axis, wherein the rotor has a first side surface and an opposed second side surface, and wherein the rotor further comprises a pair of end plates that rotate therewith the respective first and second side surfaces of the rotor; and a gate having a distal end, the gate being slidably mounted therewith the rotor and translates axially relative to the rotor about and between a first position, in which the distal end of the gate is positioned at a first distance from the peripheral surface of the rotor, and a second position, in which the distal end of the gate is positioned at a second distance from the peripheral surface of the rotor, wherein the distal end of the gate is constrained to be spaced proximate from the inner wall surface of the housing as the rotor rotates about the rotor axis of rotation; wherein at least portions of the peripheral surface of the rotor, portions of the inner wall surface, and varying portions of the gate proximate the distal end of the gate define a chamber of varying volume as the rotor rotates about the rotor axis of rotation.

2. The rotary compressor of claim 1, further comprising at least one inlet port in fluid communication with the compression chamber.

3. The rotary compressor of claim 2, wherein the at least one inlet port is in the gate.

4. The rotary compressor of claim 2, wherein the at least one inlet port is in the housing.

5. The rotary compressor of claim 1, wherein the first distance is greater than the second distance.

6. The rotary compressor of claim 1, wherein the second distance is proximal to the peripheral surface of the rotor.

7. The rotary compressor of claim 1, wherein, in the second position, the distal end of the gate is at or below the peripheral surface of the rotor.

8. The rotary compressor of claim 1, wherein the housing has at least one outlet port in fluid communication with the compression chamber.

9. The rotary compressor of claim 1, further comprising least one outlet port in fluid communication with the compression chamber.

10. The rotary compressor of claim 9, further comprising means for selectively opening and closing the at least one outlet port therein the gate.

11. The rotary compressor of claim 1, further comprising a cam positioned therein the internal cavity of the housing about a cam axis and configured to selectively engage portions of the gate to effect the axial movement of the gate about and between the respective first and second positions.

12. The rotary compressor of claim 11, wherein the rotor is configured to act on select portions of the gate to effect the constrained axial movement of the gate relative to the peripheral surface of the rotor.

13. The rotary compressor of claim 11, wherein the rotor defines a bore configured for slidable receipt of the gate, and wherein the gate defines a hollow having at least one bearing surface that is configured for selective contact with portions of the cam.

14. The rotary compressor of claim 13, wherein the at least one bearing surface comprises a pair of opposed bearing surfaces.

15. The rotary compressor of claim 14, wherein the rotor defines a centrally positioned chamber configured for rotative receipt of the cam, wherein the bore has a bore axis that bisects a center of the chamber, and wherein the pair of opposed bearing surfaces of the gate are positioned substantially transverse to the bore axis.

16. The rotary compressor of claim 15, wherein the pair of opposed bearing surfaces are spaced from each other along a longitudinal axis of the gate and are positioned opposite each other about the cam axis.

17. The rotary compressor of claim 13, further comprising means for minimizing distortion and deflection of the gate at high fluid pressures.

18. The rotary compressor of claim 17, wherein at least a portion of the bore of the rotor has a cylindrical cross-sectional shape, and wherein at least portions of the gate have a cylindrical cross-sectional shape that is complementary to the bore of the rotor.

19. The rotary compressor of claim 1, wherein the distal end of the gate is constrained to be spaced proximate from the inner wall surface of the housing in a constrained range of between about 0.0001 inches to about 0.2000 inches.

20. The rotary compressor of claim 1, wherein the distal end of the gate is constrained to be spaced proximate from the inner wall surface of the housing in a constrained range of between about 0.0003 inches to about 0.1500 inches.

21. The rotary compressor of claim 1, wherein the distal end of the gate is constrained to be spaced proximate from the inner wall surface of the housing in a constrained range of between about 0.0005 inches to about 0.1000 inches.

22. The rotary compressor of claim 1, wherein the distal end of the gate is constrained to be spaced proximate from the inner wall surface of the housing in a constrained range of between 0.01% and 15.0% of a diameter of the inner cavity.

23. The rotary compressor of claim 1, wherein the distal end of the gate defines a slot, and further comprising a seal assembly comprising at least one planar member movable therein the slot of the gate, and wherein the seal assembly further comprises a bias element configured to selectively act on the at least one planar member to maintain an outer edge of the at least one planar member in sliding contact with the inner wall surface of the housing as the rotor rotates.

24. The rotary compressor of claim 23, wherein the seal assembly further comprises a means for applying a biasing force acting upon the at least one planar member to maintain the outer edge of the at least one planar member in sliding contact with the inner wall surface of the housing as the rotor rotates.

25. The rotary compressor of claim 1, wherein at least one of the pair of end plates defines an inlet port in fluid communication with the compression chamber.

26. The rotary compressor of claim 1, wherein at least one of the pair of end plates defines an outlet port in fluid communication with the compression chamber.

27. The rotary compressor of claim 1, wherein the housing has a front surface and an opposed back surface, wherein portions of a first end plate of the pair of end plates sealingly and slidably contacts portions of the front surface of the housing; and wherein portions of a second end plate plates sealingly and slidably contacts portions of the back surface of the housing.

28. The rotary compressor of claim 1, further comprising a pair of end plates, wherein the housing has a front surface and an opposed back surface, wherein a first end plate of the pair of end plates is mounted to the front surface of the housing; and wherein a second end plate of the plurality of end plates is mounted to the back surface of the housing.

29. A rotary compressor, comprising:

a housing defining an internal cavity having an inner wall surface, wherein the internal cavity of the housing has a housing longitudinal axis extending transverse to a housing plane that bisects the inner wall surface;

a rotor having a peripheral surface and being positioned within the internal cavity of the housing, the rotor configured to rotate about a rotor axis of rotation eccentric to the housing longitudinal axis;

a gate having a distal end, the gate being slidably mounted therewith the rotor and translatable axially relative to the rotor about and between a first position and a second position; and a means for constraining the axial movement of the gate such that the distal end of the gate is constrained to be spaced proximate from the inner wall surface of the housing as the rotor rotates about the rotor axis of rotation in a constrained range of between 0.01% and 15.0% of a diameter of the inner cavity; wherein at least portions of the peripheral surface of the rotor, portions of the inner wall surface, and varying portions of the gate proximate the distal end of the gate define a compression chamber of varying volume as the rotor rotates about the rotor axis of rotation.

30. A rotary compressor, comprising:

a housing defining an internal cavity having an inner wall surface, wherein the internal cavity of the housing has a housing longitudinal axis extending transverse to a housing plane bisecting the inner wall surface;

a rotor having a peripheral surface and defining a bore having a bore axis that extends therein the peripheral surface of the rotor, the rotor being positioned within the internal cavity of the housing and configured to rotate about a rotor axis of rotation eccentric to the housing longitudinal axis;

a gate having a distal end, the gate being slidably mounted therein the bore of the rotor and constrained for movement axially along the bore axis about and between a first extended position and a second retracted position, wherein the distal end of the gate is constrained to be spaced proximate from the inner wall surface of the housing as the rotor rotates about the rotor axis of rotation; and a cam positioned therein the internal cavity of the housing about a cam axis and configured to selectively engage portions of the gate to effect the axial movement of the gate about and between the respective first and second positions, wherein the gate has at least one bearing surface that is configured for selective contact with portions of the cam, and wherein the distal end of the gate is constrained to be spaced proximate from the inner wall surface of the housing in a constrained range of between 00.01% and 15.0% of a diameter of the inner cavity.

31. The rotary compressor of claim 30, wherein the rotor defines a centrally positioned chamber configured for rotative receipt of the cam, and wherein the bore axis bisects a center of the chamber.

32. The rotary compressor of claim 31, wherein the at least one bearing surface comprises a pair of opposed bearing surfaces.

33. The rotary compressor of claim 32, wherein the pair of opposed bearing surfaces of the rotor are positioned substantially transverse to the bore axis.

34. The rotary compressor of claim 33, wherein the pair of opposed bearing surfaces are spaced from each other along a longitudinal axis of the gate and are positioned opposite each other about the cam axis.

35. The rotary compressor of claim 30, wherein at least portions of the peripheral surface of the rotor, portions of the inner wall surface, and varying portions of the gate proximate the distal end of the gate define a compression chamber of varying volume as the rotor rotates about the rotor axis of rotation.

36. The rotary compressor of claim 30, further comprising an inlet port in fluid communication with the compression chamber.

37. The rotary compressor of claim 30, further comprising an outlet port in fluid communication with the compression chamber.

38. The rotary compressor of claim 30, wherein the rotor is configured to act on select portions of the gate to effect the constrained axial movement of the gate relative to the peripheral surface of the rotor.

39. The rotary compressor of claim 30, wherein the distal end of the gate is constrained to be spaced proximate from the inner wall surface of the housing in a constrained range of between about 0.0001 inches to about 0.2000 inches.

40. The rotary compressor of claim 30, wherein the distal end of the gate is constrained to be spaced proximate from the inner wall surface of the housing in a constrained range of between about 0.0005 inches to about 0.1000 inches.

41. The rotary compressor of claim 30, wherein, in the first position, the distal end of the gate is spaced from the peripheral surface of the rotor.

42. The rotary compressor of claim 30, wherein, in the second position, the distal end of the gate is about or below the peripheral surface of the rotor.

43. The rotary compressor of claim 30, wherein the distal end of the gate defines a slot, and further comprising a seal assembly comprising at least one planar member movable therein the slot of the gate.

44. The rotary compressor of claim 43, wherein the seal assembly further comprises a bias element configured to selectively act on the at least one planar member to maintain an outer edge of the at least one planar member in sliding contact with the inner wall surface of the housing as the rotor rotates.

45. The rotary compressor of claim 43, wherein the seal assembly further comprises a means for applying a biasing force acting upon the at least one planar member to maintain an outer edge of the at least one planar member in sliding contact with the inner wall surface of the housing as the rotor rotates.

46. The rotary compressor of claim 30, wherein at least a portion of at least one bearing surface is curved.

47. The rotary compressor of claim 30, wherein the rotor has a first side surface and an opposed second side surface, further comprising a pair of end plates that are mounted to and rotate therewith the respective first and second side surfaces of the rotor.

48. The rotary compressor of claim 47, wherein the housing has a front surface and an opposed back surface, wherein portions of a first end plate of the pair of end plates sealingly and slidably contact portions of the front surface of the housing, and wherein portions of a second end plate of the pair of end plates sealingly and slidably contact portions of the back surface of the housing.

49. The rotary compressor of claim 30, further comprising a pair of end plates, wherein the housing has a front surface and an opposed back surface, wherein a first end plate of the pair of end plates is mounted to the front surface of the housing, and wherein a second end plate of the plurality of end plates is mounted to the back surface of the housing.

50. The rotary compressor of claim 30, further comprising a seal element extending outwardly from the inner wall surface of the housing proximate the location of minimal running clearance between the inner wall surface of the housing and the peripheral surface of the rotor, wherein an edge of the seal element is configured for selective slidable contact with the peripheral surface of the rotor.

51. The rotary compressor of claim 50, further comprising means for withdrawing the seal element within the housing such that the edge of the seal element is at or below the inner wall surface of the housing when the distal end of the gate passes over the seal element as the rotor rotates.

* * * * *